US006405004B2

(12) United States Patent
Matsuzaki et al.

(10) Patent No.: US 6,405,004 B2
(45) **Date of Patent: *Jun. 11, 2002**

(54) PROCESS CARTRIDGE AND IMAGE FORMING APPARATUS

(75) Inventors: Hiroomi Matsuzaki; Naoki Asano, both of Mishima (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/575,533

(22) Filed: May 22, 2000

(30) Foreign Application Priority Data

| | | |
|---|---|---|
| May 20, 1999 | (JP) | 11-139905 |
| Jul. 15, 1999 | (JP) | 11-201207 |
| Aug. 31, 1999 | (JP) | 11-245139 |
| Aug. 31, 1999 | (JP) | 11245163 |
| May 1, 2000 | (JP) | 12-132240 |

(51) Int. Cl.[7] ..... G03G 21/16
(52) U.S. Cl. ..... 399/111
(58) Field of Search ..... 399/111, 116, 399/119

(56) References Cited

U.S. PATENT DOCUMENTS

| | | | | |
|---|---|---|---|---|
| 3,985,436 A | * | 10/1976 | Tanaka et al. | 399/111 |
| 4,609,276 A | | 9/1986 | Mitzutani | 355/3 R |
| 4,873,548 A | | 10/1989 | Kobayashi et al. | 355/200 |
| 4,876,572 A | * | 10/1989 | Nagatsuna | 399/111 |
| 5,138,374 A | * | 8/1992 | Bellis | 399/111 |
| 5,907,751 A | * | 5/1999 | Kawaguchi et al. | 399/111 X |
| 5,943,529 A | | 8/1999 | Miyabe et al. | 399/111 |
| 5,966,567 A | | 10/1999 | Matsuzuki et al. | 399/111 |
| 6,011,941 A | | 1/2000 | Takashima et al. | 399/111 |
| 6,101,350 A | * | 8/2000 | Suzuki et al. | 399/111 X |

* cited by examiner

*Primary Examiner*—Fred L. Braun
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive member; a developing member for developing an electrostatic latent image formed on the electrophotographic photosensitive member; a developer accommodating portion for accommodating a developer to be used by the developing member to develop the electrostatic latent image; a cartridge guide for being guided by a main assembly side guide provided in the main assembly of the apparatus; a first cartridge positioning portion; provided at one end portion in an axial direction of the electrophotographic photosensitive member, for engagement with a first main assembly side positioning portion, provided in the main assembly of the apparatus, in response to falling of a side of the process cartridge opposite from a side having the developer accommodating portion in the direction crossing with the axial direction of the electrophotographic photosensitive member by operation of a lever provided in the main assembly of the apparatus; a second cartridge positioning portion, provided at the other end portion in an axial direction of the electrophotographic photosensitive member, for engagement with a second main assembly side positioning portion, provided in the main assembly of the apparatus, in response to falling of a side of the process cartridge opposite from a side having the developer accommodating portion in the direction crossing with the axial direction of the electrophotographic photosensitive member by operation of a lever provided in the main assembly of the apparatus.

11 Claims, 33 Drawing Sheets

PROCESS CARTRIDGE AND IMAGE FORMING APPARATUS

FIELD OF THE INVENTION AND RELATED ART

The present invention relates to a process cartridge and an electrophotographic image forming apparatus to which the process cartridge is detachably mountable.

Here, the electrophotographic image forming apparatus forms an image on a recording material through an electrophotographic image-formation-type process. Examples of electrophotographic image forming apparatus include an electrophotographic copying machine, an electrophotographic printer (laser beam printer, LED printer or the like), a facsimile machine and a word processor.

The above-described process cartridge contains as a unit an electrophotographic photosensitive member and a charging means, a developing means or a cleaning means in the form of a cartridge that is detachably mountable to a main assembly of an image forming apparatus. The process cartridge may contain an electrophotographic photosensitive member and at least one of a charging means, a developing means and a cleaning means in the form of a cartridge that is detachably mountably to a main assembly of an image forming apparatus. The process cartridge may contain an electrophotographic photosensitive member and at least developing means in the form of a cartridge that is detachably mountably to a main assembly of an image forming apparatus.

With a process-cartridge type apparatus, the servicing or maintenance operations can be in effect carried out by users, so that the operativity is significantly improved, and therefore, the process-cartridge type apparatus is widely used in the electrophotographic field.

With the increasing demand for a longer service life of the process cartridge, the amount of the developer accommodated in the process cartridge increases, and the size of the process cartridge also increases. Correspondingly, the operativity of the process cartridge is influenced. Additionally, the positioning of the process cartridge relative to the main assembly may be influenced by an increase in the weight of the cartridge.

SUMMARY OF THE INVENTION

Accordingly, it is a principal object of the present invention to provide an improved process cartridge and an electrophotographic image forming apparatus in which the process cartridge is mounted and demounted relative to a main assembly of the image forming apparatus.

It is another object of the present invention to provide a process cartridge and an electrophotographic image forming apparatus in which the positional accuracy of the process cartridge relative to the image forming apparatus is improved.

According to an aspect of the present invention, there is provided a process cartridge detachably mountably to a main assembly of an electrophotographic image forming apparatus, comprising: an electrophotographic photosensitive member; a developing member for developing an electrostatic latent image formed on the electrophotographic photosensitive member; a developer accommodating portion for accommodating a developer to be used by the developing member to develop the electrostatic latent image; a cartridge guide being guided by a main-assembly-side guide provided in the main assembly of the apparatus; a first cartridge positioning portion, provided at one end portion in an axial direction of the electrophotographic photosensitive member, for engagement with a first main-assembly-side positioning portion, provided in the main assembly of the apparatus, in response to falling of a side of the process cartridge opposite from a side having the developer accommodating portion in a direction crossing with the axial direction of the electrophotographic photosensitive member by operation of a lever provided in the main assembly of the apparatus; a second cartridge positioning portion, provided at the other end portion in an axial direction of the electrophotographic photosensitive member, for engagement with a second main-assembly-side positioning portion, provided in the main assembly of the apparatus, in response to falling of a side of the process cartridge opposite from a side having the developer accommodating portion in a direction crossing with the axial direction of the electrophotographic photosensitive member by operation of a lever provided in the main assembly of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Referring to FIGS. 1–8, a preferred embodiment will be described. In this embodiment, the term "longitudinal direction" refers to the direction perpendicular to the recording medium conveyance direction, and parallel to the surface of the recording medium. A "rectangular parallelepiped" refers to a solid object that is approximately uniform in a cross section perpendicular to its longitudinal direction.

(Process Cartridge and Electrophotographic Image Forming Apparatus)

Figure 1:
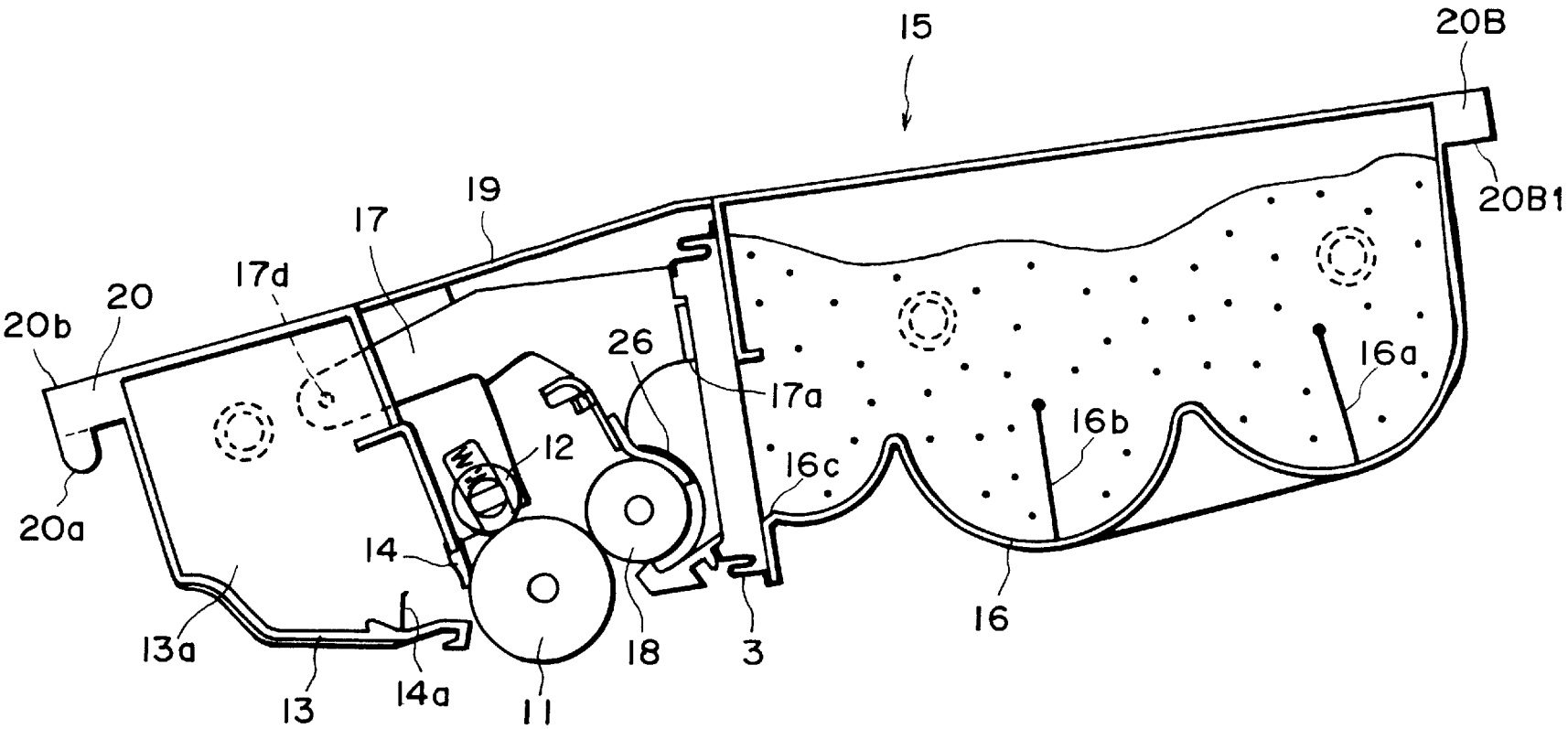
FIG. 1 is a longitudinal sectional view of a process cartridge according to the first embodiment of the present invention.
Figure 2:
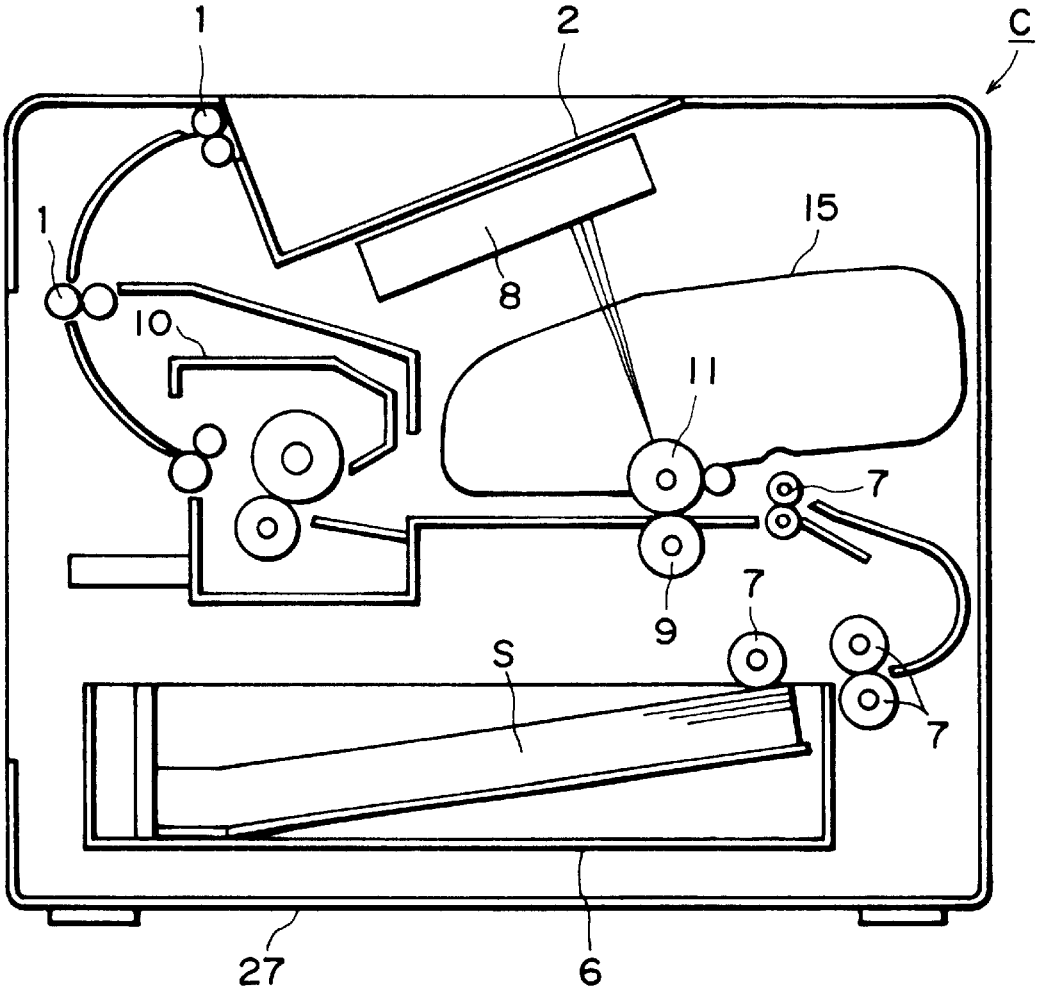
FIG. 2 is a longitudinal sectional view of a main assembly of an image forming apparatus according to the first embodiment of the present invention.

FIG. 1 is a vertical sectional view of the essential portion of the process cartridge in accordance with the present invention, at the plane perpendicular to the longitudinal direction of the process cartridge. FIG. 2 is a vertical sectional view of the essential portion of the image forming apparatus in accordance with the present invention, at the plane perpendicular to the longitudinal direction of the process cartridge. This process cartridge is provided with one or a plurality of processing means which act on the electrophotographic photosensitive member. As for the processing means, there are, for example, a charging means for charging the peripheral surface of the electrophotographic photosensitive member, a developing apparatus for developing an electrophotographic latent image formed on the electrophotographic photosensitive member, and a cleaning means for removing the developer remaining on the peripheral surface of the electrophotographic photosensitive member.

As shown in FIG. 1, the process cartridge 15 in this embodiment comprises: an electrophotographic photosensitive member 11 (hereinafter, "electrophotographic photosensitive drum") in the form of a drum; a charge roller 12 as a charging member; a developing apparatus comprising a development roller 18 as a developing member, and a development blade 26; a cleaning blade 14 as a cleaning member; and a housing in which the preceding processing means are integrally disposed around the electrophotographic photosensitive drum 11. The process cartridge 15 is removably installable in the main assembly 27 of an electrophotographic image forming apparatus (hereinafter, "apparatus main assembly").

Referring to FIG. 2, this process cartridge 15 is installed in an electrophotographic image forming apparatus C (hereinafter, "image forming apparatus"), for image formation.

A sheet S is fed out of a sheet cassette 6 fitted in the bottom portion of the apparatus, by a conveyer roller 7. In synchronism with the conveyance of this sheet S, the electrophotographic photosensitive member 11 (hereinafter "photosensitive drum") is selectively exposed by an exposing apparatus 8. As a result, an electrostatic latent image is formed. Thereafter, the developer (hereinafter, "toner") stored in a toner storage container 16 (developer storage portion) is sent out of the toner storage container 16 by a pair of stirring members 16*a* and 16*b*. The toner sent out is triboelectrically charged by a development blade 26, and this developer is borne on the peripheral surface of the development roller 18. Then, as development bias is applied to the development roller 18, the toner is supplied to the photosensitive drum 11 in accordance with the latent image. Next, this toner image is transferred onto the sheet S, as a recording medium, by applying bias (voltage) to a transfer roller 9. Then, the sheet S is conveyed to a fixing apparatus 10, in which the toner image is fixed. Next, the sheet S is discharged by a discharge roller 1 into a delivery portion 2 provided on the top side of the apparatus. Meanwhile, the toner that remains on the photosensitive drum 11 after the image transfer is removed by a cleaning blade 14. The removed toner is sent to a removed toner storage bin 13*a* (removed developer storage portion) by a removed toner conveying member 14*a*.

(Structure of Process Cartridge Frame)

Figure 3:
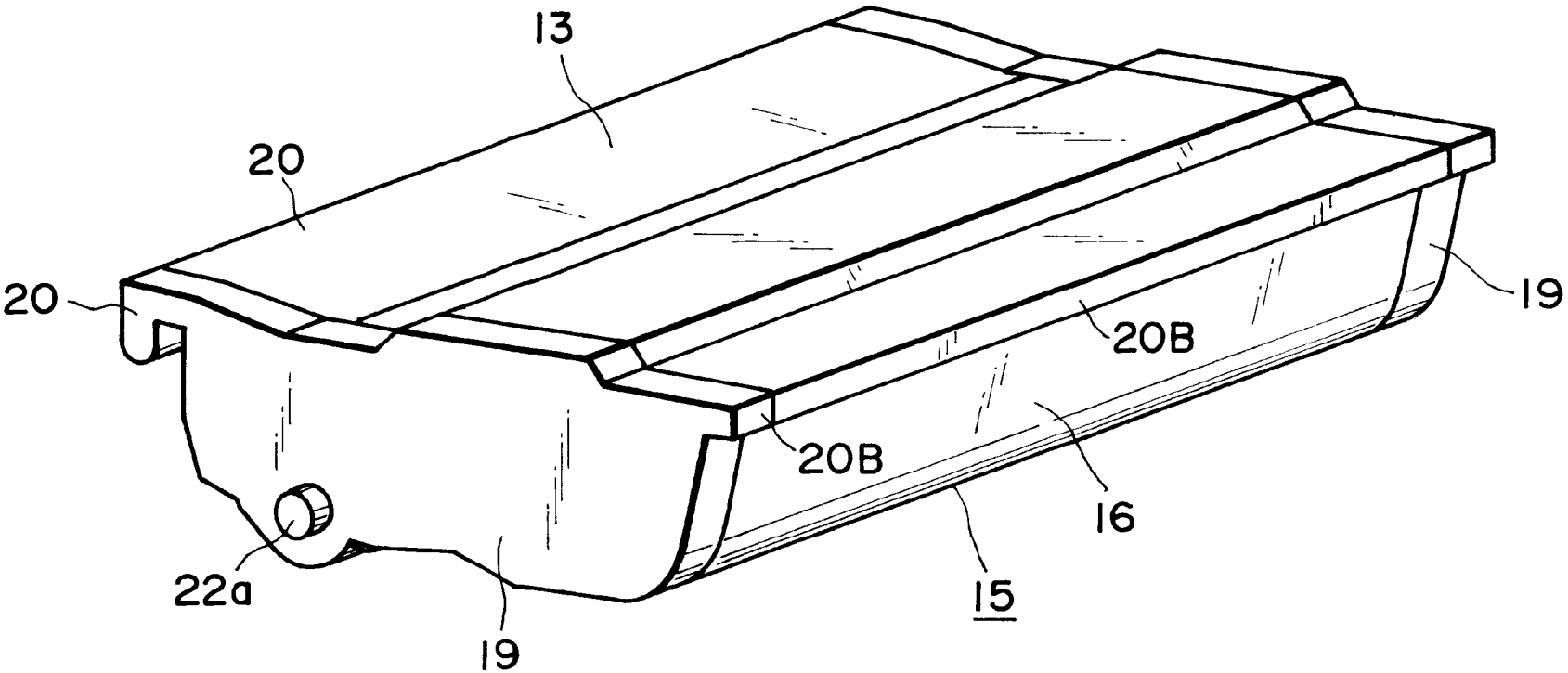
FIG. 3 shows a perspective outer appearance of the process cartridge according to the first embodiment of the present invention.

FIG. 3 is a perspective view that shows the structure of the process cartridge frame. As shown in FIG. 1, the process cartridge 15 comprises three frame pieces: a cleaning-means frame 13 as a drum frame that integrally supports the photosensitive drum 11, charge roller 12 (charging member), and cleaning blade 14 (cleaning member); a developing-means frame 17 that integrally supports the development roller 18, and development blade 26; and a toner-storage container 16 in which toner is stored. Further, the process cartridge 15 in this embodiment comprises a pair of side covers 19 and 19 that are fixed to the longitudinal ends of the cleaning means frame 13 and tone storage container 16 to hold the frames 13 and 15 together. The development-means frame 17 is supported by the cleaning-means frame 13. Further, the process cartridge 15 is provided with a scaling member 3 that connects the opening 16*c* of the toner-storage container 16 and the opening 17*a* of the developing-means frame 17.

To the cleaning-means frame 13, the cleaning blade 14 is fixed with the use of email screws, and in the cleaning-means frame 13, the removed toner conveying member 14*a* is disposed. The charge roller 12 is rotatably supported by the longitudinal ends, by bearings (unillustrated). In the cleaning-means frame 13, the photosensitive drum 11 is rotatably supported by a pair of drum shafts 22*a* and 22*b* (only 22*a* is illustrated), with the flange portions (unillustrated), that is, the longitudinal end portions, of the photosensitive drum 11, supported by a pair of bearings 22*a* and 22*b*.

The toner-storage frame 16 stores toner therein, and comprises a pair of toner stirring members 16*a* and 6*b* for conveying, while stirring, the stored toner. The aforementioned side covers 19 and 19 are large enough to match in size the primary cross section (cross section at a plane perpendicular to the recording medium conveyance direction) of the process cartridge 15. They are positioned at the longitudinal ends of the process cartridge 15, one for one, covering, and being fixed to, both the cleaning-means frame 13 and toner-storage container 16, in a manner to sandwhich the frames 13 and 16. With this arrangement, the side covers 19 and 19 integrally hold together the cleaning-means frame 13 and toner-storage frame 16. The holes (unillustrated) which which the side cover 19 and 19 are provided, respectively, are aligned with the rotational axis of the photosensitive drum 11 in the cleaning-means frame 13. In the hole of the side cover 19, that is, the side cover illustrated on the front side of the drawing, with which cleaning means frame 13 is provided, the bearing 22*a* press fitted. Also, a shaft (unillustrated) is put through the bearing 22*a*, and the center hole of the flange of the photosensitive drum 11, to rotatably support one of the longitudinal ends of the photosensitive drum 11.

The way the other longitudinal end of the photosensitive drum 11 is supported is the same as the way the first longitudinal end is supported. The shaft, which is rotatably supported by a bearing 22*b* (not visible in the drawing) is provided with a coupler, which engages with the coupler on the driving side connected to the driving force source of the apparatus main assembly 27. Therefore, the photosensitive drum 11 rotates by receiving the driving force from the apparatus main assembly 27. This side on which the driving force is received is the rear side as seen from the direction from which the process cartridge 15 is installed into the apparatus main assembly 27.

As seen from the side from which the process cartridge 15 is inserted into the apparatus main assembly 27, the process cartridge 15 is provided with a pair of guiding portions 20 and 20B (cartridge guides), which are visible on the left-hand and right-hand sides, as illustrated in FIG. 1. These guiding portions 20 and 20B extend in the direction parallel to the axial line of the photosensitive drum 11 so that process cartridge 15 is guided by the guiding portions 20 and 20B when the process cartridge 15 is installed into, or removed from, the apparatus main assembly 27. The guiding portion 20 is provided with a projection 20*a*, which projects from the outward edge of the bottom side of the square portion 20*b* (in cross sectional view). The bottom end of this projection 20*a* has a semicircular contour.

Referring to FIG. 1, the guiding portion 20B on the right-hand side is square. The downwardly facing surface 20B1 of the guiding portion 20B is flat, and during the installation of the process cartridge 15 into the apparatus main assembly 27, the surface 20B1 remains substantially horizontal.

The guiding portions 20 and 20B extend across almost the entire length of the process cartridge 15. The guiding portion 20 is integrally formed with the cleaning means frame 13, as an integral part of the cleaning means frame 13. The guiding portion 20B is integrally formed with the toner storage container 16, as an integral part of the toner storage container 16.

The longitudinal ends of the guiding portion 20 and 28 belong to the corresponding side covers 19 and 19. Therefore, this process cartridge 15 is approximately in the shape of a rectangular parallelepiped.

This process cartridge 15 is provided with a handle 15*a*, which is on the top surface, adjacent to the center of gravity. This handle 15*a* is convenient for an operator to grasp with one hand to carry the process cartridge 15. Further, the handle 15*a* prevents the toner within the process cartridge 15 from collecting on one side.

The portion of the process cartridge 15, to which the handle 15*a* is attached, may be a portion on the surface on the side opposite to the side from which the force for driving the photosensitive drum 11 is received. In other words, the handle 15*a* may be attached to the front side of the process cartridge 15 as seen from the downstream side in terms of the process-cartridge installation direction (which will be described later in more detail) in which the process cartridge 15 is inserted into the apparatus main assembly 27. Attaching the handle 15*a* to the front side in terms of the process-cartridge installation direction makes it easier to move the process cartridge 15 onto or out of the cartridge space 31 (which will be also described later in detail) in the apparatus main assembly 27.

The developing-means frame (cartridge frame) is supported by the cleaning-means frame 13 (cartridge frame) in such a manner that the developing-means frame is allowed to pivot about the axial line of a hole 17*d*, with which the developing-means frame is provided, while keeping parallel the rotational axes of the photosensitive drum 11 and development roller 18. The hole 17*d* is on the side from which the development roller 18 is driven by one of its longitudinal ends. More specifically, the developing-means frame 17, which supports the development roller 18, is attached to the cleaning-means frame 13 by a pin (unillustrated) inserted in the hole 17*d*, being allowed to pivot about the axial line of the hole 17*d*. Further, the developing-means frame 17 is kept under the pressure from a resilient member (unillustrated) between the cleaning-means frame 13 and developing-means frame 17, so that the development roller 18 is kept pressed toward the photosensitive drum 11. With this arrangement, a moment is applied to the cleaning-means frame 13 and developing-means frame 17 in a direction to pivot them toward each other about the axial line of the hole 17*d*. As described before, the cleaning-means frame 13 and toner-storage container 16 are fixed to each other, being prevented from moving relative to each other. Thus, the developing-means frame 17 is movable relative to the toner-storage container 16. The other side of the developing-means frame 17 is also supplied by the cleaning-means frame 13 in the same manner as the first side.

On the non-driven side of the developing-means frame 17, in place of the above-described hole 17*d*, a projection (unillustrated), the axial line of which coincides with the axial line of the development roller 18, may be provided, so that this projection is kept pressed toward the axial line of the photosensitive drum 11 by being guided by a guiding groove (unillustrated) (detailed description is omitted).

(Cartridge Space Provided in Apparatus Main Assembly)

Figure 4:
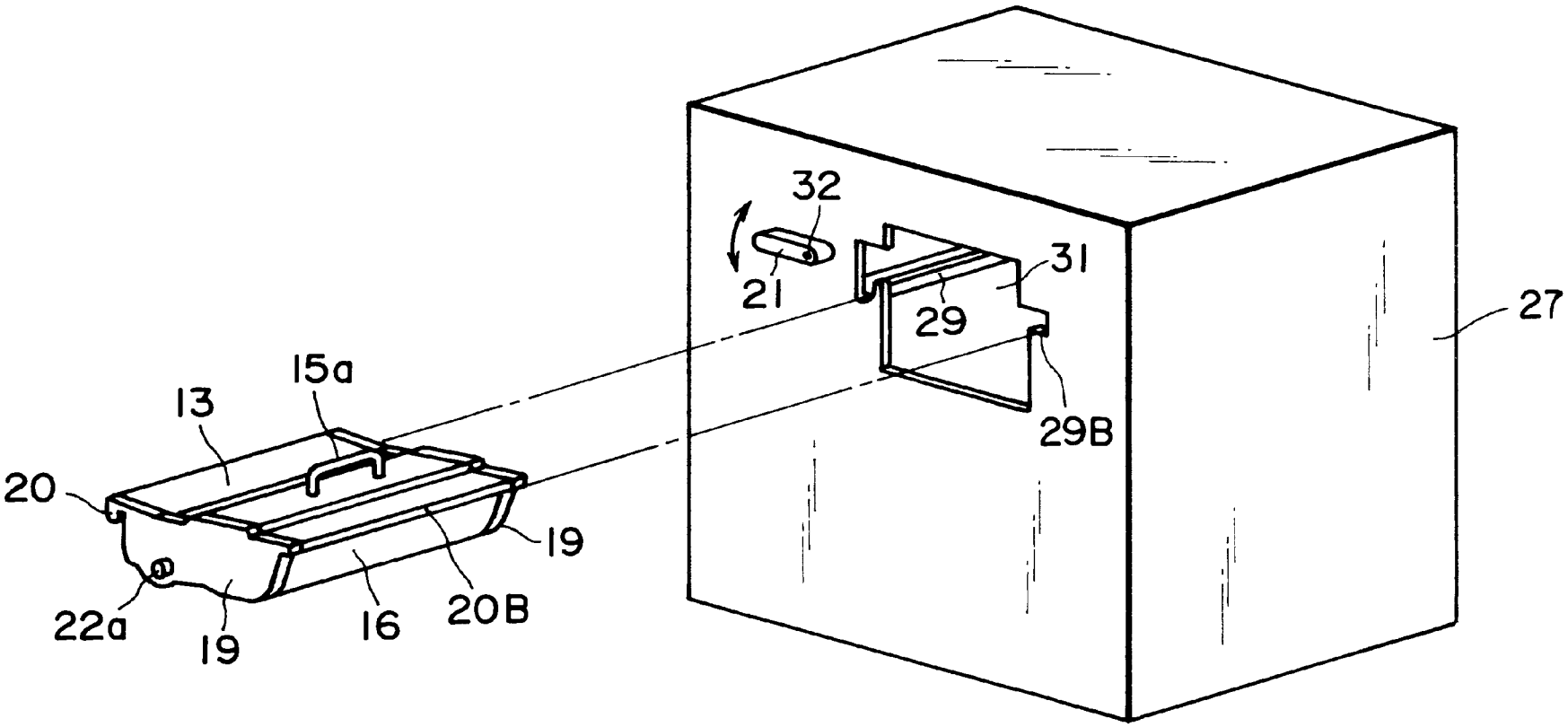
FIG. 4 is a prospective view illustrating mounting and demounting of the process cartridge relative to the main assembly of the apparatus according to the first embodiment of the present invention.

FIG. 4 is a perspective view of the cartridge space provided in the apparatus main assembly. As the front door (unillustrated) of the apparatus main assembly is opened, the entrance to the cartridge space 31 becomes visible.

Figure 5:
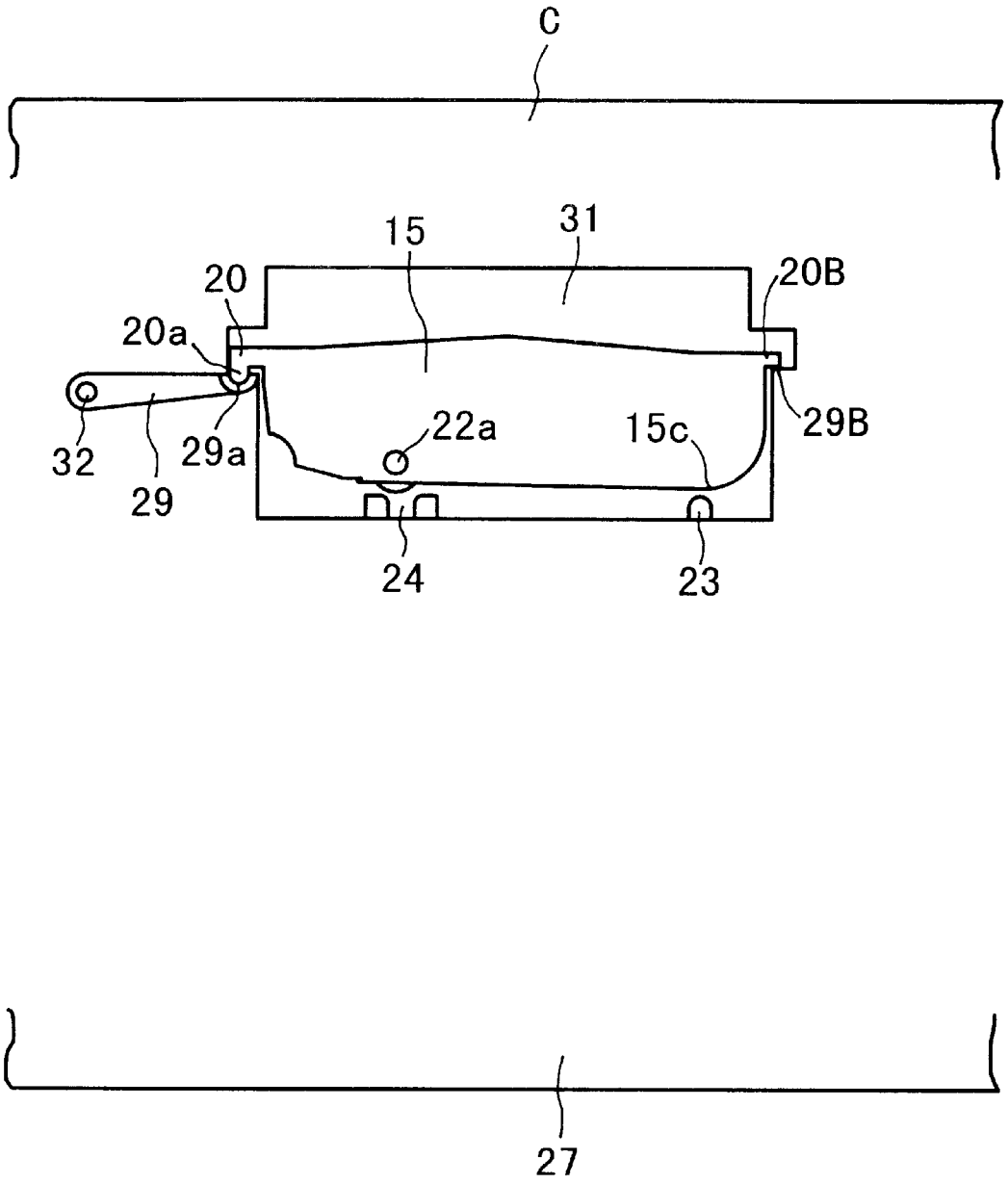
FIG. 5 is a front view illustrating mounting and demounting of the process cartridge relative to the main assembly of the apparatus according to the first embodiment of the present invention.
Figure 6:
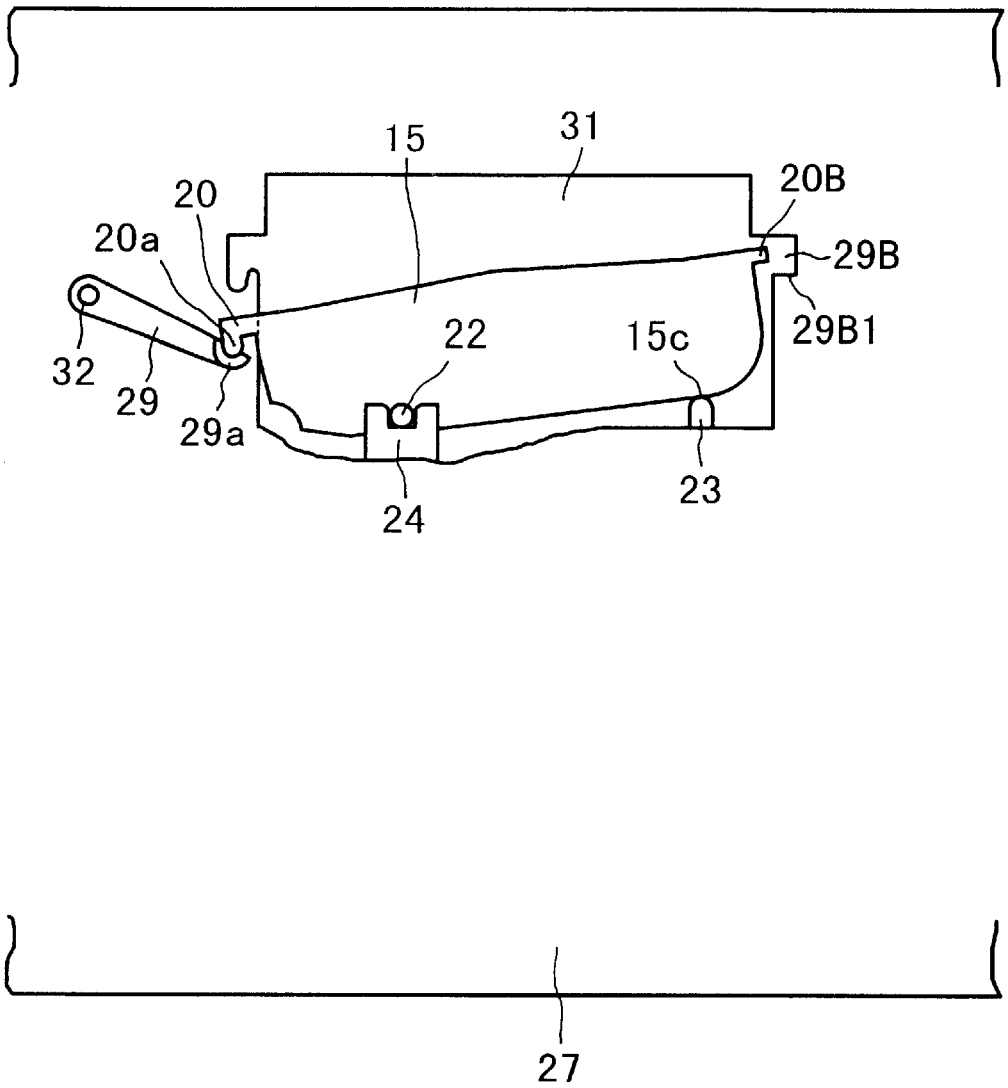
FIG. 6 is a front view illustrating mounting and demounting of the process cartridge relative to the main assembly of the apparatus according to the first embodiment of the present invention.

This cartridge space 31 is provided with a pair of guide rails 29 and 29B (guiding portions on the apparatus main assembly side), which are perpendicular to the direction in which the sheet S is conveyed, and are parallel to the sheet S. Referring to FIGS. 5 and 6, the guide rail 29*a* is pivotable about a shaft 32, allowing the process-cassette supporting side 29*a* of the guide rail 29 to move vertically. The guide rail 28B is fixed. The guide rails 29 and 29B are parallel to each other, and are approximately at the same level, that is, approximately in the same horizontal plane.

When installed into or removed from the cartridge space 31, the process cartridge 15 is inserted thereinto or retracted therefrom, in the longitudinal direction of the process cartridge 15. During these processes, the guiding portions 20 and 20B of the process cartridge 15 are enganged with the guide rails 29 and 29B, respectively, in the cartridge space of the apparatus main assembly 27.

To describe the invention in more detail, referring to FIG. 5, the guide rail 29 is pivotally supported by the apparatus main assembly 27: it is fixed to the shaft 32. The shaft 32 is pivotally supported by the apparatus main assembly 27. The free end portion of the guide rail 29 is provided with a semicylindrical concave guiding surface 29*a*, which extends in the longitudinal direction. In this semicylindrical concave guiding surface 29*a*, the aforementioned downward semicylindrical projection 20*a* is engageable.

Referring to FIG. 5, the apparatus main assembly 27 is provided with a cartridge catching member 23, which catches and supports the right-hand side of the process cartridge 15 as the process cartridge descends with the guide portion 20 as the cartridge guide 29 pivots about the shaft 32 in the clockwise direction. The apparatus main assembly 27 is provided with a pair of positioning grooves 24, in which the bearings 22 (22*a* and 22*b*: 22*b* is on the rear side in terms of the process cartridge installation direction, and therefore, is invisible in the drawing), which double as a pair of positioning members, preferably fit, one for one. In other words, the position or attitude of the process cartridge 15 is fixed by both of its longitudinal edges.

Referring to FIG. 4, the shaft 32 is provided with a lever 21, which is exposed from the apparatus main assembly 27, on the front side, and is pivotable about the rotational axis of the shaft 32.

In the above described structure, when the process cartridge 15 is inserted into, or retracted from, the apparatus main assembly 27, the guiding surface 29*a* of the guide rail 29 must be retained at the top end of its moving range, so that the plane which includes the longitudinal center lines of the guide portions 20 and 20B remains approximately horizontal.

One example of a structure that can meet the above-described requirement will be described below, along with its functions.

Figure 7:
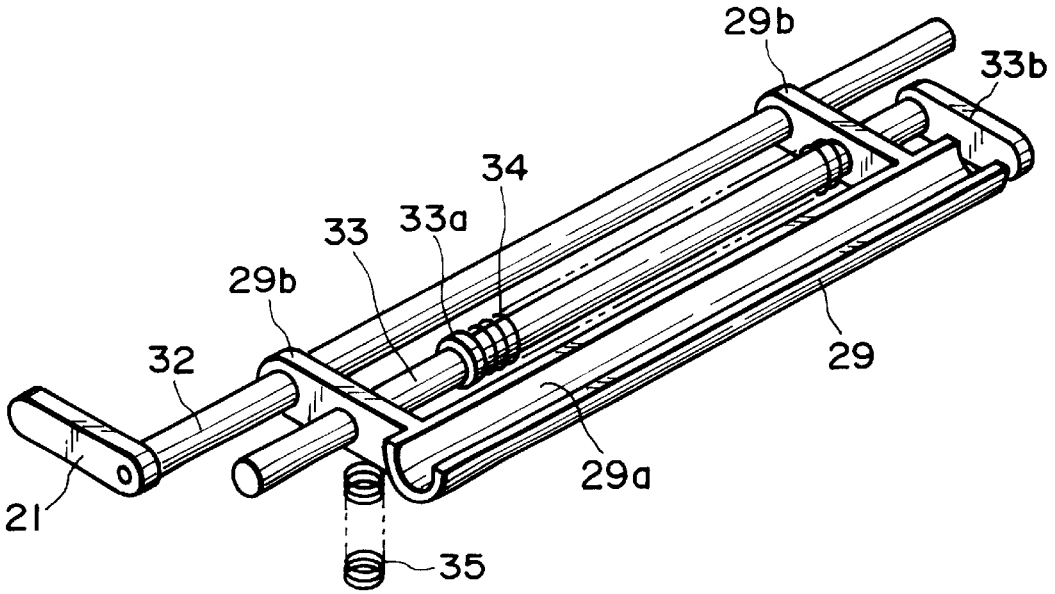
FIG. 7 is a perspective view of locking means of a cartridge mounting portion.
Figure 8:
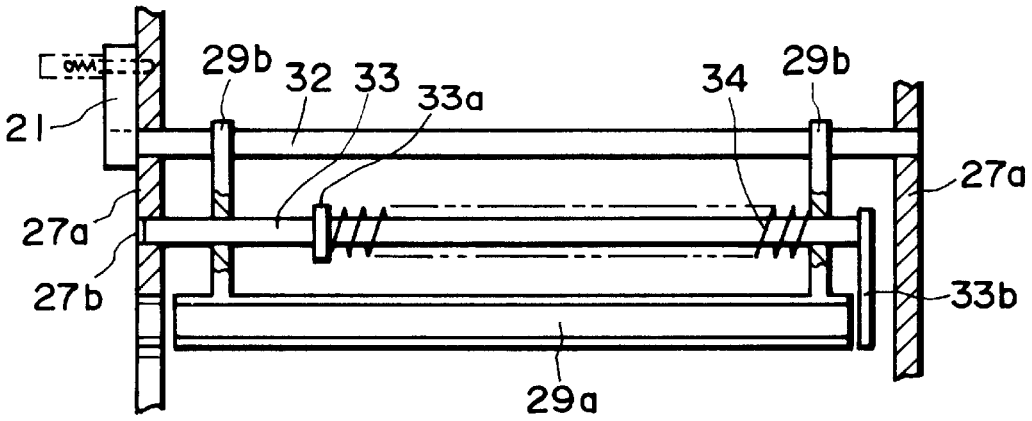
FIG. 8 is a plan view of the locking means of FIG. 7.

Referring to FIG. 5, when the position of the guiding surface 29*a* is at the top of its moving range, a locking bar 33, which is attached to the arm portions of the guide rail 29 so that the locking bar 33 can be moved in the longitudinal direction, is kept in the locking hole 27*b* with which the frame 27*a* of the apparatus main assembly 27 is provided, by the force from a compression spring 34 (FIGS. 7 and 8). The compression spring 34 is disposed between the retainer rib portion 33*a* of the locking bar, and the arm portion 29*b* located on the rear side in terms of the longitudinal direction.

Referring again to FIG. 5, the process cartridge 15 is pushed into the apparatus main assembly 27 in the longitudinal direction, with the guide portions 20 and 20B engaged in the guide rails 29 and 29B. Then, the process cartridge 15 comes into contact with a kelly-bar fixed to the locking bar 33. Next, the process cartridge 15 is pushed further into the apparatus main assembly 27 by an operator, against the resiliency of the spring 34. Then, the kelly-bar 33*b* and locking bar 33 move inward together, causing the locking bar 33 to come out of the locking hole 27*b* of the frame 27*a*. As a result, the process cartridge 15 descends, due to its own weight, from the position given in FIG. 5 to the position given in FIG. 6, while moving leftward and causing the guide rail 29 to pivot about the shaft 32 in the clockwise direction. Consequently, the toner storage container supporting portion 15*c*, which is a portion of the bottom wall of the toner storage container 16, makes contact with the cartridge catching member 23 fixed to the apparatus main assembly 27. Up to this point in the installation, the downwardly facing flat surface of rectangular guide portion 20B, which is horizontal at this point in the installation, has been riding on the upwardly facing flat horizontal surface of the guide rail 29B. Therefore, as the process cartridge 15 descends while moving leftward as described above, the guide portion 20B is caused to slightly lift from the upwardly facing horizontal surface of the guide rail 29B, and comes out of the guide rail 29B; the guide portion 20B becomes completely disengaged from the guide rail 29B. As soon as the guide portion 20B becomes disengaged from the guide rail 29B, the cartridge catching member 23 fixed to the apparatus main assembly 27 comes into contact with the toner-storage-container supporting portion 15*c*, with which the bottom wall of the toner-storage container 16 is provided. As a result, the right-hand side of the process cartridge 15 is supported by the cartridge catching member 23. Next, as the guide rail 29 pivots further downward, the drum shafts 22 (22*a* and 22*b*: first and second process cartridge positioning portion on the process cartridge side), which double as the process-cartridge positioning members, fit in the corresponding process-cartridge positioning grooves 24 (first and second process-cartridge positioning portions on the apparatus-main-assembly side) of the apparatus main assembly 27. As a result, the position of the process cartridge 15 becomes fixed. Further, the attitude of the process cartridge 15 becomes fixed as the supporting portion 15*c* (third process cartridge positioning portion) comes into contact with the process-cartridge catching member 23.

When the guide rail 29 descends as described above, the lever 21 on the apparatus-main-assembly side pivots in the clockwise direction about the shaft 32. Referring to FIG. 7, a compression spring 35 is disposed so that pressure is applied to the guide rail 29 in a direction to lift the guide rail 29. The force generated by the spring 35 is large enough to lift the guide rail, but not enough to lift the process cartridge 15.

In order to take the process cartridge 15 out of the apparatus main assembly 27, first, the main assembly side lever 21 is to be rotated in the counterclockwise direction about the shaft 32. With this rotation, the guide rail 29 is pivoted upward about the shaft 32. The concave semicylindrical guiding surface 29*a* lifts the guide portion 20 while moving it rightward. As a result, the bearings 22, which double as the positioning members, separate upward from the positioning grooves 24, which are the process-cartridge positioning portions on the apparatus-main-assembly-27 side, and the guide portion 20B engages with the guide portion 29B. At this point in the removal, the locking bar 33 is moved to the front side, fitting into the locking hole 27*b*, by the force from the spring 34, and the process cartridge 15 is slightly moved in the removal direction, while being guided by the guide rails 20 and 20B, also by the force from the spring 34, so that the process cartridge 15 can be pulled toward the operator. Then, as the process cartridge 15 is pulled toward the operator, the process cartridge 15 comes out of the apparatus main assembly 27, with the guide portions 20 and 20B guided by the guide rails 29 and 29B.

In this embodiment described above, the guide rail was provided with the semicylindrical rail portion which had the semicylindrical concave guiding surface, and one of the guide portions of the process cartridge side was provided with the downwardly projecting semicylindrical projection, the radius of which is equal to the radius of the concave guiding surface. However, the configuration of the process cartridge guiding means does not need to be limited to the above described one. All that is necessary is that the guide portion 20 is shaped so that the movement of the guide portion 20 in terms of the direction perpendicular to the process cartridge installation direction is restricted by the guide rail 29. Further, regarding the manner in which the guide rail 29 restricts the guide portion 20, the restriction does not need to be as strict as the above described arrangement in which the projecting and concave portions are the same in radius. In other words, there may be a small amount of gap between the guide rail 29 and guide portion 20, and also, the guide rail 29 and guide portion 20 may be provided with teeth so they mesh with each other. Further, the relationship in terms of the shape between the concave guiding surface 29*a* and guide portion 20 may be reversed. In other words, the guiding surface 29*a* may be protrusive while the guide portion 20 is concave. Further, in this embodiment, in order to render the guide rail 29 mobile, the shaft 32 was rendered rotational about its axial line S. However, this arrangement is not requisite. All that is necessary is that the guide rail 29 is allowed to move diagonally downward so that the guiding surface 29*a* moves away from the guide rail 29B. Therefore, the structure for movably supporting the guide rail 29 may be, for example, a four-joint linkage.

The only requirement regarding the fixed guide rail 29B is that the guide rail 29B is enabled to support the guide portion 20B from below when the process cartridge 15 is installed or removed. Therefore, there is provided a space above the guide portion 20B, and also, there is provided a space independent from the process cartridge space 31, on the outward side of the guide portion 20B. Thus, it is unnecessary for the guiding surface of the guide rail 29B be flat; it may be upwardly protuberant.

Also, instead of providing guide rail 29 with the above-described mechanism for directly locking the guide rail 29, the end portion of the lever 21 on the main-assembly side may be provided with a notched grip. In the latter case, the notched portion is kept in the hole of the apparatus main assembly by the force from a spring, and the grip is pulled to force the notched portion out of the hole to allow the guide rail 29 to rotate about the shaft 32.

The above described process cartridge (15) in this embodiment comprises the electrophotographic photosensitive drum (11); the developing member (development roller 18) for developing an electrostatic latent image formed on the electrophotographic photosensitive drum (11); the developer storage portion (toner storage container 16) for storing the developer used for developing the electrostatic latent image, with the use of the developing member; the cartridge guides (guide portions 20 and 20B), which are guided by the guides (guide rails 29 and 29B) on the apparatus-main-assembly side, when the process cartridge (15) is installed into the apparatus main assembly (27); the first cartridge-positioning portion (drum shaft 22) which is on one of the longitudinal ends of the process cartridge (15), being in alignment with the axial line of the electrophotographic photosensitive member (11), and engages with the first cartridge-positioning portion (positioning groove 24) provided on the apparatus-main-assembly (27) side, as the process cartridge (15) is allowed to descend, from the side opposite to where the developer storage portion (toner storage container 16) is located, in the direction perpendicular to the direction of the axial line of the electrophotographic photosensitive member (11), by the manipulation of the lever (main-assembly-side lever 21) with which the apparatus main assembly (27) is provided; and the second cartridge-positioning portion (drum shaft 22) which is on the other longitudinal end of the process cartridge (15), being alignment with the axial line of the electrophotographic photosensitive member (11), and engages with the second cartridge-positioning portion (positioning groove 24) on the apparatus-main-assembly (27) side, as the process cartridge (15) is allowed to descend from the side opposite to where the developer storage portion (toner storage container 16) is located, in the direction perpendicular to the direction, of the axial line of the electrophotographic photosensitive member (11), by the manipulation of the lever (main assembly side lever 21) with which the apparatus main assembly (27) is provided.

The cartridge guides (guide portions 20 and 20B) and extended along both the longitudinal edges of the process cartridge (15), one for one, which are perpendicular to the axial line of the electrophotographic photosensitive member.

Further, the cartridge guides (guide portion 20 and 20B) are extended in a direction parallel to the direction in which the process cartridge (15) is inserted into the apparatus main assembly (27). The process cartridge (15) is inserted into the apparatus main assembly (27) in a direction parallel to the axial line of the electrophotographic photosensitive member (11).

Furthermore, the process cartridge (15) comprises the third cartridge-positioning portion (supporting portion 15*c*), in addition to the first and second cartridge-positioning portions (bearings 22 and 22), for positioning the process cartridge (15) relative to the apparatus main assembly (27) when the process cartridge (15) is installed into the apparatus main assembly (27).

The third cartridge-positioning portion (supporting portion 15*c*) is located on the developer-storage-portion side (toner storage container 16 side) with respect to a direction perpendicular to the axial line of the electrophotographic photosensitive member (11).

The first cartridge-positioning portion is a part: (14) of the drum shaft (22*a*) by which the one of the longitudinal ends of the electrophotographic photosensitive member (11) in the form of a drum is supported by the cartridge frame (cleaning means frame (13)).

To describe in more detail, the above described process cartridge (15) in this embodiment, which is removably installable in the main assembly (27) of an electrophotographic photosensitive drum, comprises: the electrophotographic photosensitive drum (11); the development roller (18) for developing an electrostatic latent image formed on the electrophotographic photosensitive drum (11); the developer storage portion (toner storage container 16) for storing the developer used for developing the electrostatic latent image, with the use of the development roller (18); the charging member (charge roller 12) for charging the electrophotographic photosensitive drum (11); the cleaning member (cleaning blade 14) for removing the developer remaining on the electrophotographic photosensitive drum (11); the removed developer storage portion (removed developer storage portion 13*a* ) for storing the developer removed from the electrophotographic photosensitive drum (11) by the cleaning member; the first cartridge guide (guide portion 20) which is guided by the first guide (guide rail 29), with which the apparatus main assembly is provided, when the process cartridge is installed into the apparatus main assembly, this first cartridge-positioning guide being located on one side of the process cartridge with respect to a direction perpendicular to the longitudinal direction of the electrophotographic photosensitive drum, and extending in the direction parallel to a direction in which the process cartridge enters the apparatus main assembly; the second guide (guide portion 20B) which is guided by the second guide (guide rail 29B) with which the apparatus main assembly is provided, when the process cartridge is installed into the apparatus main assembly, this second cartridge guide being located on the other side of the process cartridge with respect to a direction perpendicular to the longitudinal direction of the electrophotographic photosensitive drum, and extending in a direction parallel to the direction in which the process cartridge enters the apparatus main assembly; the first cartridge-positioning portion (drum shaft 22*a* ) which is located on one of the longitudinal ends of the process cartridge in terms of the longitudinal direction of the electrophotographic photosensitive drum, and engages with the first positioning portion (positioning groove 24) with which the apparatus main assembly (27) is provided, and the process cartridge (15) is allowed to descend from the removed developer storage portion (recovered toner storage bin 13*a* ) side, that is, the side opposite to where the developer storage portion (toner storage container 16), with respect to the electrophotographic photosensitive drum (11), by the manipulation of the lever (main assembly side lever 21) with which the apparatus-main-assembly (27), is provided. The process cartridge enters the apparatus-main-assembly in the direction parallel to the longitudinal direction of the electrophotographic photosensitive drum.

According to the above described embodiment, the process cartridge is inserted into the main assembly of an image forming apparatus, in the direction parallel to the direction of the axial line of the electrophotographic photosensitive drum, and then, the process cartridge is allowed to descend from one side. As the process cartridge descends, the positioning portions, the axial lines of which are in alignment with the axial line of the electrophotographic photosensitive drum, can be supported by the apparatus main assembly. Therefore, the accuracy with which the process cartridge is positioned relative to the apparatus main assembly was improved.

Embodiment 2

(Description of Process Cartridge and Main Assembly of Electrophotographic Image Forming Apparatus)

Figure 9:
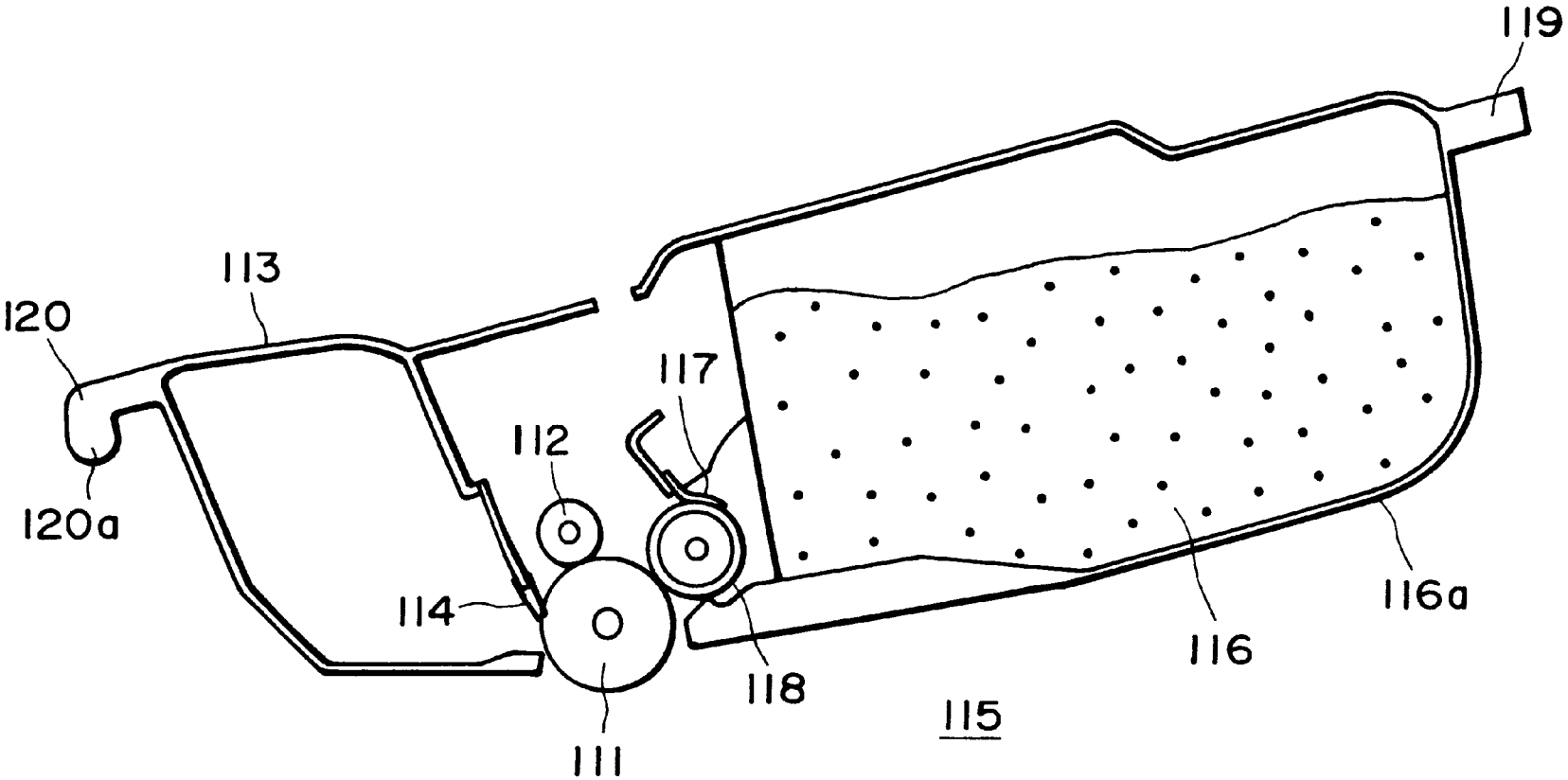
FIG. 9 is a sectional view of a process cartridge according to a second embodiment of the present invention.
Figure 10:
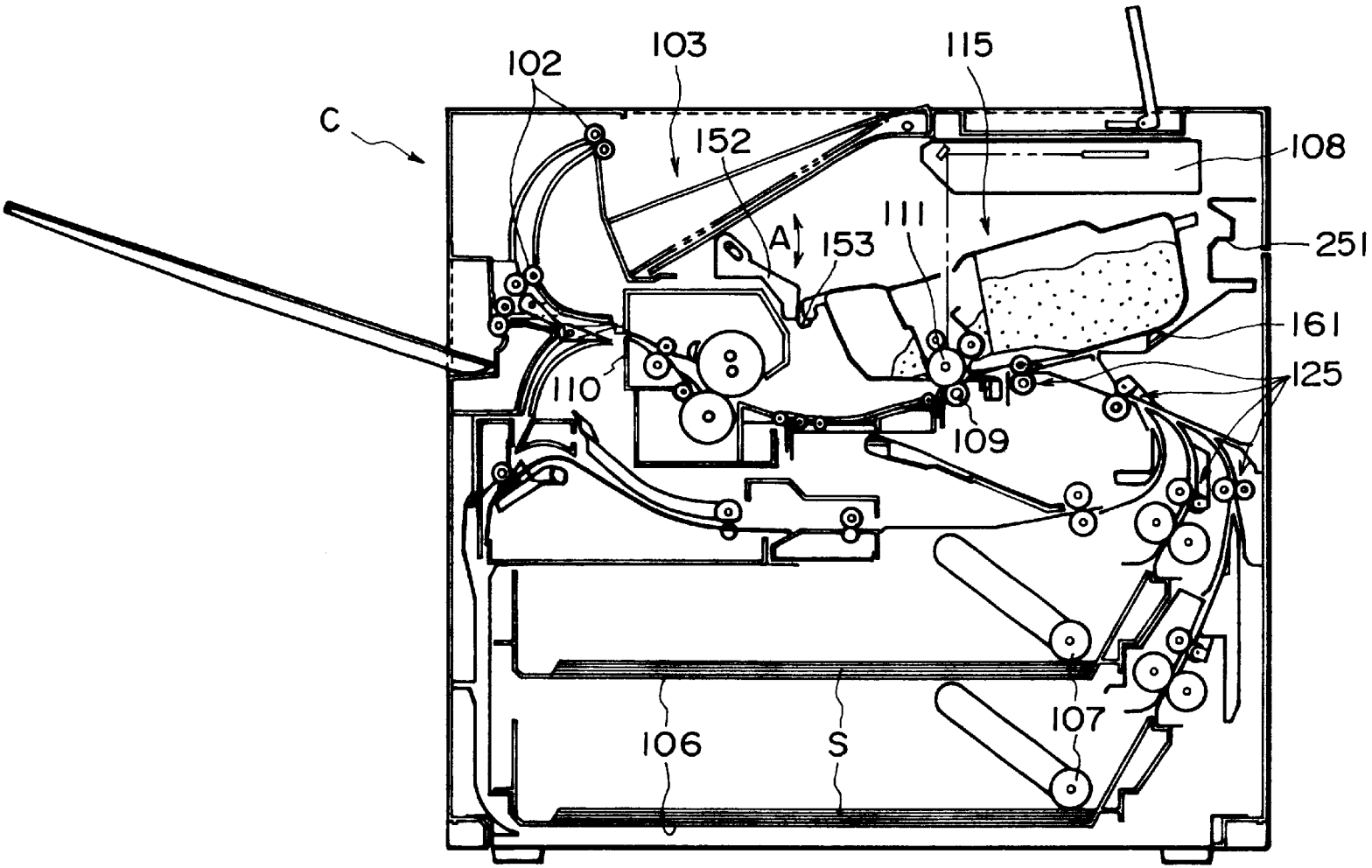
FIG. 10 is a sectional view of an image forming apparatus according to the second embodiment of the present invention.
Figure 11:
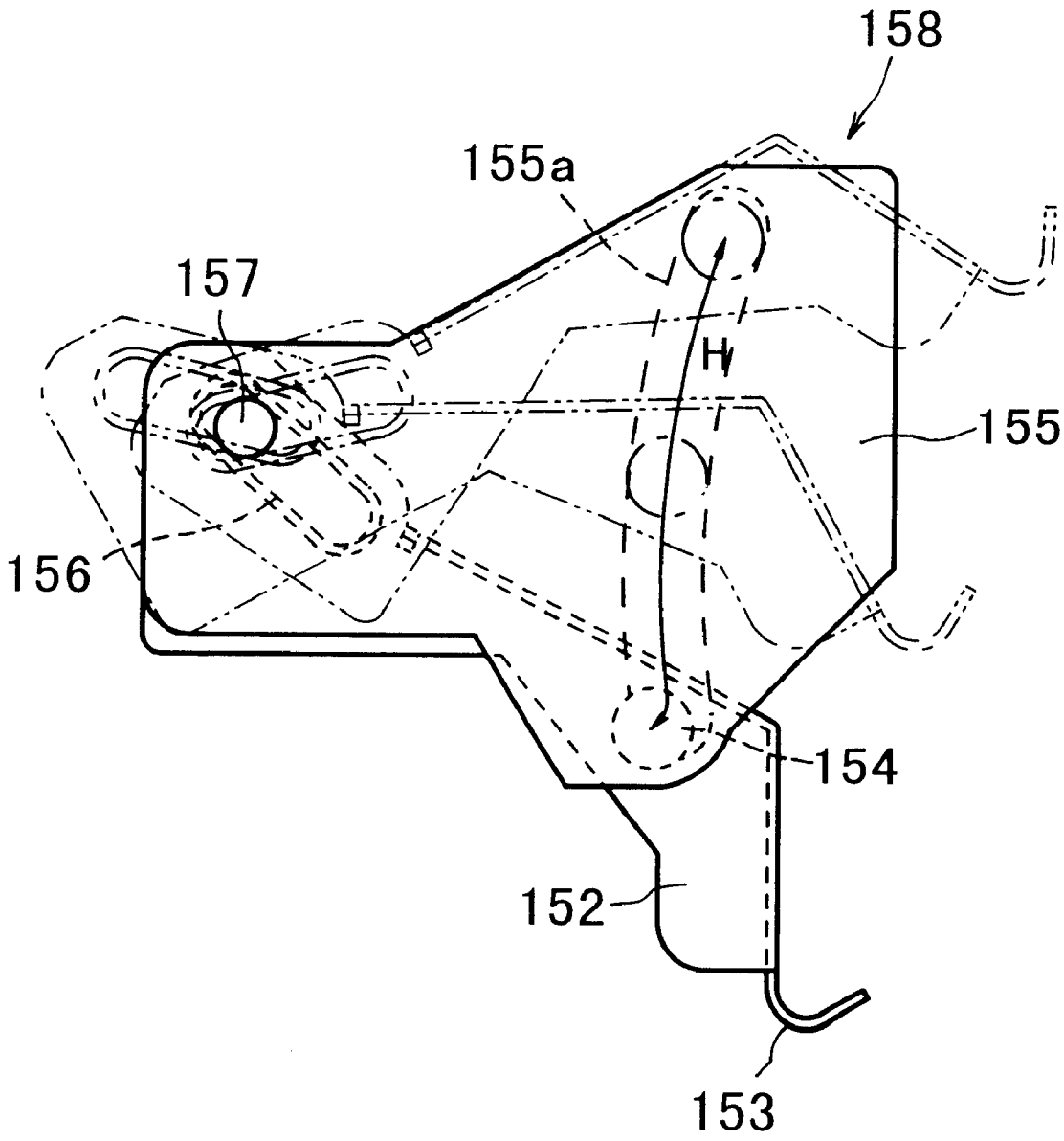
FIG. 11 is a detailed side view of a guiding member used in the second embodiment of the present invention.
Figure 12:
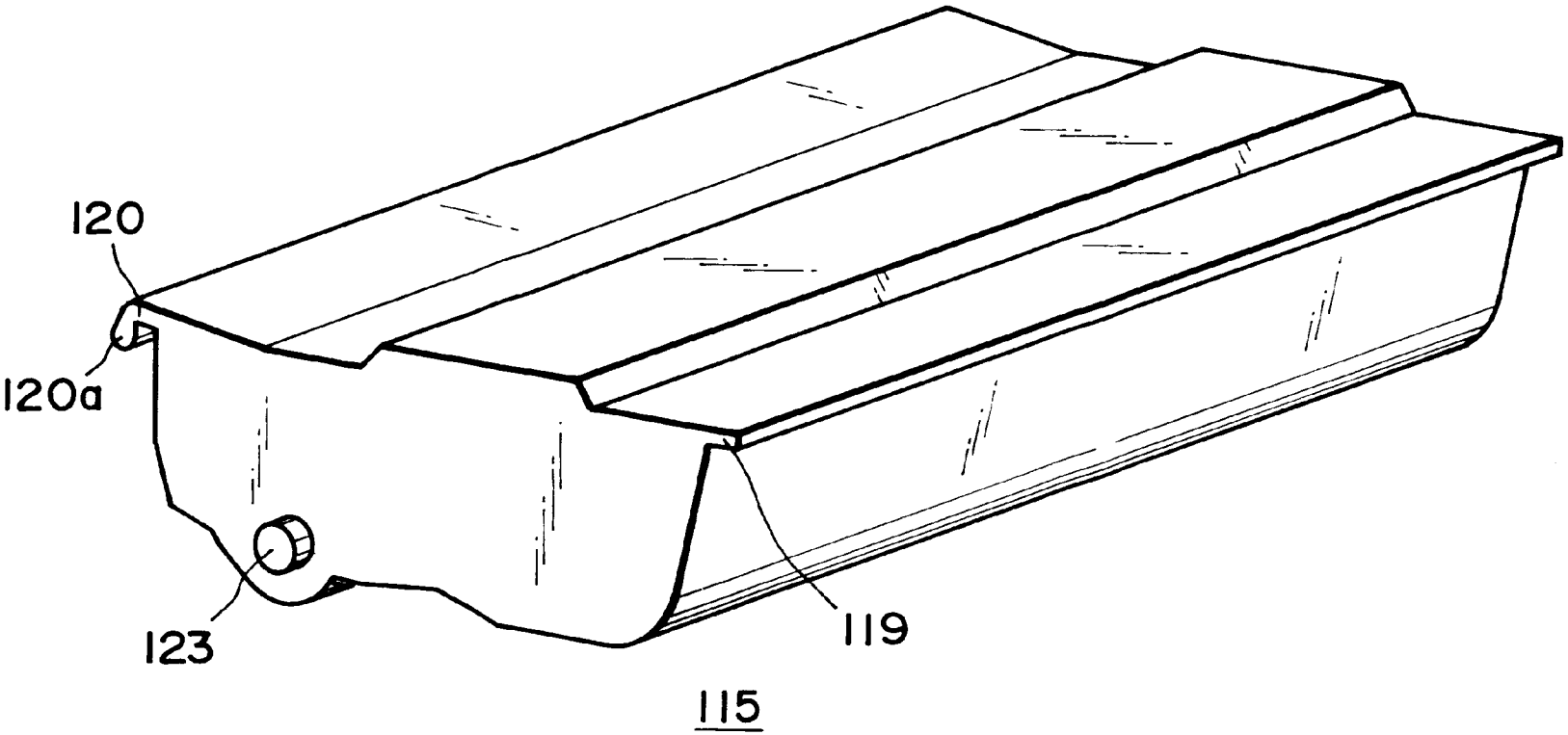
FIG. 12 is an outer perspective view of the process cartridge according to the second embodiment of the present invention.
Figure 13:
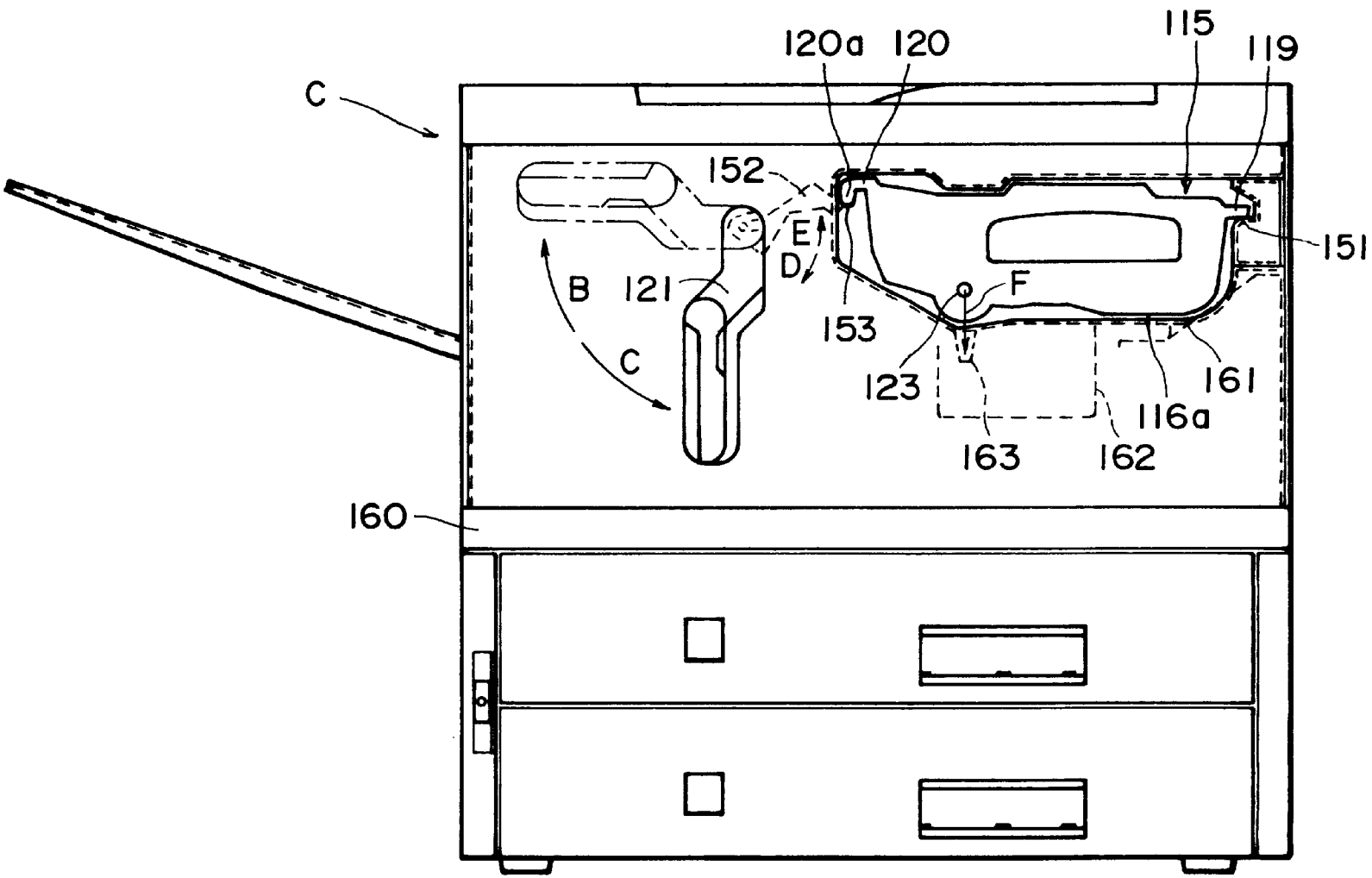
FIG. 13 is a front view illustrating mounting and demounting of the process cartridge relative to the main assembly of the apparatus according to the second embodiment of the present invention.
Figure 14:
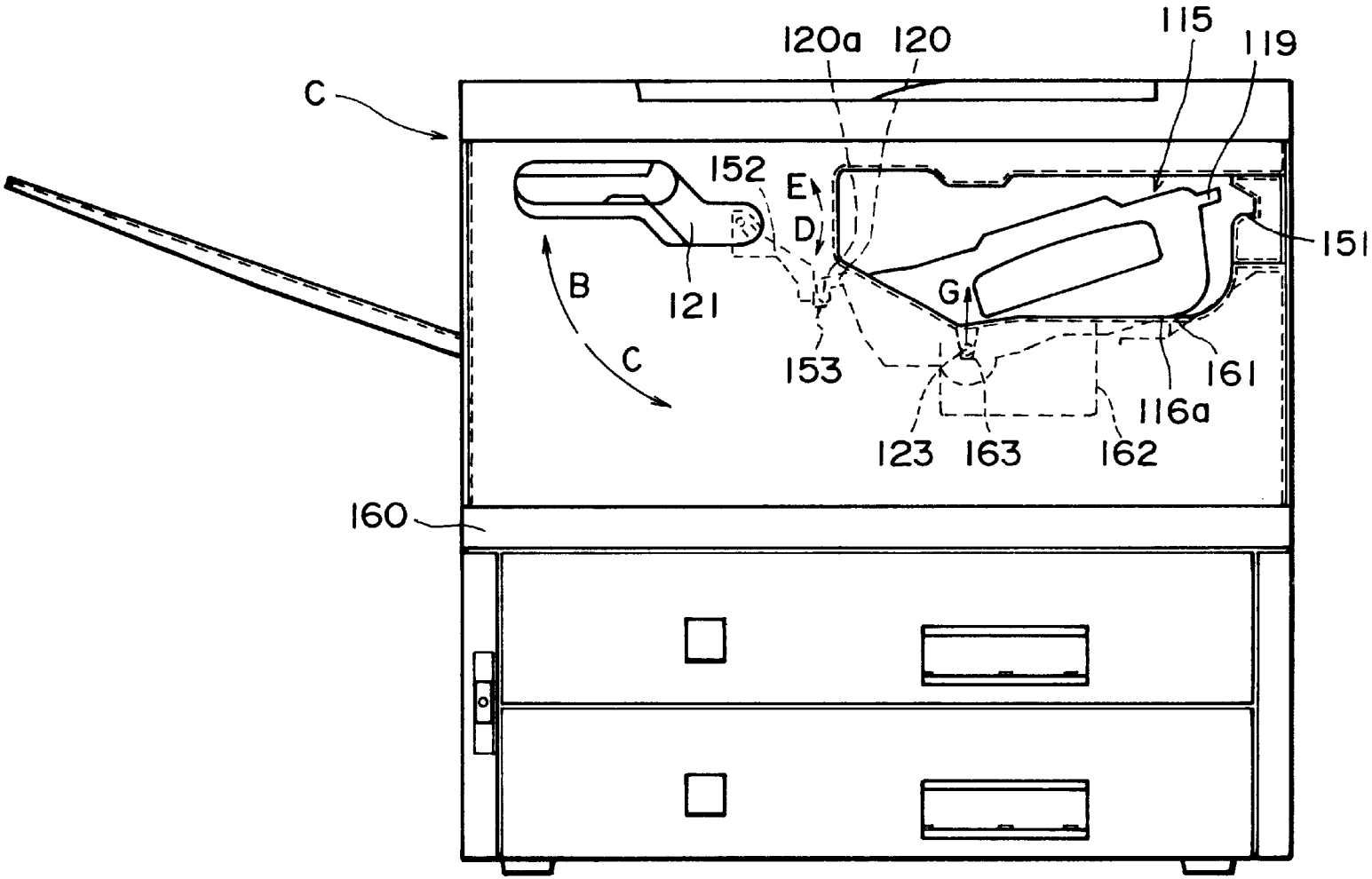
FIG. 14 is a front view illustrating mounting and demounting of the process cartridge relative to the main assembly of the apparatus according to the second embodiment of the present invention.

FIG. 9 is a sectional view of the essential portion of the process cartridge in accordance with the present invention, at a plane perpendicular to the longitudinal direction, and FIG. 10 is a sectional view of the essential portion of an image forming apparatus in accordance with the present invention, at a plane perpendicular to the longitudinal direction. FIG. 11 is a detailed sectional view of the guiding member in accordance with the present invention, and FIG. 12 is an external perspective view of the process cartridge in accordance with the present invention. FIGS. 13 and 14 are front views of the image forming apparatus, for describing how the process cartridge in accordance with the present invention is installed into, or removed from, the main assembly of the image forming apparatus in accordance with the present invention.

Referring to FIG. 9, the process cartridge 115 in this embodiment comprises: an electrophotographic photosensitive member 115 (hereinafter, "electrophotographic photosensitive drum") in the form of a drum: a charge roller 112 as a charging means; a combination of a development sleeve 118 (developing member) and a development blade 117, as a developing apparatus; a toner storage container 116 (developer storage portion) for storing toner; and a cleaning means container 113 provided with a cleaning blade 114 (cleaning member); and a housing in which the preceding processing means are integrally disposed around the electrophotographic photosensitive drum 111. The process cartridge 115 is removably installable in the main assembly C of an electrophotographic image forming apparatus.

Referring to FIG. 10, this process cartridge 115 is installed in the apparatus main assembly C, for image formation. An image forming operation is carried out as follows. A sheet S is fed out of a sheet cassette 106 fitted in the bottom portion of the apparatus, by a conveyer roller 107. This sheet S is conveyed by a group of conveyer roller pairs 125 located on the downstream side of the conveyor roller 107. In synchronism with the conveyance of this sheet S, the photosensitive drum 111 is selectively exposed by an exposing apparatus 108. As a result, an electrostatic latent image is formed on the photosensitive drum 111. Thereafter, the toner stored in a toner storage container 116 (developer storage portion) is coated on the peripheral surface of the development sleeve 118 by the development blade 117. Then, as development bias is applied to the development sleeve 118, the toner is supplied to the photosensitive drum 111 corresponding to the latent image. As a result, a toner image is formed on the photosensitive drum 111. Next, this toner image is transferred onto the sheet S by applying bias (voltage) to a transfer roller 109. Then, the sheet S is conveyed to a fixing apparatus 110, in which the toner image is fixed to the surface of the sheet S by the application of heat and pressure. After the fixation, the sheet S is discharged by a discharge roller 102 into a delivery portion 103 provided on the top side of the apparatus main assembly C.

The apparatus main assembly C is provided with a plurality of guiding members 151 and 152 in the form of a rail (guides on the main assembly side: first and second guides), which function as guides for the process cartridge 115 when the process cartridge 115 is installed into, or removed from, the apparatus main assembly. Referring to FIG. 10, the guide member 151 (first guide on the main assembly side ) is fixed to the apparatus main assembly C, being disposed so that its position corresponds to the night-hand side of the process cartridge. The guiding member 152 (second guide on the main assembly side) is fixed to the apparatus main assembly C, on the side opposite to the guiding member 151, with respect to the process cartridge, in other words, being disposed so that its position corresponds to the left-hand side of the process cartridge 115. The rail portions of the guiding members 151 and 152 are approximately parallel to each other, and extend in the direction perpendicular to the plane of the paper on which FIG. 10 is drawn.

The guiding member 152 is provided with a guide rail portion 153 in the form of a rail, which functions as a guide during the installation or removal of the process cartridge 115. The guide rail portion 153 is movable in the direction indicated by an arrow mark A in FIG. 10. Referring to FIGS. 13 and 14, in order to rotate the guiding member 152, the base portion of a lever 121 is fixed to the portion of the guiding member 152 adjacent to an elongated hole 156.

Referring to FIG. 11, the guiding member 152 is provided with a pair of pins 154, which project from both surfaces of the guiding member 152, one for one. The guiding member 152 is sandwiched between a pair of grooved members 155 provided with an elongated groove 155*a*, with the pair of pins 154 fitted in the elongated grooves 155*a*, one for one. The pair of grooved members 155 are fixed to the apparatus main assembly C. Further, the guide member 152 is provided with an elongated hole 156, in which a fixedly positioned shaft 157 fits. With this arrangement, the attitude of the guiding member 152 is regulated when the guiding member 152 rotates in the direction indicted by an arrow mark A. In other words, the pins 154 side following the elongated grooves 155*a* in the direction indicated by an arrow mark H, being guided by the grooved members 155, elongated hole 156, and shaft 157, which constitute a moving means 158. As a result, the guiding member 152 is controlled in position and attitude. In other words, the guiding member 152 is caused to move while rotating. The elongated grooves 155*a* are located in the direction perpendicular to the direction in which the elongated hole 156 extends. Further the elongated grooves 155*a* form an approximate arc, the center of which is on the opposite side of the shaft 157 with respect to the elongated grooves 155*a*. Furthermore, the guiding member 152 is provided with a guiding rail portion 153 as a guiding portion, which is farther away from the shaft 157 than the pin 154.

Next, referring to FIGS. 12, 13 and 14, a method by which the process cartridge 115 is installed into, or removed from, the apparatus main assembly C will be described. When the process cartridge 115 is outside the apparatus main assembly, the lever 121 hangs downward ass shown in FIG. 13, and the guiding rail portion 153 is at the uppermost point in its moving range.

Referring to FIG. 12, the process cartridge 115 is in the form of a rectangular parallelepiped, and is provided with the guiding portions 119 and 120 (cartridge guide, first guide, and second guide) which function as a guide when the process cartridge 115 is installed into, or removed from, the apparatus main assembly C. One of the guiding members (first guide), i.e., the guiding member 120, projects downward, forming a downwardly projecting portion 120*a*. This projecting portion 120*a* is approximately semicylindrical, and extends parallel to the electrophotographic photosensitive drum 111, across the entire range of the process cartridge 115. Each of the longitudinal ends of the process cartridge 115 is provided with cylindrical projection 123, the axial line of which is in alignment with the axial line of the drum 111. The other guiding member 119 (second guide) is rectangular, and extends parallel to the drum 111, across the entire range of the process cartridge 115. In other words, the process cartridge 115 is provided with a pair of guiding members 119 and 120, which extend on both sides, one for one, of the process cartridge 115 parallel to the drum 111.

The insertion of the process cartridge 115 into the apparatus main assembly C is carried out in the following manner. Referring to FIG. 13, first, a door 16 on the front side (non-driven side of the drum 111 in terms of its axial direction), which is hinged at the bottom side, is opened in manner to fall toward the front. Next, an operator grasps the handle (unillustrated) provided on the front side of the process cartridge 115, and rests the guiding members 119 and 120 of the process cartridge 115 on the guiding members 151 and 152 of the apparatus main assembly C, respectively. Then, the process cartridge 115 is inserted straight into the apparatus main assembly C (inward in the direction perpendicular to the plane of the paper on which the FIG. 13 is drawn). During the insertion, the guiding rail portion 153 of the guiding member 152 remains engaged with the projecting portion 120*a*, keeping the position of the process cartridge 115 fixed in terms of the left-to-right direction of the process cartridge 115. In this state, the bottom of the toner storage container 116 of the process cartridge 115 (third positioning portion 116*a* on the cartridge side), at which the process cartridge 115 is supported, and a projection 161 (third positioning portion on the main assembly side of the apparatus main assembly, are not in contact with each other. This projection 161 may be provided on the process cartridge side, while providing the apparatus main assembly C with a surface with which the projection 161 on the process cartridge side makes contact.

Next, after the insertion of the process cartridge 115 to a predetermined point in the apparatus main assembly C, the lever 121 is to be operated by the operator. As the level 121, which has been hanging downward, is rotated in the direction indicated by an arrow mark B, the guiding member 152 is moved in the direction indicated by an arrow mark D. This movement is caused as the edges of the elongated hole 156 slides on the shaft while pin 154 moves following the elongated grooves 155*a* in the direction II, as shown in FIG. 11. As described previously, the apparatus main assembly C is provided with the projection 161 which projects upward. Also during this movement, the position of the projection 161 remains adjacent to the bottom of the toner storage container 116 of the process cartridge 115.

Next, as the operator operates the lever 121, the process cartridge 115 descends due to its own weight, causing the bottom 116*a* of the process cartridge 115 to come into contact with the projection 161. Then as the lever 121 is further rotates, the process cartridge 115 which remained in contact with the guiding member 151 up to this point, becomes separated from the guiding member 151. As a result, the process cartridge 115 pivots in the counter-clockwise direction, with the tip of the projection 161 functioning as a flucrum. In other words, the process cartridge 115 becomes tilted so that the left side of the process cartridge 115 becomes lower than the right side of the process cartridge 115. During this pivoting of the process cartridge 115, the position of the process cartridge 115 in terms of the left-to-right direction remains fixed by the guiding rail portion 153 and semicylindrical projection 120*a*. The locus of the guiding rail portion 152 is fixed so that the axial line of the drum 111 in the process cartridge 115 moves virtually vertically. Therefore, the axial line of the drum 11 descends as indicated by an arrow mark F. Further, since the semicylindrical projection 120*a* is semicylindrical on the side by which it makes contact with the guiding rail portion 153, it smoothly slides on the semicylindrically concaved contact surface of the guiding rail portion 153 in the direction perpendicular to the longitudinal direction.

Referring to FIG. 14, as the process cartridge 115 pivots in the counterclockwise direction to a predetermined point, the projection 123 (positioning portion on the cartridge side) with which the process cartridge 115 is provided fits into the recess 163 (positioning portion on the main assembly side) of the positioning member 162 with which the apparatus main assembly C is provided. As a result, the position of the process cartridge 115 relative to the apparatus main assembly C is accurately fixed. It should be noted here that there are a pair of the positioning members 162, which are fixed, one for one, to the inward surfaces of the sidewalls of the apparatus main assembly C, in a manner to sandwich the process cartridge 115 when the process cartridge 115 is in the apparatus main assembly C. The recess 163 with which the apparatus main assembly C is provided opens upward, and the projection 123 of the process cartridge 115 enters the recess 163 from the open side of the recess 163, and perfectly fits with the recess 163. As for the projection 123, the process cartridge 115 is provided with a pair of the projections 123, which are located on the longitudinal ends, one for one.

When conveying the sheet S into the apparatus main assembly C, in other words, when clockwise rotational force, that is, driving force, is applied to the drum 111, the projection 161 functions as a member for preventing the rotation of the process cartridge 115. Therefore, the attitude of the process cartridge 115 remains fixed. In other words, the pivotal fulcrum of the process cartridge 115 functions as a point which prevents the process cartridge 115 from rotating when the sheet S is conveyed.

As the process cartridge 115 is inserted into the apparatus main assembly C, a driving force receiving portion through which driving force is received by the drum 111, is engaged with a driving member connected to the driving force source with which the apparatus main assembly C is provided.

When the process cartridge 115 is taken out of the apparatus main assembly C, the above described operational procedure is reversely carried out.

In other words, first, the lever 121 is rotated in the direction indicated by an arrow mark C so that the guiding member 152 is rotated in the direction indicated by an arrow mark E. With this action, the guiding rail portion 153 pushes up the projection 120*a* from underneath, causing the process cartridge 115 to move upward while causing it to pivot in the clockwise direction about the tip of the projection 161. During this movement of the process cartridge 115, the axial line of the drum 111 moves upward in the virtually vertical direction, that is, the direction indicated by an arrow mark G. As a result, the projection 123 smoothly slips out of the recess 163 of the positioning member 162. As the projection 120*a* is lifted further, the guiding member 119, i.e., the guiding member without a projection, comes into contact with the guiding member 151. As the projection 120*a* is lifted further, the projection 161 separates from the bottom 116*a* of the process cartridge 115, and the process cartridge 115 comes to be supported by the guiding members 151 and 152 with which the apparatus main assembly C is provided.

As the process cartridge 115 is lifted to the position shown in FIG. 13, the operator moves the process cartridge 115 toward the operator, in the direction parallel to the longitudinal direction, by grasping the handle (unillustrated) provided on the front surface of the process cartridge 15. With this action, the process cartridge 115 comes out of the apparatus main assembly C.

The handle is on the operator side of the process cartridge 115 in terms of the direction in which the process cartridge 115 is inserted into, or removed from, the apparatus main assembly C, at a position adjacent to a line which includes the center of gravity of the process cartridge 115 and extends in the longitudinal direction of the process cartridge 115.

As described above, in this embodiment, when installing the process cartridge 115 into the apparatus main assembly C, the process cartridge 115 can be securely positioned relative to the apparatus main assembly C simply by rotating the lever to the predetermined point after horizontally inserting the process cartridge 115 into the apparatus main assembly C. In other words, the installation or the removal of the process cartridge 115 becomes easier, and the accuracy with which the process cartridge is positioned relative to the apparatus main assembly is improved. Therefore, even a process cartridge with a heavier weight or a larger size can be securely positioned in the apparatus main assembly C because of the improved operativity.

Conversely, when removing the process cartridge from the apparatus main assembly, the process cartridge can be removed from the apparatus main assembly simply by pulling the process cartridge toward the operator after operating the lever. Therefore, even a process cartridge with a larger size can be easily removed.

In the above described embodiment, the lever 121 and guiding member 152 are attached to each other, simply by attaching the base portion of the lever 121 to the pivotal center portion of the guiding member 152. Therefore, without the provision of an additional structure, it is impossible to keep stable the rotational center of the lever 121. Next, the method by which the rotational center of the lever 121 is kept stable while the lever 121 is rotated, will be described.

Figure 15:
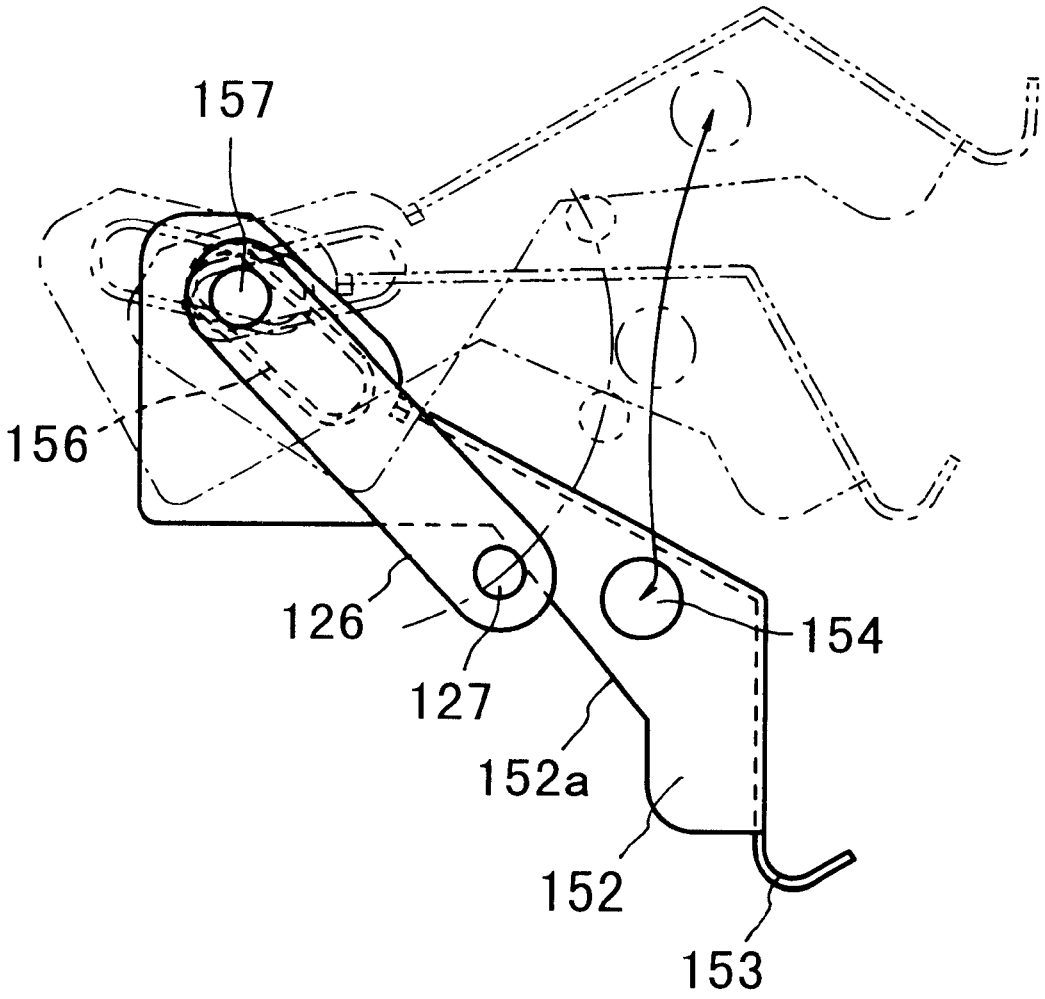
FIG. 15 is side views of a guiding member and an operating number used in the second embodiment of the present invention.

Referring to FIG. 15, the shaft 157 is rotationally supported by the apparatus main assembly C. To the outward end of the shaft 157, the base portion of the lever 121 is fixed.

Further, to the other end of the shaft 157, which is inside the apparatus main assembly C, the base portion of the lever 126 is fixed. The lever 126 is disposed adjacent to the guiding member 152 in terms of the axial direction of the shaft 157. To the tip of the lever 126, a pin 127 is fixed. The shaft 157 is fitted with a torsional spring (unillustrated). One end of this torsional coil spring is anchored to the lever 126, and the other end is fixed to the guiding member 152. Thus, the force generated by the resiliency of the torsional coil spring acts to cause the pin 127 of the lever 126 to come into, and remain in, contact with the bottom edge 152*a* of the guiding member 152.

When the cartridge control lever 121 for the installation or removal of the process cartridge 115 is in the horizontal position, the guiding rail portion 153 and the pin 127 of the lever 126 are at the bottommost positions in their moving ranges, as indicated by the solid lines in FIG. 15. As the cartridge control lever 121 is rotated in the counterclockwise direction, the lever 126 is rotated in the same direction, causing the pin 127 to slide against the bottom edge 152*a* of the guiding member 152 while pushing upward the guiding member 152. Further, the edge of the elongated hole 156 slides on the shaft 157 and the pins 154 slide following the elongated groove 155*a*.

Embodiment 3

Next, the third embodiment of the present invention will be described in detail with reference to the drawings.

FIGS. 16 to 20 are drawings for depicting the third embodiment of the present invention.

Figure 16:
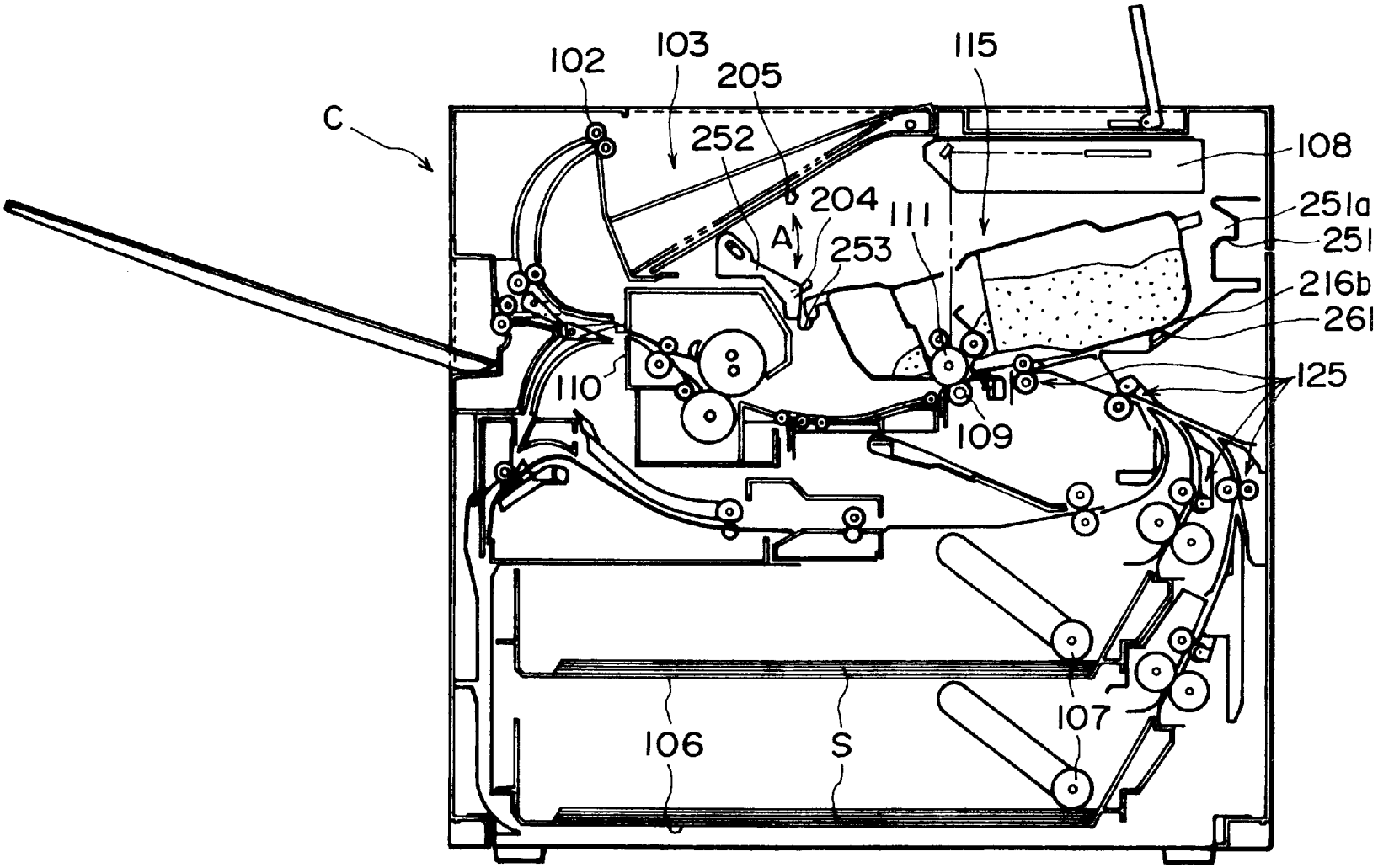
FIG. 16 is a sectional view of an image forming apparatus according to a third embodiment of the present invention.
Figure 17:
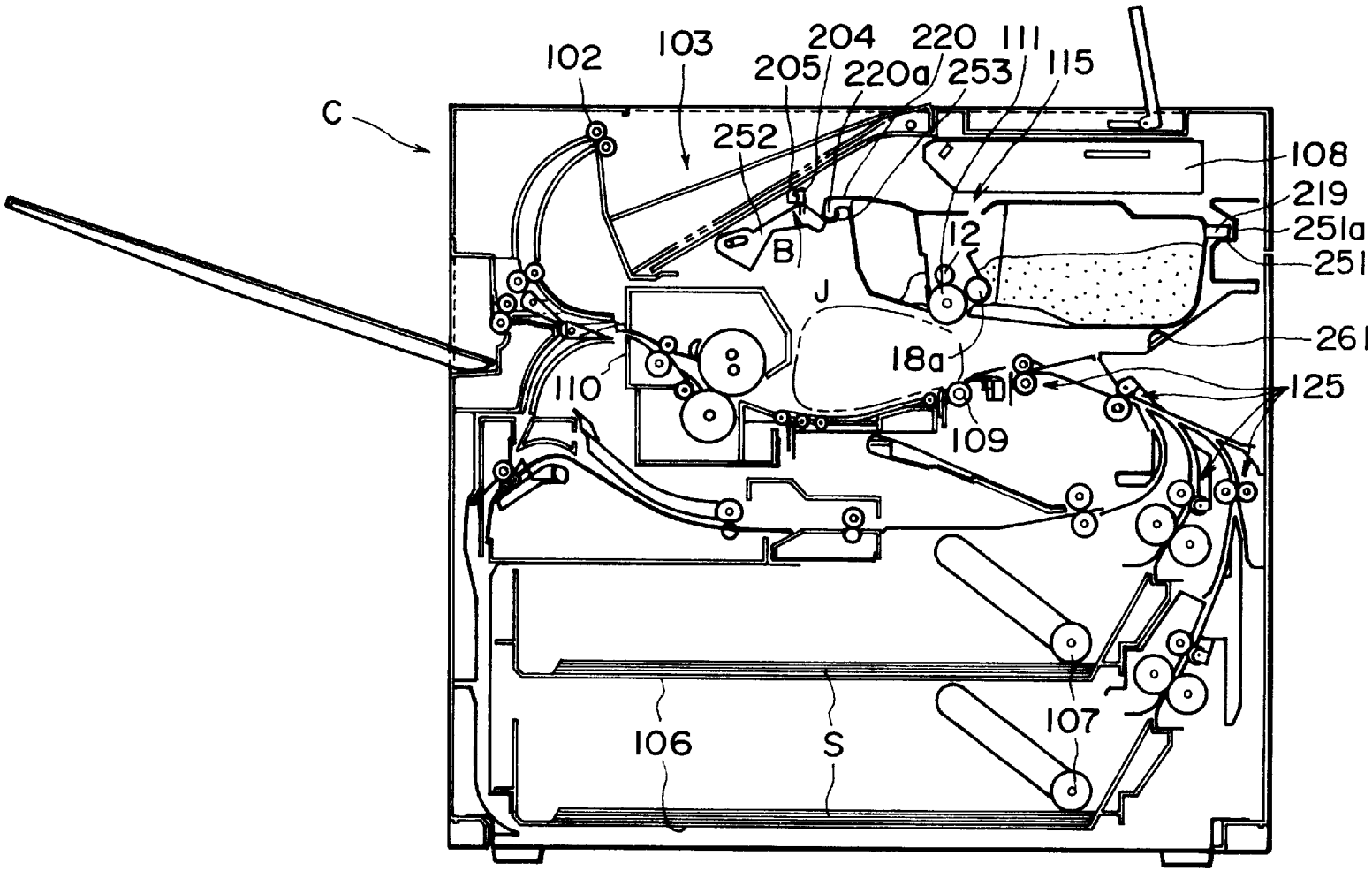
FIG. 17 is a sectional view of an image forming apparatus according to the third embodiment of the present invention.
Figure 18:
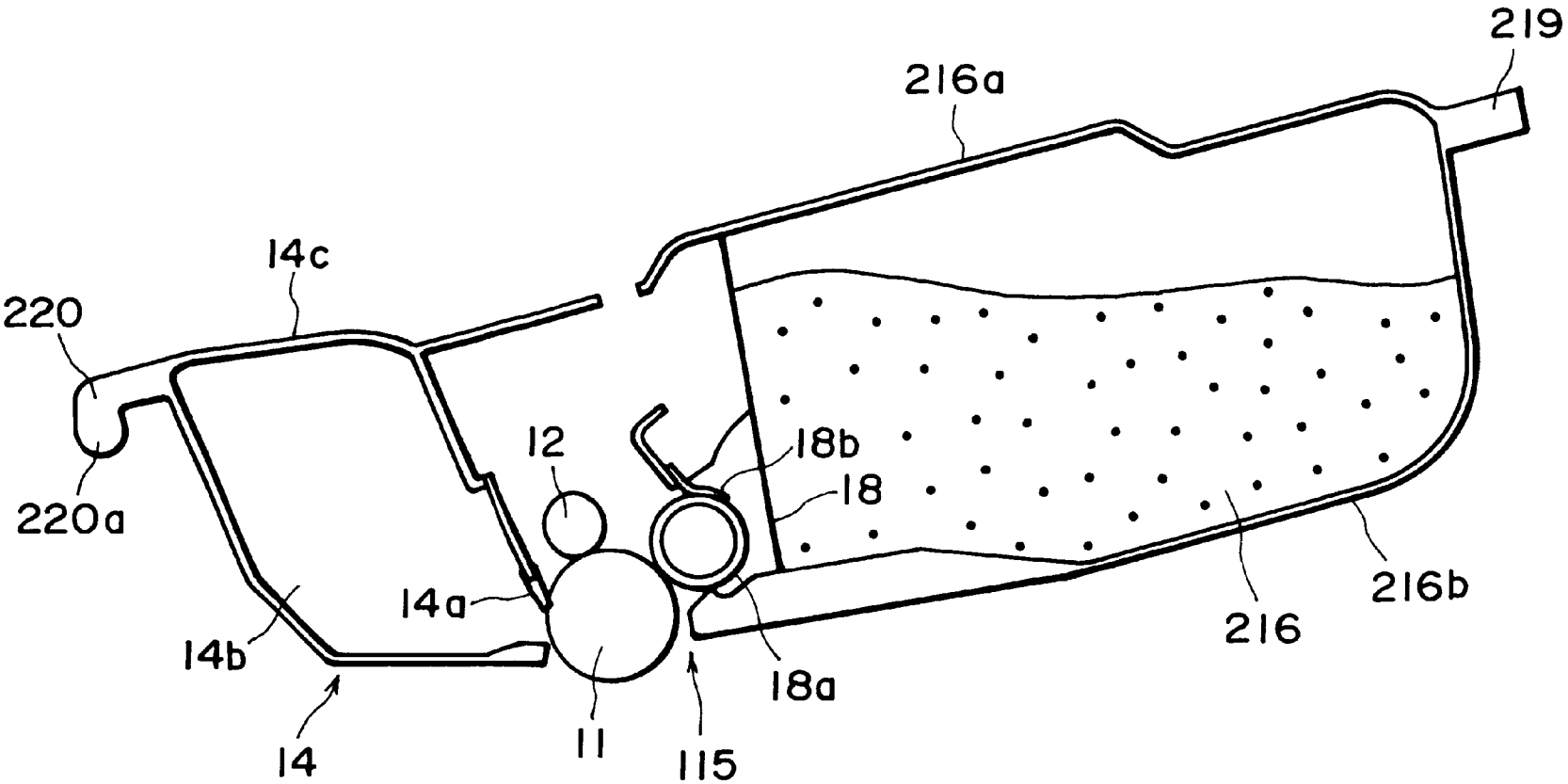
FIG. 18 is a sectional view of a process cartridge according to the third embodiment of the present invention.
Figure 19:
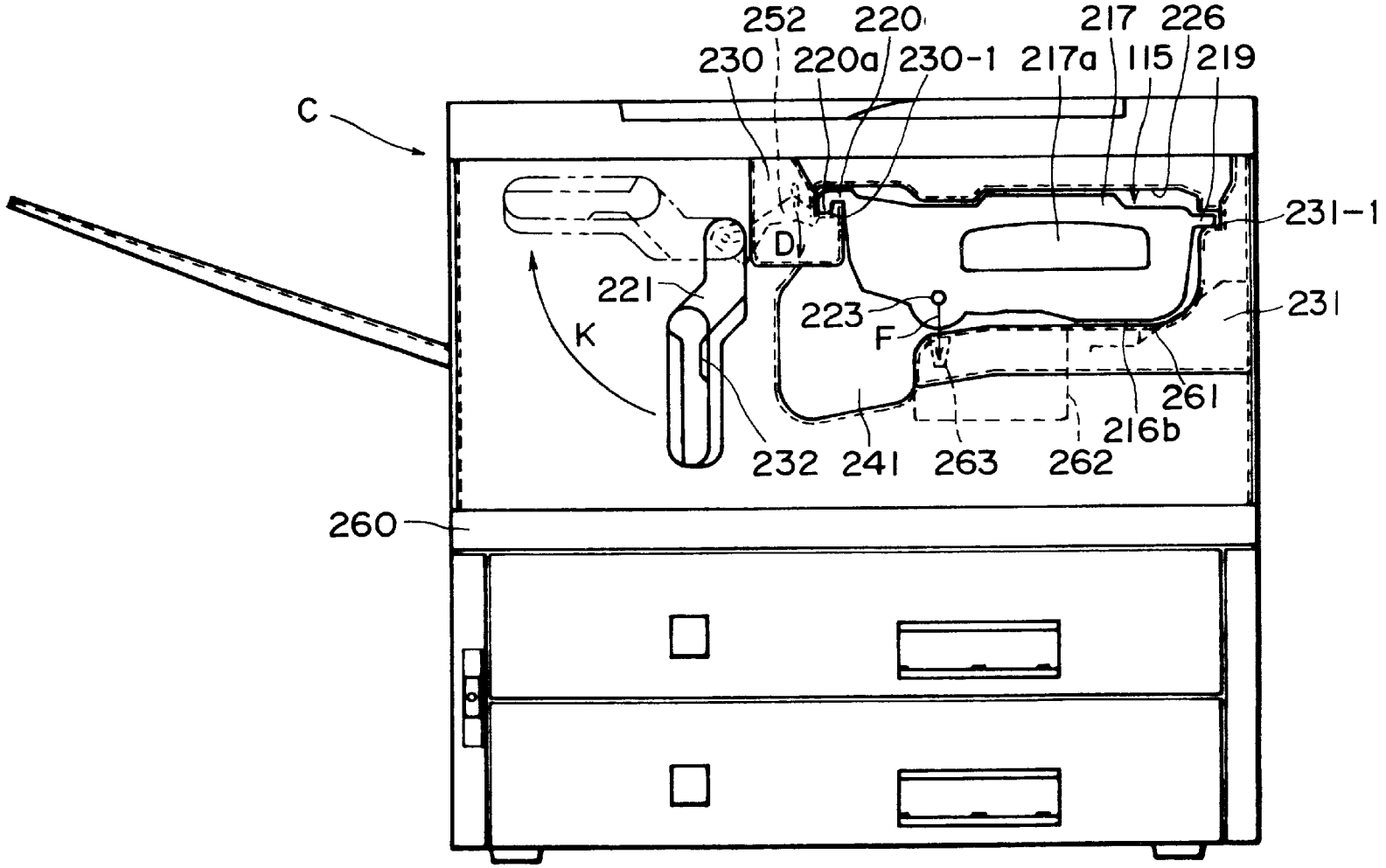
FIG. 19 is a front view among image forming apparatus according to the third embodiment of the present invention.
Figure 20:
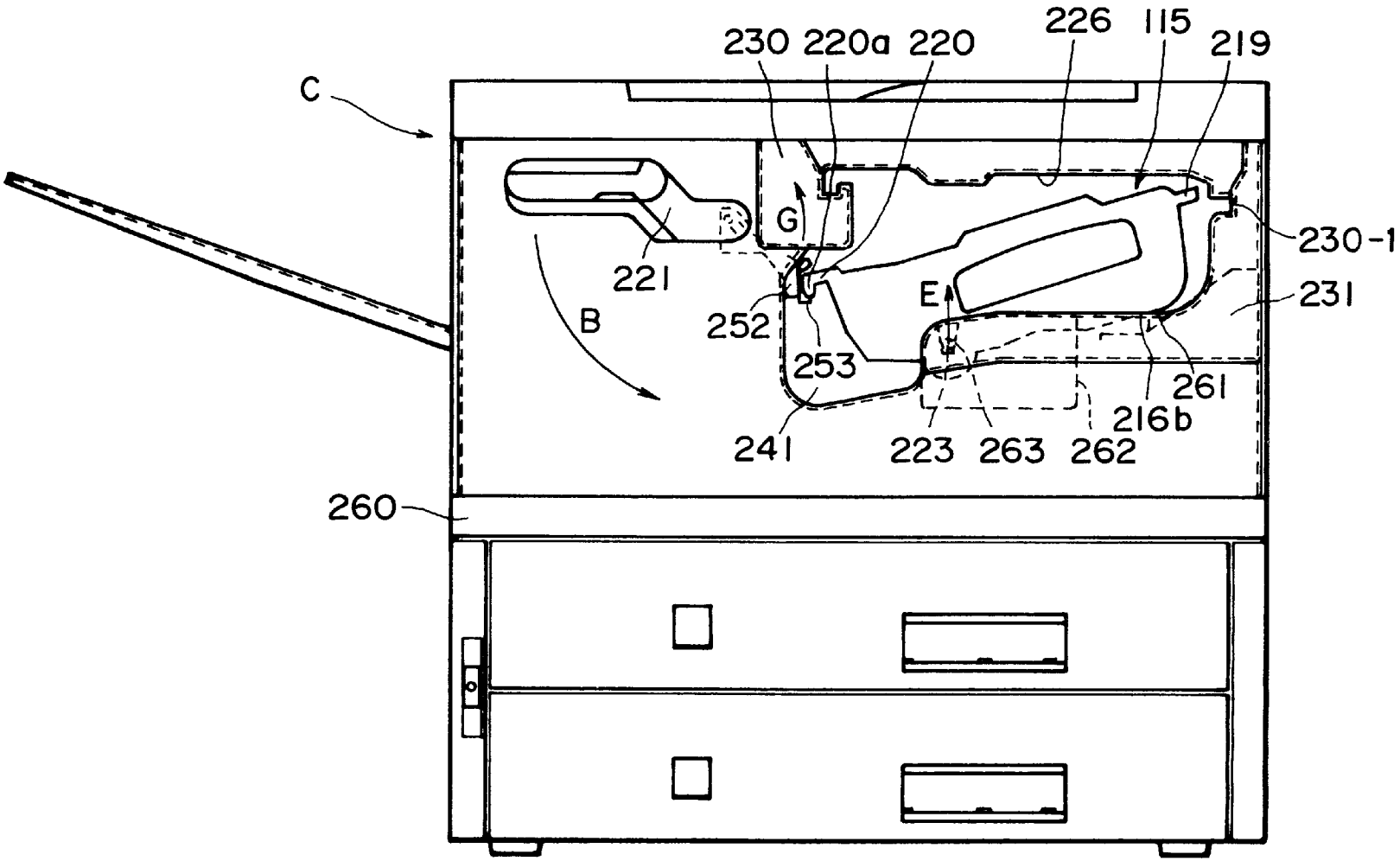
FIG. 20 is a front view of an image forming apparatus according to the third embodiment of the present invention.

FIGS. 16 and 17 are sectional views of the essential portion of the image forming apparatus in this embodiment, and FIG. 18 is a sectional view of the essential portion of the process cartridge in this embodiment. FIGS. 19 and 20 are front views of the image forming apparatus in this embodiment, for describing how the process cartridge in this embodiment is installed into, or removed from, the image forming apparatus in this embodiment.

(General Structure of Image Forming Apparatus)

To the members and portions, which are the same in function as those in the preceding embodiments, the same reference codes are assigned to quote their description given before.

(Process Cartridge)

To the members in this embodiment, which are the same in function as those in the preceding embodiments, the same reference codes are given to guote the descriptions given before.

(Structure for Installing or Removing Process Cartridge)

Referring to FIGS. 16 and 17, the apparatus main assembly C is provided with a pair of guiding members 251 and 252 in the form of a rail, which function as a guide when the process cartridge 115 is installed into the image forming apparatus from outside the image forming apparatus. The guiding member 251 is fixed to the apparatus main assembly C, on the side corresponding to the right-hand side of the process cartridge The guiding members 252 is disposed on the side opposite to the guiding member 251 with respect to the process cartridge 115; in other words, the guiding member 252 is disposed on the side corresponding to the left side of the process cartridge 115. The guiding rail portions 251*a* and 253, which are the rail portions of the guiding portions 251 and 252, respectively, extend approximately parallel in a direction perpendicular to the planes of FIGS. 16 and 17.

The guiding member 252 is provided with a guiding rail portion 253 in the form of a rail, which functions as a guide during the installation or removal of the process cartridge 115. This rail portion 253 is rendered rotatably in the direction indicated by the arrow mark A in FIG. 16.

FIG. 16 shows the state of the image forming apparatus, in which the process cartridge 115 has been situated at the predetermined image-formation position after its descent.

FIG. 20 is a front view of the image forming apparatus, the door 260 of which has been opened toward the operator, about the hinge located at the bottom edge of the door. The door 260 is attached to the apparatus main assembly C with the use of the hinge located at the bottom edge of the door, and can be opened or closed about the hinge.

In the state depicted in FIG. 20, the drum positioning projection 223 (first and second positioning portions on the cartridge side) of the process cartridge 115 is in the positioning recess 263 on the apparatus main assembly C side. Further, the projection 261 of the apparatus main assembly C is supporting the process cartridge 115 by the bottom 216*b* of the process cartridge 115. The process cartridge 115 is provided with two drum positioning projections 223, which are on the longitudinal ends of the process cartridge 115, one for one, projecting from the exterior surfaces, with their axial lines in alignment with the axial line of the photosensitive drum 111.

In this state, in order to pull the process cartridge 115 out of the apparatus main assembly, first, the cartridge control lever 221 is rotated in the direction indicated by an arrow mark B. FIGS. 17 and 19 show the state of the image forming apparatus after the cartridge control lever 221 is rotated 90 degrees in the direction of the arrow B from the position indicated in FIG. 20. As the cartridge control lever 221 is rotated, the guiding member 252 is rotated in the same direction, causing the guiding rail portion 253 of the guiding member 252 to push the projection 220*a* of the guiding member 220 of the process cartridge 115 upward from underneath. As the process cartridge 115 is pushed outward, it ascends while pivoting in the clockwise direction about the tip of the aforementioned projection 261. During this ascent of the process cartridge 115, the axial line of the photosensitive drum 111 moves upward approximately vertically, that is, in the direction indicated by an arrow mark E in FIG. 20. Next, after the guiding member 219 makes contact with the guiding rail portion 251*a,* the process cartridge 115 is pivoted upward, with the contact point between the guiding member 210 and guiding rail portion 251*a* functioning as a fulcrum. As a result, the process cartridge 115 is separated from the projection 261, and the projection 223 is allowed to smoothly slip out of the aforementioned positioning recess 263. After the process cartridge 115 is lifted to the position indicated in FIG. 19, the process cartridge 115 may be pulled in the direction perpendicular to the plane of the drawing, that is, toward the operator. With this action, the process cartridge 115 comes out of the apparatus main assembly C through the cartridge installation opening 226, with the guiding members 219 and 220 being guided by the guiding rail portions 251*a* and 253.

On the contrary, when installing the process cartridge 115 into the apparatus main assembly C, the process cartridge 115 is inserted into the apparatus main assembly from the front side of the apparatus main assembly. Then, after the process cartridge 115 is inserted to a predetermined position, the cartridge control lever 221 is rotated in the direction indicated by an arrow mark K. With this action, the process cartridge 115 descends while pivoting in the counterclockwise direction, from the position shown in FIG. 19 to the position shown in FIG. 20, which is the image formation position.

Figure 23:
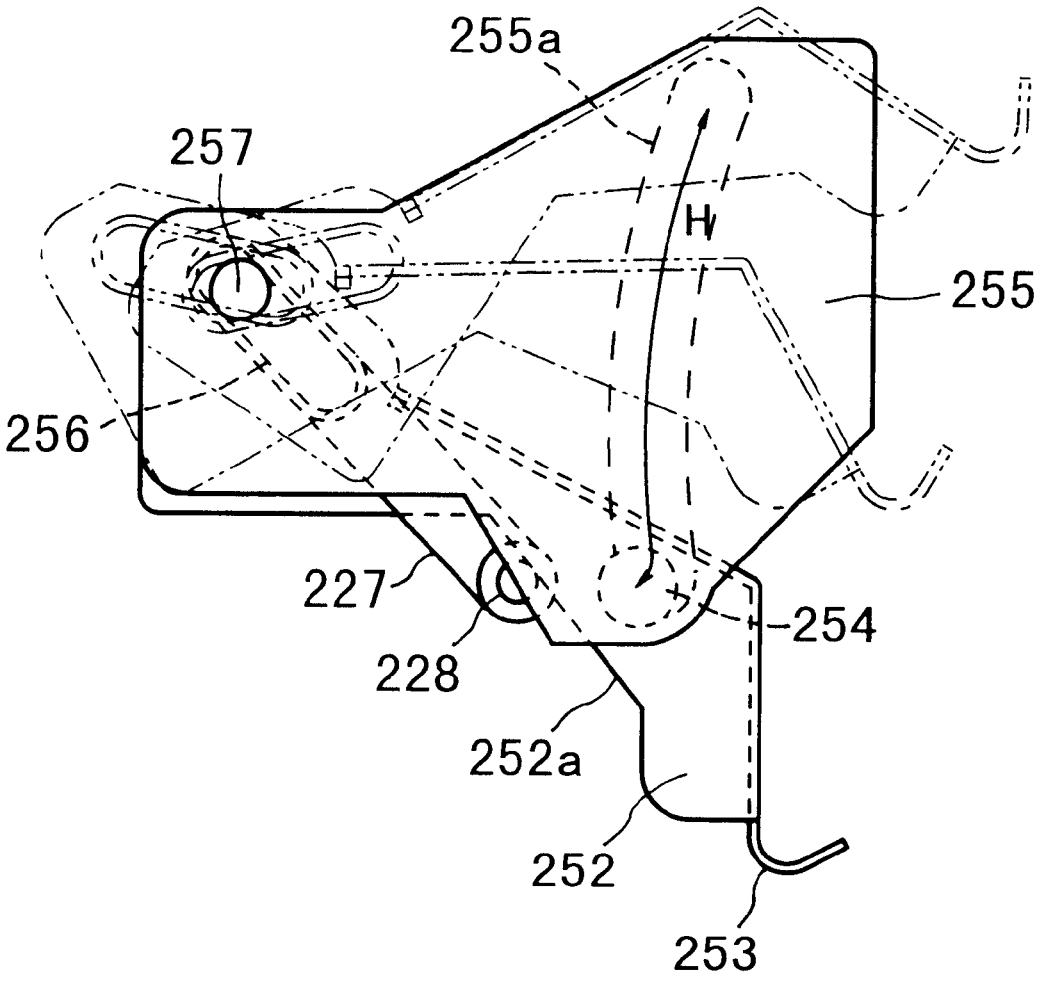
FIG. 23 is a front view of a guiding member and an operating member therefor used in the fourth embodiment of the present invention.

Referring to FIG. 23, the guiding member 252 is provided with two pins 254, which are located at the longitudinal ends of the guiding member 252, one for one. Each pin 254 is fitted in the long groove 255*a* of the grooved member 255 fixed to the apparatus main assembly C. The long groove 255*a* forms an arc, the center of which coincides with the tip of the projection 261. Further, in the long hole 256 of the guiding member 252, a shaft 257 is fitted. The shaft 257 is rotatably supported by the apparatus main assembly C. The shaft 257 and long hole 256 together control the attitude of the guiding member 252 while the guiding member 252 is rotationally moved. More specifically, the guiding member 252 is controlled in position and attitude as the pin 254 slide in the direction indicated by an arrow mark H against the edge of the long groove 255*a*. The guiding member 252 ascends as its bottom edge 252*a* is pushed by the pin 228 with which a lever 227 is provided. The lever 227 rotates in the same direction as the cartridge control lever 221 as the cartridge control lever 221 is rotated in the direction of the arrow mark B from the position shown in FIG. 20. As the guiding member 252 ascends following the long groove 255*a* while being controlled in moving direction by the long groove 255*a,* the guiding rail portion 253 ascends forming the aforementioned arc. During this action, the edge of the long hole 256 slides on the shaft 257, adjusting to the change in the distance between the shaft 257 and guiding rail portion 253.

Next, the installation or removal of the process cartridge into or from the apparatus main assembly will be described in more detail.

In order to pull the process cartridge 115 out of the apparatus main assembly C, first, the guiding member 252 must be rotated in the counterclockwise direction. Referring to FIGS. 16 and 17, the guiding member 252 is provided with a hook-like portion 204, whereas the apparatus main assembly C is provided with a locking portion 205 with which the hook-like portion 204 engages or disengages. FIG. 17 shows the state of the image forming apparatus in which the process cartridge 115 has been lifted to the uppermost point in the moving range of the process cartridge 115 by rotating the guiding member 252 in the counterclockwise direction, that is, in the direction of the arrow mark B. In this state, the hook-like portion 204 and locking portion 205 are in engagement with each other. At the position corresponding to the moment when the hook-like portion 204 becomes engaged with the locking portion 205, the process cartridge 115 is stopped and retained immobile thereafter.

The longitudinal ends of the process cartridge 115 are provided with the guiding members 219 and 220 (cartridge guide), one for one, which function as a guide during the installation or removal of the process cartridge 115 into or from the apparatus main assembly C. The guiding member 220, i.e., the guiding member on the left side, is provided with a semicylindrical projection 220*a* which is on the bottom side of the guiding member 220. The guiding members 219 and 220 are parallel to the photosensitive drum 11, and extend across the entire longitudinal range of the process cartridge 115.

The frontal appearance of the aforementioned image forming apparatus is as shown in FIG. 19.

The steps taken when inserting the process cartridge 115 into the apparatus main assembly C are as follows. Referring to FIG. 19, first, the door 260 located in the front surface of the apparatus main assembly C shown in FIG. 19 is opened toward the front about the hinge. Next, the process cartridge 115 is placed at the entrance of the opening so that the projection 220*a* of the guiding member 220 fits in the receiving portion 230-1 of a projecting portion 230 (guide on the main assembly side) with which the apparatus main assembly C is provided. The projecting portion 230 projects toward the front by a small step from the surrounding surface. On the other hand, on the right side of the process cartridge 115, the guiding member 219 is rested on the receiving portion 231-1 of the projecting portion 231 (guide on the main assembly side) with which the apparatus main assembly C is provided. The projecting portion 231 also projects toward the front by a small step from the surrounding surface. These projecting portions 230 and 231 function as an entrance guide during the installation or removal of the process cartridge 113 into or from the apparatus main assembly C.

Next, the process cartridge 115 is inserted straight (in the direction toward the back side of the paper on which FIG. 19 is drawn) into the apparatus main assembly C. During this inserting step, the position of the process cartridge 115 in terms of the widthwise direction of the process cartridge 115 remains fixed by the guiding rail portion 253 (FIG. 17) and projection 220*a,* which extend from the projecting portion 230. Meanwhile, the guiding member 210 on the right side of the process cartridge 115 moves onto the guiding rail portion 251*a* of the apparatus main assembly C from the receiving portion 231-1 of the projecting portion 231.

As the process cartridge 115 is inserted deeper into a predetermined point in the apparatus main assembly C, the process cartridge 115 passes by the projecting portions 230 and 231. At this point in the installation, the hook-like portion 204 of the guiding member 252 becomes engaged with the locking portion 205 of the apparatus main assembly C as shown in FIG. 17. Therefore, the process cartridge 115 is held stationary by the guiding members 251 and 252 as shown in FIG. 19. In this state, an operator presses a bottom 232 provided on the cartridge control lever 221. As the button is pressed, a release mechanism (unillustrated) is activated to release the hook-like portion 204 from the locking portion 205, freeing the guiding member 252. Next, the cartridge control lever 221, which is at the lowermost point in its moving range at this point in the installation, is rotated in the direction of the arrow mark K. As the cartridge control lever 221 is rotated, the guiding member 252 is moved in the direction of the arrow mark D.

The apparatus main assembly C is provided with a projection 261, which projects upward, and which is positioned opposite to the guiding member 252 with respect to the photosensitive drum 111.

As the guiding member 252 is moved in the direction of the arrow mark D by the manipulation of the cartridge control lever 221 by the operator, the bottom 216*b* (third positioning portion on the cartridge side) of the process cartridge 115 comes into contact with the projection 261. Then, the process cartridge 115 pivots in the counterclockwise direction about the tip of the projection 261; in other words, the process cartridge 115 pivots so that the left side of the process cartridge 115 becomes lower than the right side of the process cartridge 115. As a result, the guiding member 219, which is on the right side of the process cartridge 115, separates from the guiding rail portion 251*a*. During this movement of the process cartridge 115, the position of the process cartridge 115 in terms of the left-to-right direction remains fixed by the guiding rail portion 253 and the projection 220*a,* being allowed to descend while pivoting. The rotational locus of the guiding rail portion 253 is fixed so that the axial line of the photosensitive drum 111 moves approximately vertically. Therefore, the axial line of the photosensitive drum 11 descends in the direction of the arrow mark F. Further, since the projection 220*a* has an arc-like profile, it can smoothly slide against the guiding rail portion 253.

Referring to FIG. 20, as the process cartridge 115 pivots to a predetermined point in the counterclockwise direction, the projection 223 fits into the recess 263 of the positioning member 262. As a result, the process cartridge 115 is securely positioned. The two positioning members 262 oppose each other in a manner to sandwich the process cartridge 115 when the process cartridge 115 is in the apparatus main assembly C, and are fixed to the side plates, that is, the front and rear plates, of the apparatus main assembly C. By the attachment of each positioning member 262 to the corresponding side plate, the recess 263 is created. The recess 263 is U-shaped and opens upward. The projection 223 enters the recess 263 from the open side. After the entry, the projection 223 is securely engaged in the recess 263.

When conveying the sheet S into the apparatus main assembly C, in other words, when a clockwise rotational force, that is, a driving force, is applied to the photosensitive drum 111, the projection 261 functions as a member for preventing the rotation of the process cartridge 115. Therefore, the attitude of the process cartridge 115 remains fixed. In other words, the pivotal center, about which the process cartridge 115 pivots when the process cartridge 115 is installed into, or removed from, the apparatus main assembly C, functions as a point that prevents the process cartridge 115 from rotating when the sheet S is conveyed.

When the process cartridge 115 is taken out of the apparatus main assembly C, the above-described operational procedure is reversely carried out. In other words, referring to FIG. 20, first, the cartridge control lever 221 is rotated in the direction indicated by an arrow mark B so that the guiding member 252 is rotated in the direction indicated by an arrow mark G. With this action, the guiding rail portion 253 pushes up the projection 220*a* from underneath, causing the process cartridge 115 to move upward while causing it to pivot in the clockwise direction about the tip of the projection 261. As the guiding member 219, which is on the right side of the process cartridge 115, comes into contact with the guiding rail portion 251*a,* the process cartridge 115 pivots about the contact point between the guiding member 219 and guiding rail portion 251*a* in the clockwise direction while continuing to ascend. During this movement of the process cartridge 115, the axial line of the drum 111 moves upward in the virtually vertical direction, and therefore, the projection 223 smoothly slips out of the recess 263.

Then, the process cartridge 115 ascends to the position shown in FIGS. 17 and 19, at which the process cartridge 115 is stationarily held, with the hook-like portion latched by the locking portion 205. Thereafter, the operator pulls the handle 217*a* with which the side cover 217 on the front side of the process cartridge 115 is provided, toward the operator, to move the process cartridge 115 in a direction parallel to the longitudinal direction to take the process cartridge 115 out of the apparatus main assembly C.

Also, when the sheet S is jammed below the process cartridge 115, the process cartridge 115 is lifted up in the same manner as described above. As the process cartridge 115 is lifted to the position illustrated in FIG. 19, the hook-like portion 204 becomes latched by the locking portion 205 as described above, and therefore, the process cartridge 115 is held stationary, without being assisted by the hand of the operator. The front side of the apparatus main assembly C is provided with an opening 241, which is below the projecting portion 230 and to the side of the recess 231. Thus, the sheet jam visible through this opening 241 can be removed by the operator through this opening 241; the jammed sheet S can be removed through this opening 241 by the operator, who does not need to hold the process cartridge 115 at this point.

The shape of the cartridge insertion opening 226 may be approximately the same as the shape of the cross section of the process cartridge 115, which is approximately in the form of a rectangular parallelepiped. The cartridge insertion opening 226 and the opening 241 for jam processing are continuous with each other, and therefore, when the door 260 is open, the openings 226 and 241 together expose the path through which the sheet S is conveyed between the transfer roller 109 and fixing apparatus 110. Since the opening 241 is continuous with the cartridge insertion opening 226, a greater portion of the aforementioned sheet conveyance path is exposed than otherwise. However, since the process cartridge 115 is moved upward away from the conveyance path for the sheet S, it is easy to take care of the jam even if the two openings are not continuous.

Thus, even in the case of a heavy process cartridge or a large process cartridge, which will necessarily be used as an image forming apparatus is increased in size, a jam can be easily taken care of without pulling out a process cartridge from an image forming apparatus.

Further, the front side of the apparatus main assembly C is provided with a pair of projections (projections 230 and 231), one above the opening for jam processing and the other to the side of the opening for jam processing. Therefore, even in the case of a heavy process cartridge or a large process cartridge, which will necessarily be used as an image forming apparatus is increased in size, the process cartridge can be easily inserted by temporarily resting it on the projections. In other words, it is easier of take care of a jam, and also easier to handle a heavy process cartridge.

Embodiment 4

Figure 21:
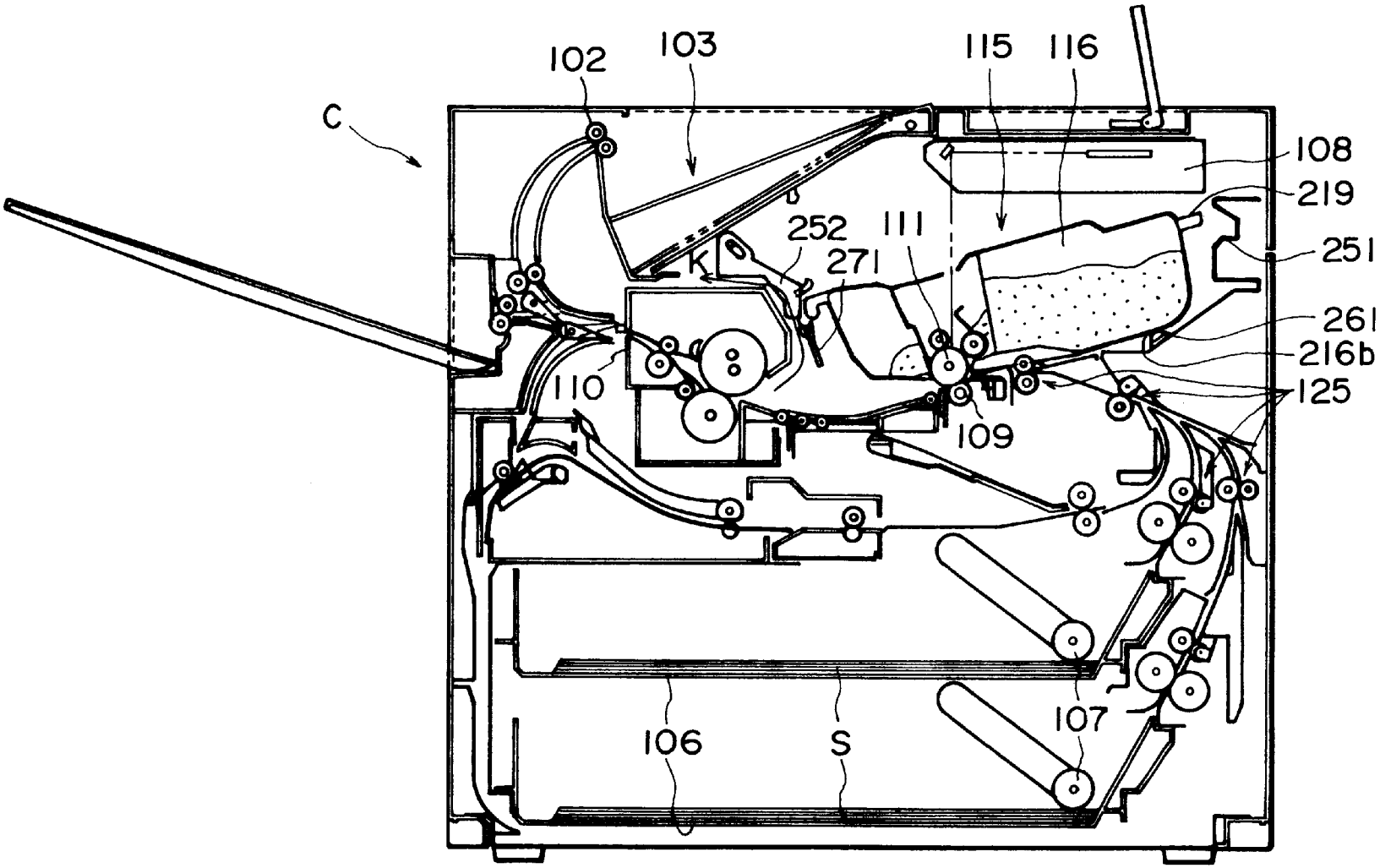
FIG. 21 is a sectional view of an image forming apparatus according to a fourth embodiment of the present invention.
Figure 22:
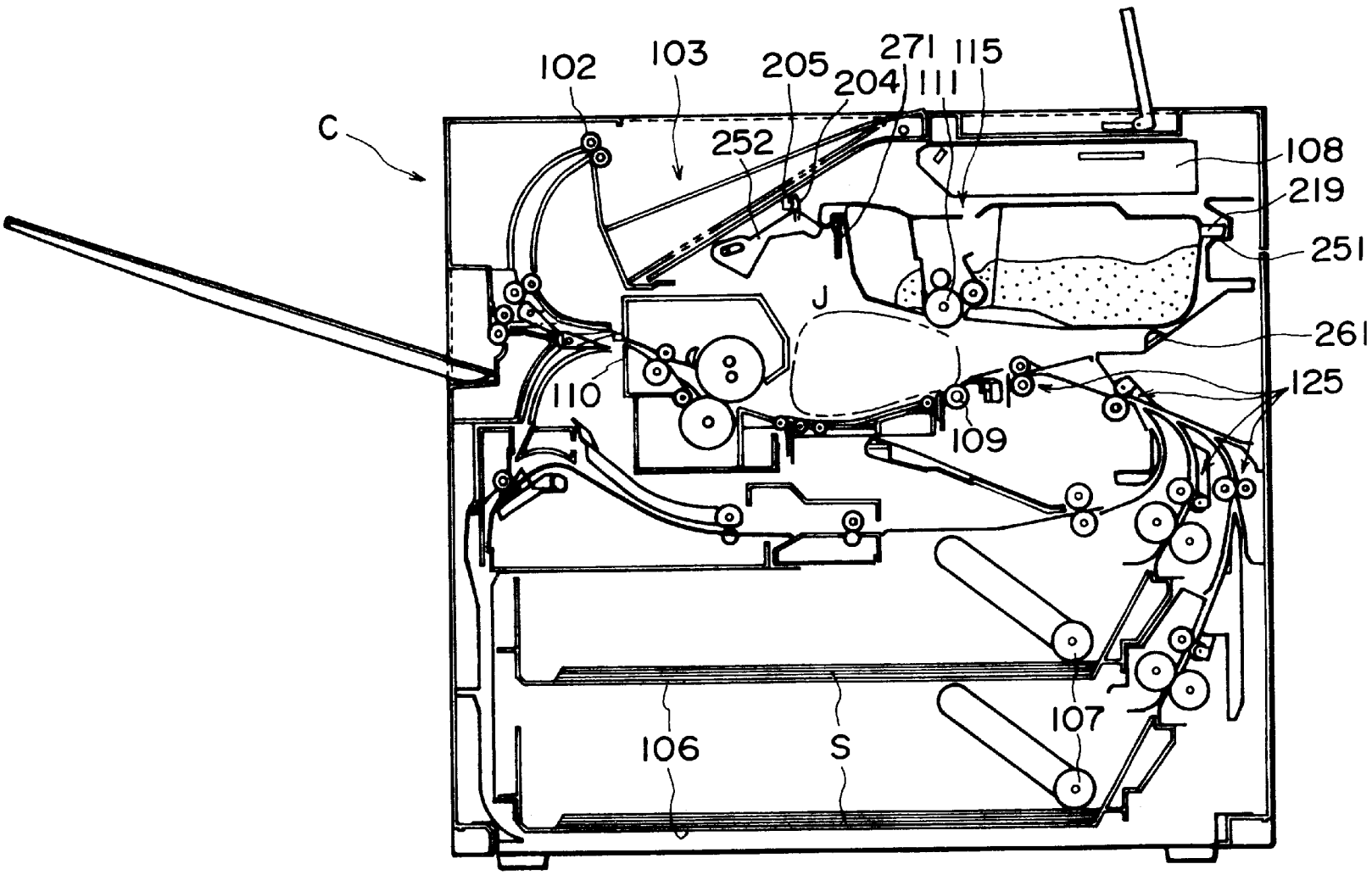
FIG. 22 is a sectional view of an image forming apparatus according to the fourth embodiment of the present invention.

FIGS. 21 and 22 are sectional views of the essential portion of the image forming apparatus in the fourth embodiment of the present invention.

This embodiment is different from the third embodiment in that the guiding members are provided with an air directing member. The components and portions of the image forming apparatus, which are identical to those in the third embodiment, will be given the same reference codes as those in the third embodiment to quote the descriptions given regarding the third embodiment. The process cartridge used in this embodiment is identical to the one used in the third embodiment.

In FIG. 21, a reference code 271 designates an air directing member, which is rotatably attached to the guiding member 252. More specifically, the top side of the air directing member 271 is attached to the bottom side of the guiding rail portion 253, with the use of a hinge, the axial line of which is perpendicular to the plane of the sheet on which FIG. 21 is drawn. This air directing member 271 is approximately the same in length as the fixing apparatus 10 in terms of the direction perpendicular to the plane of the paper on which the figure is drawn.

FIG. 21 shows the state of the image forming apparatus in which the process cartridge 115 has settled in the predetermined position for image formation. When the process cartridge 115 is in this position, the air directing member 271 is at the illustrated position, being in contact with the catching portion (unillustrated) with which the image forming apparatus main assembly is provided after having come into contact therewith. Therefore, an air passage that directs air in the direction indicated by an arrow mark K has been formed between the air directing member 271 and fixing apparatus 110; the air directing member 271 is between the process cartridge 115, and the fixing apparatus 110 on the left side of the process cartridge 115, blocking the heat that the fixing apparatus 110 generates, so that the heat is not transferred to the process cartridge 115. Further, the air directing member 271 functions to exhaust the heated air from the fixing apparatus 110 out of the apparatus main assembly C through an air passage (unillustrated) by directing the heated air in the direction of the arrow mark K.

Referring to FIG. 22, when an operator takes care of a jam by lifting the process cartridge 115, the operator lifts the process cartridge 115 by rotating the guiding member 252. With this rotation, the air directing member 271 attached to the guiding member 252 is also lifted, and remains stationarily hanging down.

In this state, the air directing member 271 is recessed from the opening 241 through which a jam is taken care of and a jam processing operational area J. Therefore, it does not affect the jam processing operation. The term "jam processing operation area J" refers to a space through which the operator can put a hand or a device to remove the jammed sheet S. Further, in this state, the air directing member 271 is away from the process cartridge 115, and therefore, the air directing member 271 does not interfere with the installation or removal of the process cartridge 115; the process cartridge 115 can be pulled out in this state, without any interference.

In other words, with the provision of the guiding member along with the air directing member, it becomes easier to deal with a jam and also to secure an air passage within the apparatus main assembly to control the temperature increase within the apparatus main assembly.

As described above, according to the third and fourth embodiments of the present invention, a jam can be dealt with by holding the process cartridge with a holding means after lifting the process cartridge by moving the cartridge moving means. Therefore, it is unnecessary to remove the process cartridge from the apparatus main assembly each time a jam must be taken care of. In other words, a jam can be more efficiently taken care of.

Embodiment 5

Next, referring to drawings, the fifth embodiment of the present invention will be described in detail.

FIGS. 23 to 33 are drawings for depicting the fifth embodiment of the present invention.

Figure 24:
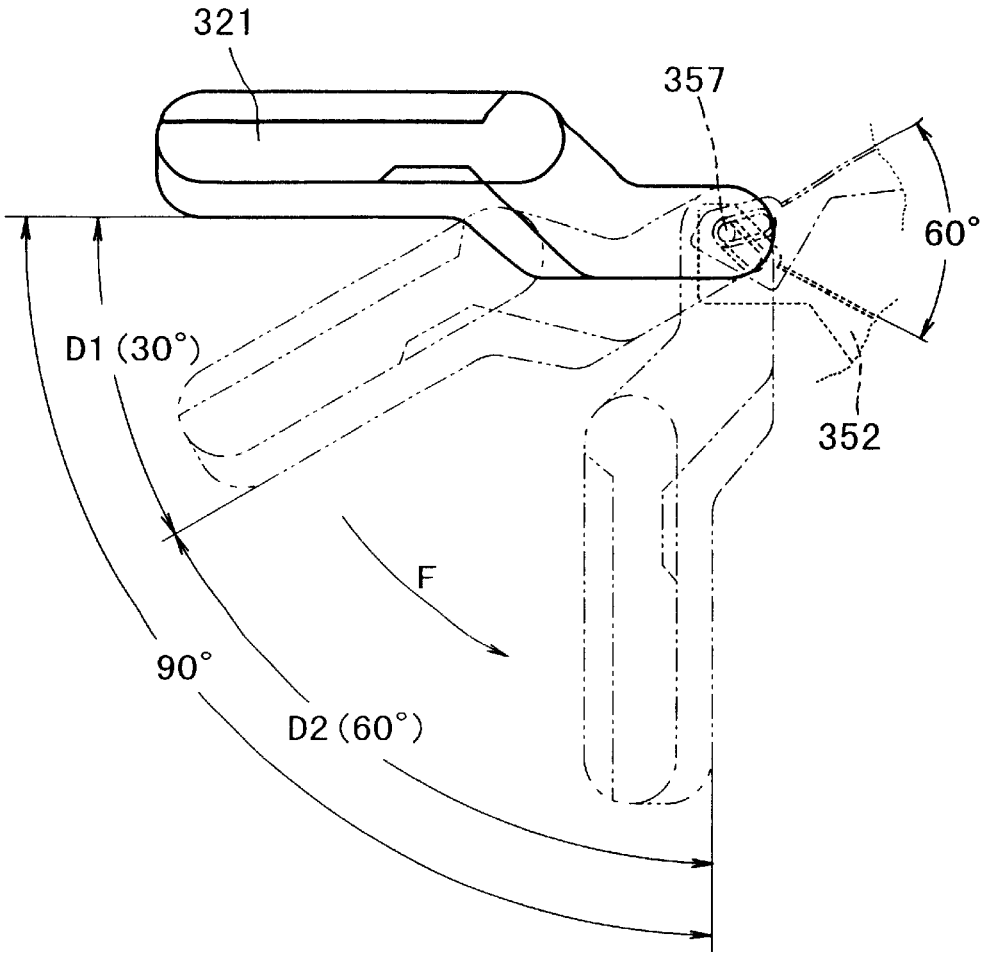
FIG. 24 is a detailed front view of an operating lever used in the fifth embodiment of the present invention.
Figure 25:
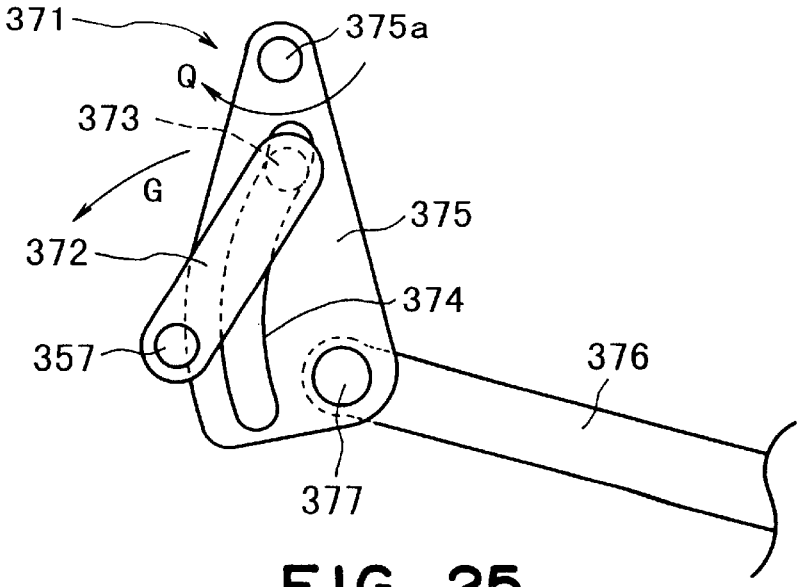
FIG. 25 is a detailed front view of a drive coupling control means used in the fifth embodiment of the present invention.
Figure 26:
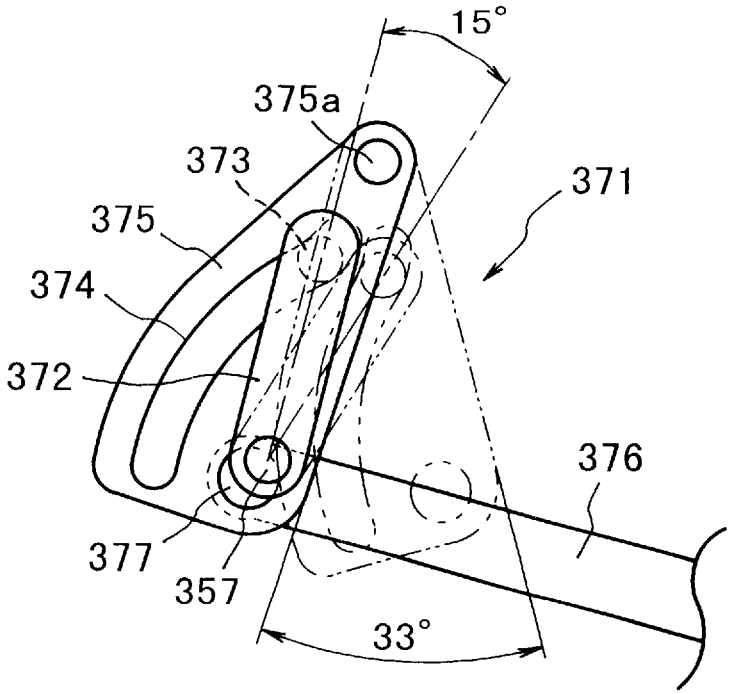
FIG. 26 is a detailed front view of a drive coupling control means used in the fifth embodiment of the present invention.
Figure 27:
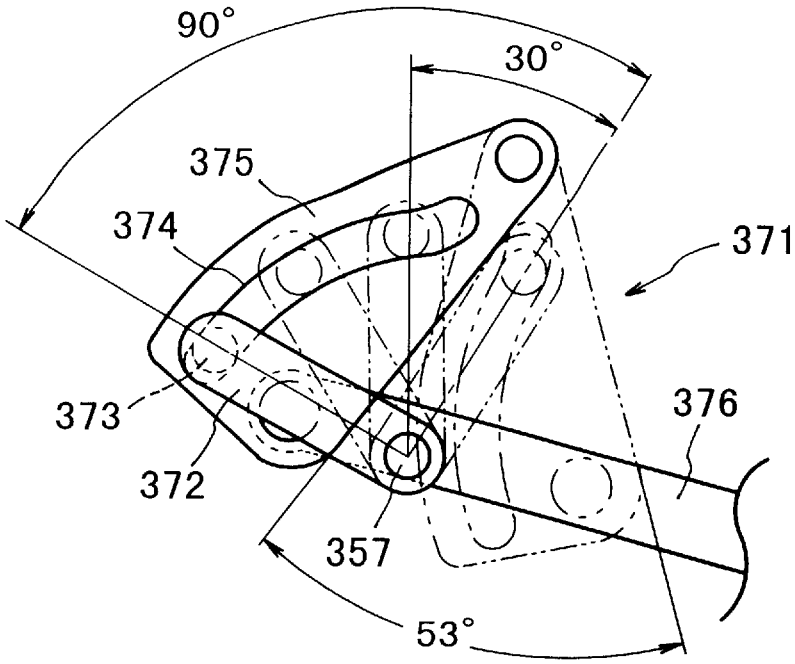
FIG. 27 is a detailed front gear of a drive coupling control means used in the fifth embodiment of the present invention.
Figure 28:
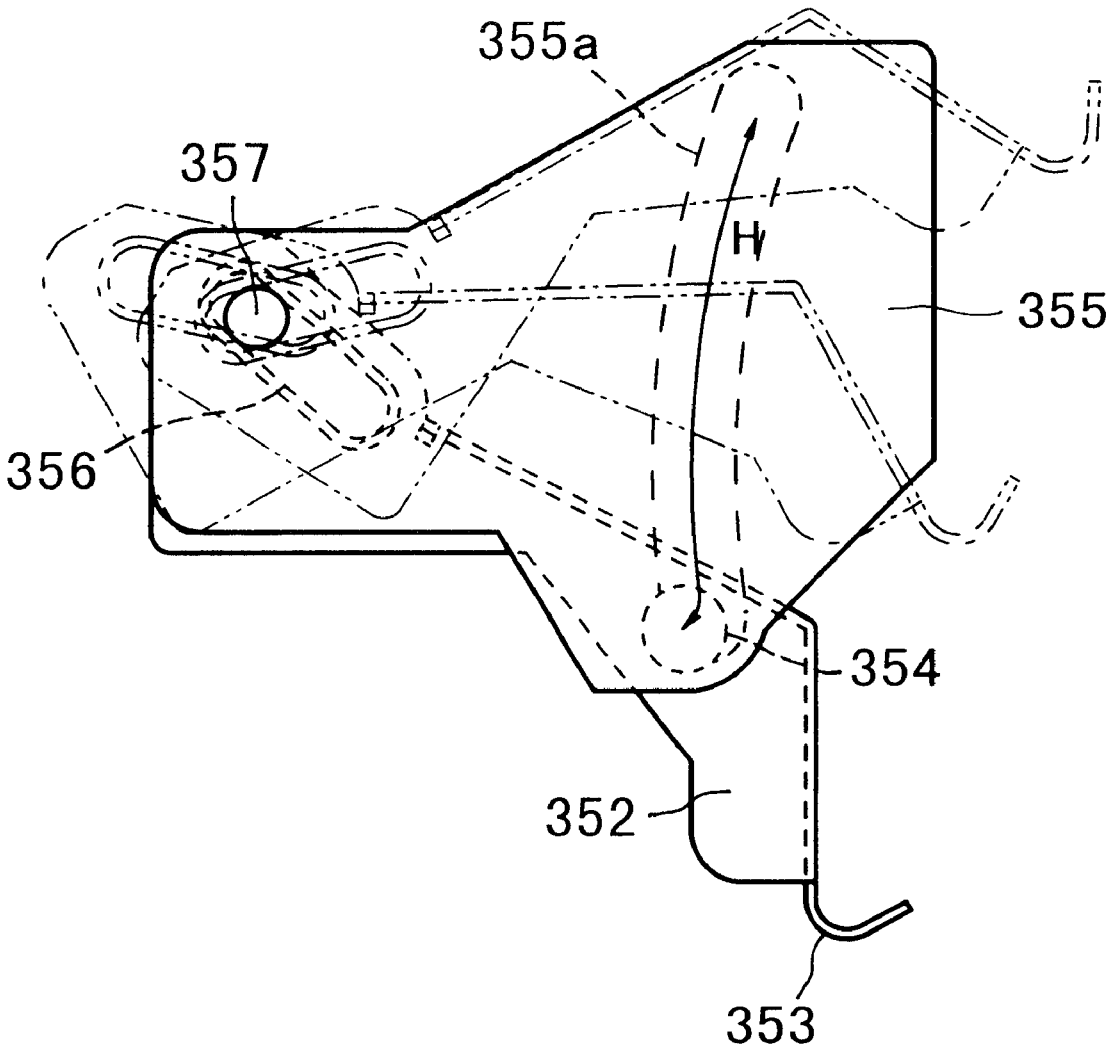
FIG. 28 is a detailed front view of a guiding member used in the fifth embodiment of the present invention.
Figure 29:
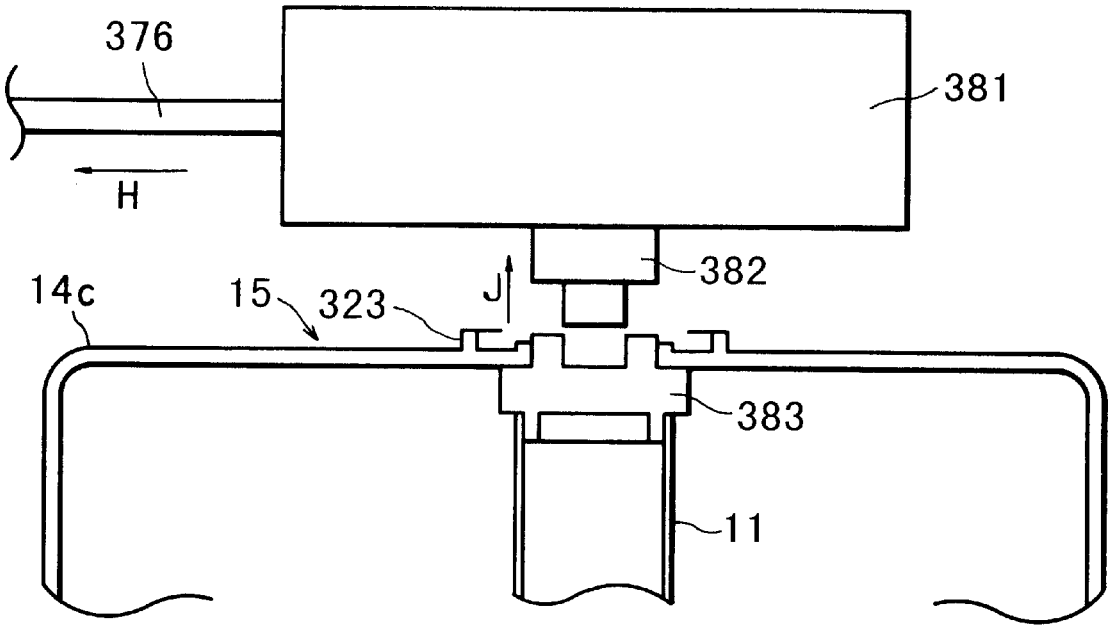
FIG. 29 is a top plan view of the driving means and process cartridge according to the fifth embodiment of the present invention.
Figure 30:
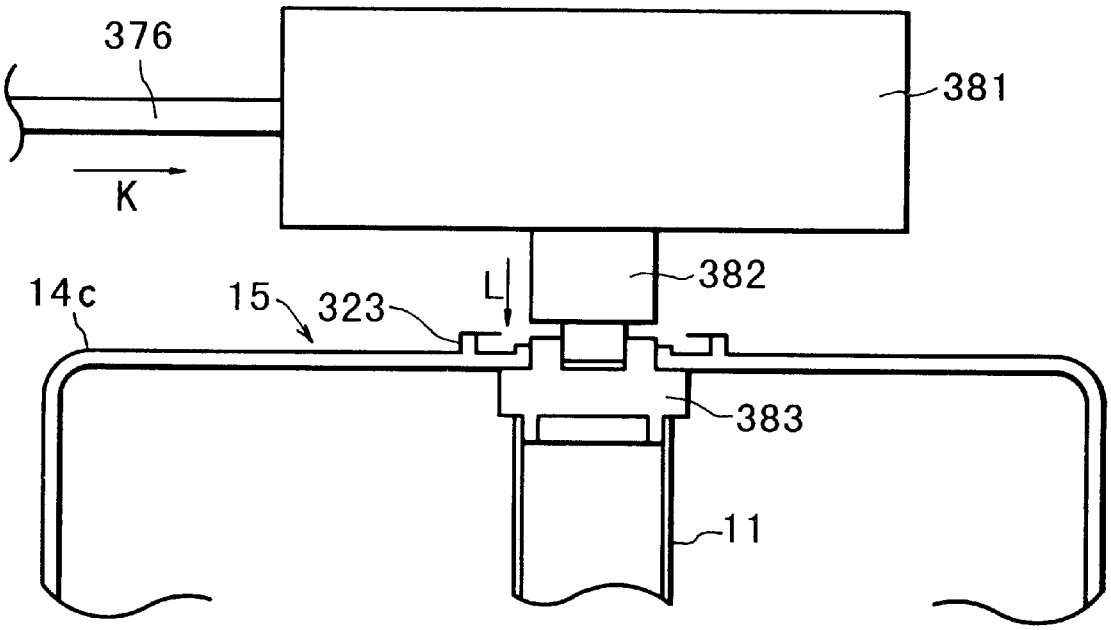
FIG. 30 is a top plan view of the driving means and the process cartridge according to the fifth embodiment of the present invention.
Figure 31:
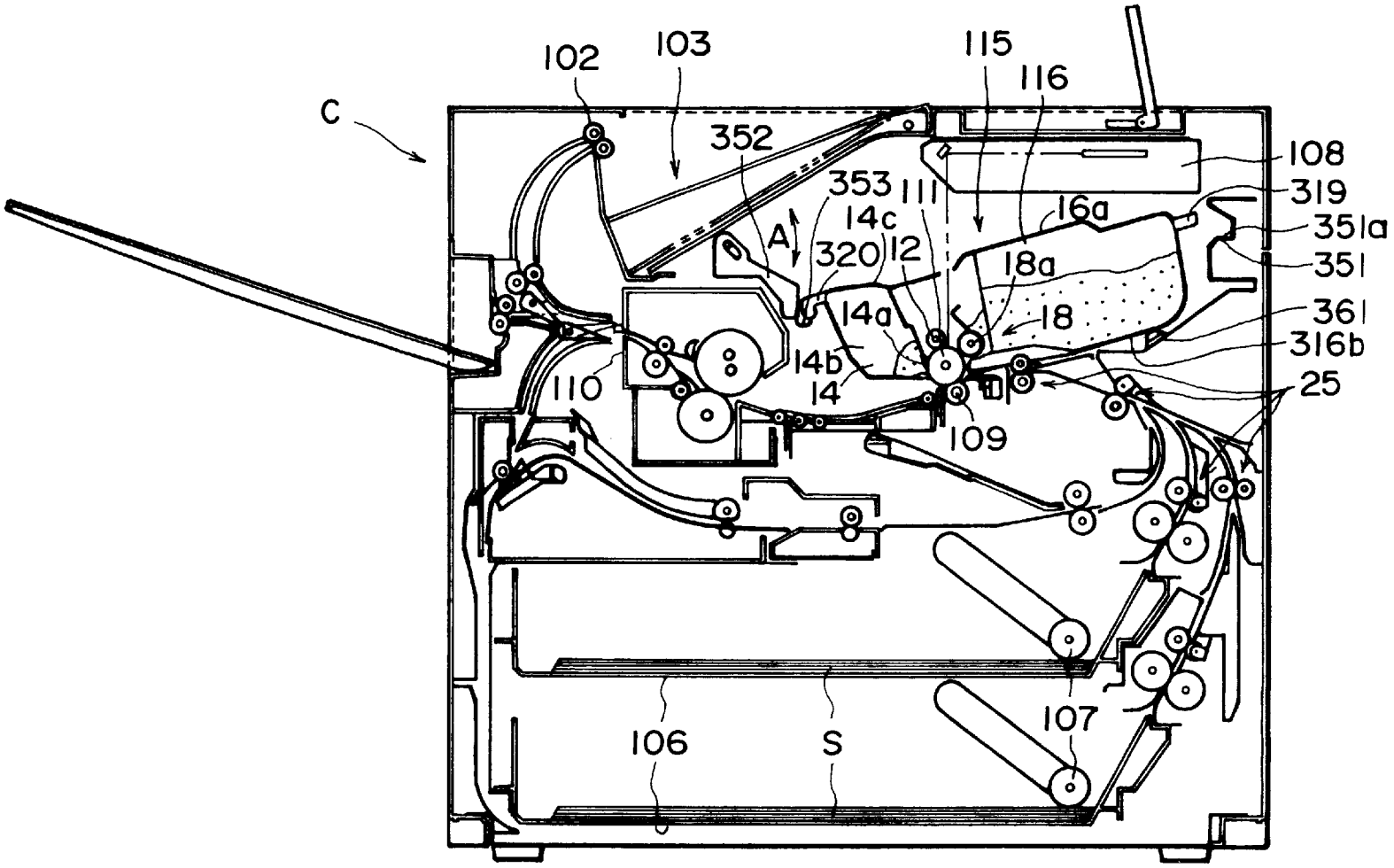
FIG. 31 is a sectional view of an image forming apparatus according to the fifth embodiment of the present invention.
Figure 32:
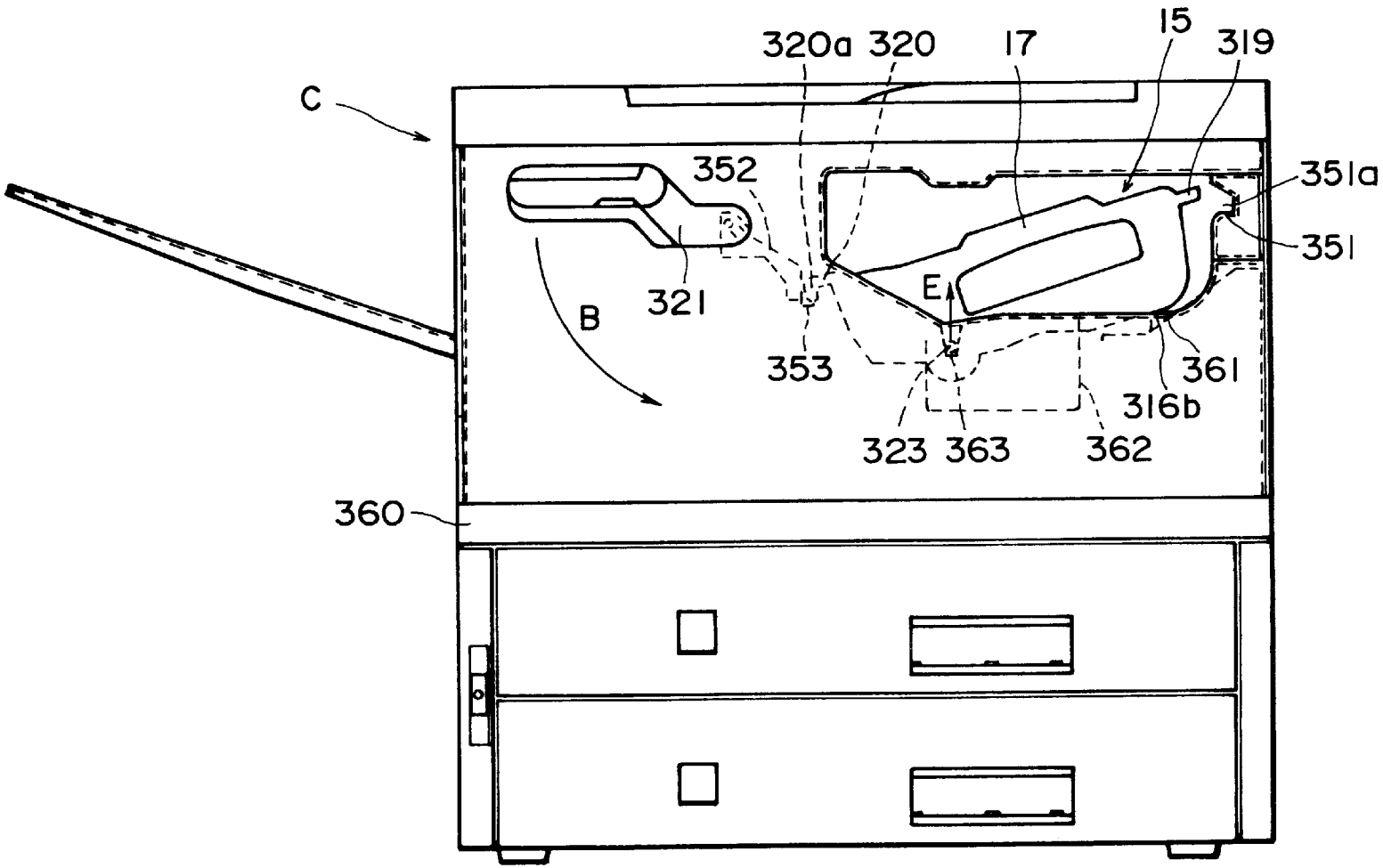
FIG. 32 is a front view of an image forming apparatus according to the fifth embodiment of the present invention.
Figure 33:
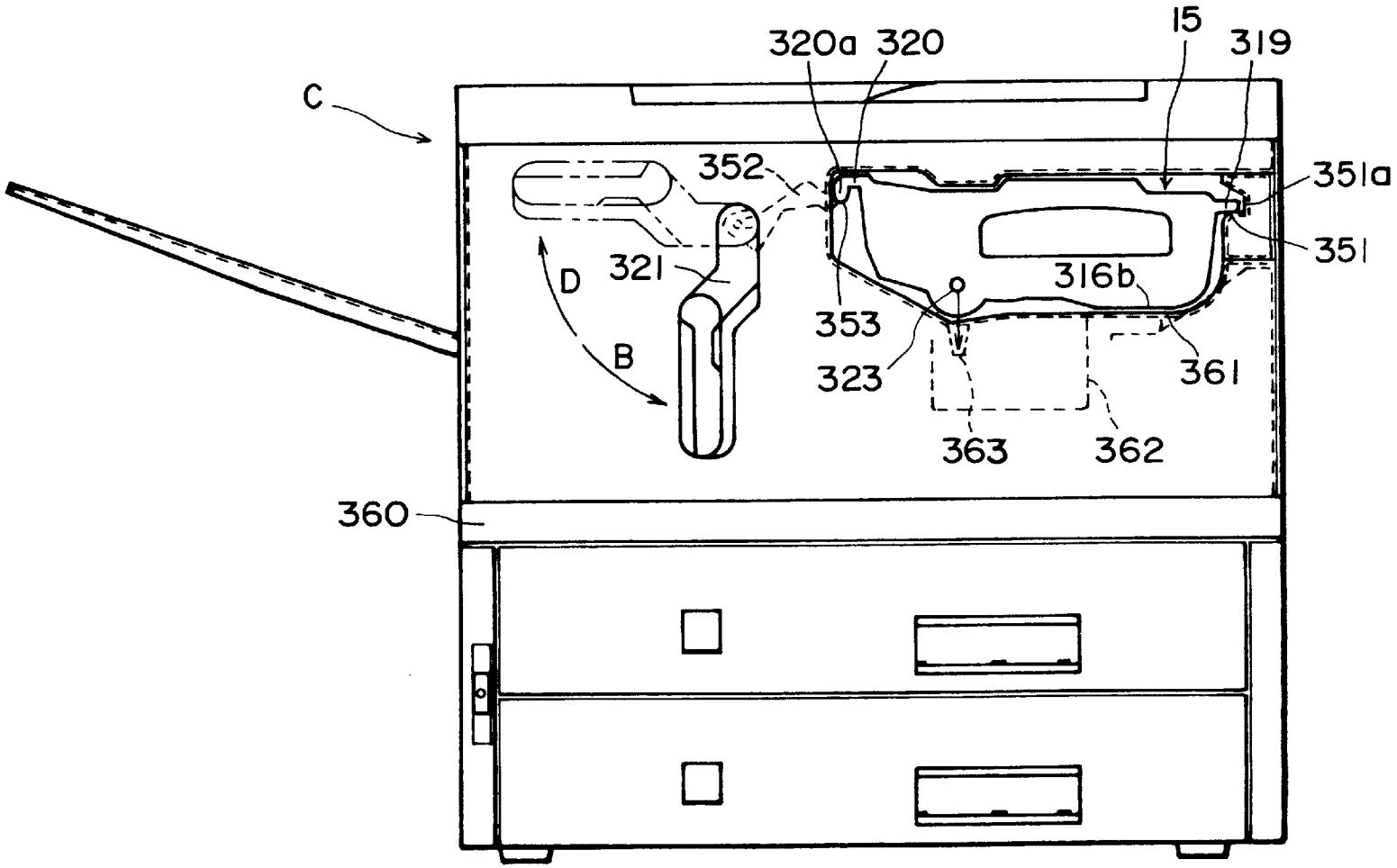
FIG. 33 is a front view of an image forming apparatus according to the fifth embodiment of the present invention.

FIG. 24 is a detailed drawing of a cartridge controlling lever in this embodiment, and FIGS. 25, 26 and 27 are detailed drawings of a cartridge control linkage in this embodiment, and depict the structure and operation of the cartridge control linkage. FIG. 28 is a detailed drawing of the guiding member in this embodiment, and FIGS. 29 and 30 are schematic drawings of a driving means, and a driving force receiving portion of the process cartridge, as seen from above. FIG. 31 is a sectional view of the essential portion of the image forming apparatus in this embodiment, and FIGS. 32 and 33 are front views of the electrophotographic image forming apparatus in this embodiment.

General Structure of Image Forming Apparatus

The components and portions of the apparatus, the functions of which are identical to those in the preceding embodiments, will be given the same reference codes to quote the descriptions regarding the preceding embodiments.

Process Cartridge

The components and portions of the process cartridge that are identical in function to those in the preceding embodiments are given the same reference codes so that the descriptions regarding the preceding embodiments can be quoted.

Structure for Installing or Removing Process Cartridge

Referring to FIGS. 31, 32 and 33, the apparatus main assembly C is provided with a pair of guiding members 351 and 352 (guides on the main assembly side) in the form of a rail, which function as a guide when the process cartridge 115 is installed into, or removed from, the image forming apparatus. The guiding member 351 is fixed to the apparatus main assembly C, on the side corresponding to the right-hand side of the process cartridge. The guiding member 352 is disposed on the side opposite to the guiding member 351 with respect to the process cartridge 115; in other words, the guiding member 352 is disposed on the side corresponding to the left side of the process cartridge 115. The guiding rail portions 351*a* and 353, which are the rail portions of the guiding portions 351 and 352, respectively, approximately extend parallel in the direction perpendicular to the plane of FIGS. 31, 32 and 33.

The guiding member 352 is provided with a guiding rail portion 353 in the form of a rail, which functions as a guide during the installation or removal of the process cartridge 115. This rail portion 353 is rendered rotatable in the direction indicated by the arrow mark A in FIG. 31.

FIG. 31 shows the state of the image forming apparatus, in which the process cartridge 115 has been situated at the predetermined image formation position after its descent.

FIG. 32 is a front view of the image forming apparatus, the door 360 of which has been opened toward the operator, about the hinge located at the bottom edge of the door. The door 360 is attached to the apparatus main assembly C with the use of the hinge located at the bottom edge of the door, and can be opened or closed about the hinge.

In the state depicted in FIG. 32, the projections 323 (first and second positioning portions on the cartridge side) of the process cartridge 115 are in the recesses 363 (first and second positioning portion on the apparatus main assembly side) of the apparatus main assembly C. Further, the projection 361 of the apparatus main assembly C is supporting the process cartridge 115 by the bottom 316*b* (third positioning portion on the cartridge side) of the process cartridge 115. The process cartridge 115 is provided with two projections 323, which are on the longitudinal ends of the process cartridge 115, one for one, projecting from the exterior surfaces, with their axial lines in alignment with the axial line of the photosensitive drum 111.

In this state, in order to pull the process cartridge 115 out of the apparatus main assembly, first, an operator rotates the cartridge control lever 321 in the direction indicated by an arrow mark B. FIG. 33 shows the state of the image forming apparatus after the cartridge control lever 321 is rotated 90 degrees in the direction of the arrow B from the position indicated in FIG. 32. As the cartridge control lever 321 is rotated, the guiding member 352 is rotated in the same direction, causing the guiding rail portion 353 of the guiding member 352 to push the projection 320*a* upward from underneath. As the process cartridge 115 is pushed upward, it ascends while pivoting in the clockwise direction about the tip of the aforementioned projection 361. During this ascent of the process cartridge 115, the axial line of the photosensitive drum 111 moves upward approximately vertically, that is, in the direction indicated by an arrow mark E in FIG. 32. Next, after the guiding member 319 makes contact with the guiding rail portion 351*a,* the process cartridge 115 is lifted, with the contact point between the guiding member 310 and guiding rail portion 351*a* functioning as a supporting point. As a result, the process cartridge 115 is separated from the projection 361, and the projections 323 are allowed to smoothly slip out of the aforementioned positioning recesses 363. After the process cartridge 15 is lifted to the position indicated in FIG. 33, the process cartridge 115 may be pulled in the direction perpendicular to the plane of the drawing, that is, toward the operator. With this action, the process cartridge 115 comes out of the apparatus main assembly C, with the guiding members 319 and 320 guided by the guiding rail portions 351*a* and 353.

On the contrary, when installing the process cartridge 115 into the apparatus main assembly C, the process cartridge 115 is inserted into the apparatus main assembly, and the cartridge control lever 32 is rotated in the direction indicated by an arrow mark D. With this action, the process cartridge 115 descends while pivoting in the counterclockwise direction, from the position shown in FIG. 33 to the position shown in FIG. 32, which is the image formation position.

Referring to FIG. 28, the guiding member 252 is provided with two pins 354, which are located at the longitudinal ends of the guiding member 352, one for one. Each pin 354 is fitted in the long groove 355*a* of the grooved member 355. Further, in the long hole 356 of the guiding member 352, a shaft 357 is fitted. The shaft 357 is rotatably supported by the apparatus main assembly C. The shaft 357 and long hole 356 together control the attitude of the guiding member 352 while the guiding member 352 is rotationally moved. More specifically, the guiding member 352 is controlled in position and attitude as the pin 354 slides in the direction indicated by an arrow mark H against the edge of the long groove 355*a*.

Referring to FIG. 24, the cartridge control lever 321 has a rotational range of 90 degrees. Within this 90 degrees of the rotational range, the range used for moving the process cartridge 115 is a range D2, that is, a range of 60 degrees from the point at which the cartridge control level 321 vertically hangs. In other words, in order to lift the process cartridge 115 which is in the image forming position illustrated in FIG. 24, the cartridge control lever 321, which is in the horizontal position, is rotated in the direction of the arrow mark F. During this rotation of the cartridge control lever 321, while the cartridge control lever 321 is rotated the first 30 degrees, the process cartridge 115 is not lifted, and while the cartridge control lever 321 is rotated through the rest of the rotational range, that is, the remaining 60 degrees, which corresponds to the range D2, until it comes to the point where it vertically hangs, the process cartridge 115 is lifted.

Figure 37:
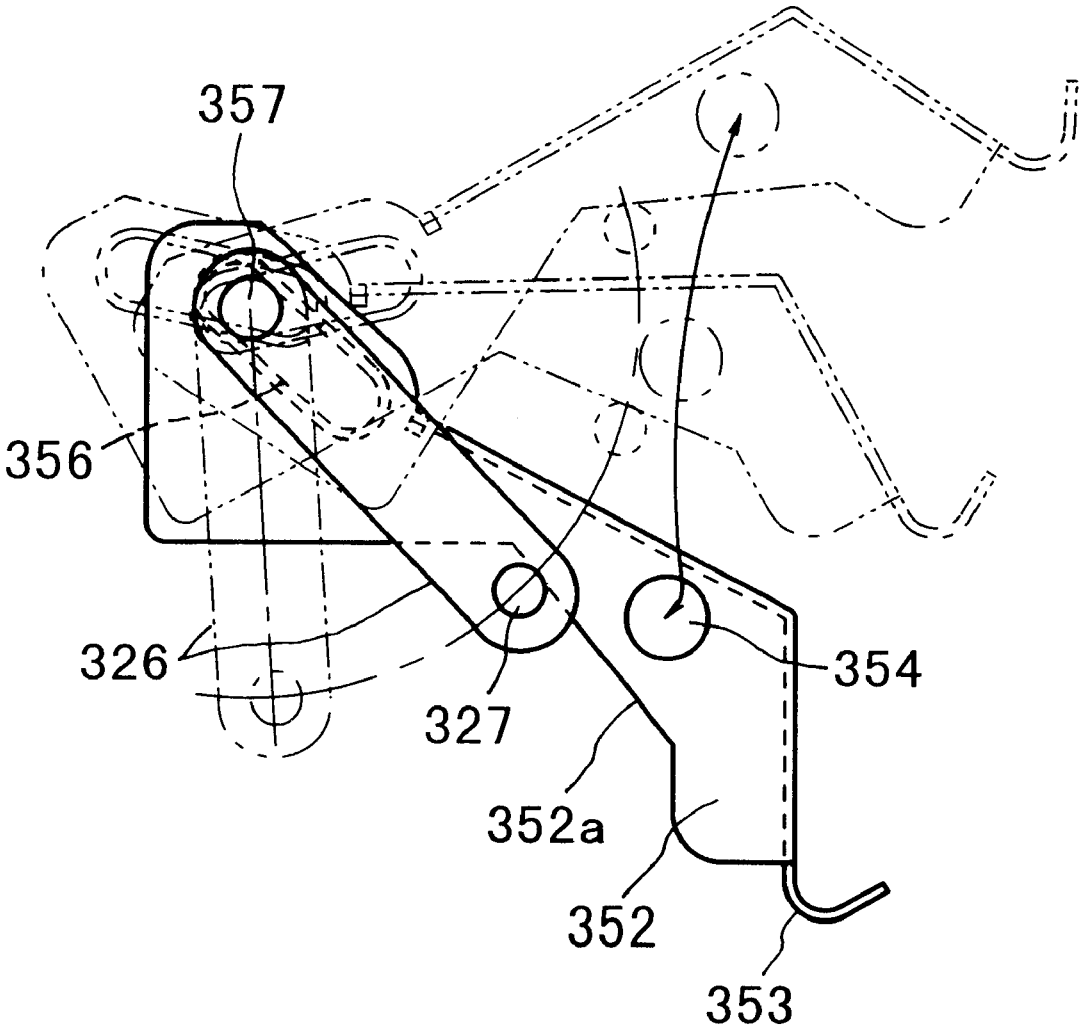
FIG. 37 is a front view of an interrelated portion between an operating lever and a guiding member according to the fifth embodiment of the present invention.

Referring to FIG. 37, the shaft 357 is rotatably supported by the apparatus main assembly C. To the shaft 357, the base portion of the cartridge control lever 321 is fixed, outside the apparatus main assembly C, and the base portion of the lever 326 is fixed, inside the apparatus main assembly C. As seen from the direction of the axis of the shaft 357, the lever 326 is located adjacent to the guiding member 352. To the end of the lever 326, a pin 327 is fixed. The shaft 357 is fitted with a torsional coil spring (unillustrated). One end of this torsional coil spring is anchored to the lever 326, and the other end is fixed to the guiding members 352. Thus, the force generated by the resiliency of the torsional coil spring acts to cause the pin 327 of the lever 326 to come into, and remain in, contact with the bottom edge 352*a* of the guiding member 352.

When the cartridge control lever 321 is in the horizontal position, the guiding rail portion 353 and the pin 327 of the lever 326 are at the bottommost positions in their moving ranges, as indicated by the double dot lines in FIG. 37. As the cartridge control lever 321 is rotated in the counterclockwise direction, the shaft 357 and lever 326 are rotated in the same direction, causing the pin 327 to slide against the bottom edge 352*a* of the guiding member 352 while pushing upward the guiding member 352. Further, the edge of the elongated hole 356 slides on the shaft 357 and the pins 354 slide following the elongated groove 355*a*.

The cartridge control lever 321 is fixed to the shaft 357, and the approximately 60 degree rotation of the cartridge control lever 321 causes the approximately 60 degree rotation of the guiding member 352.

The first 30 degrees of the rotation of the cartridge control lever 321, which corresponds to the range D1, simply places the cartridge control linkage in contact with the process cartridge 115, and does not cause the process cartridge 115 to move.

FIG. 25 is a detailed drawing of a cartridge controlling means 371. The cartridge controlling means 371 comprises the shaft 357, to which the cartridge control lever 321 is fixed, and which controls the attitude of the guiding member 352. The cartridge controlling means 371 further comprises: an arm 372 connected to the shaft 357; a cam 375 provided with a groove 374 in which a pin 373 provided on the arm 372 moves; and a rod 376 rotatably connected to the cam 375 with the use of a pin 377. The cam 375 is pivotally attached to the apparatus main assembly C with the use of a pin 375*a*.

FIG. 25 shows the state of the cartridge control means, or linkage, in which the cartridge control lever 321 is in the horizontal position. As the cartridge control lever 321 in this state is rotated, the arm 372 rotates in the direction indicated by an arrow mark G. With this rotation of the arm 372, the pin 373 of the arm 372 also rotates. The pin 373 is fitted in the groove 374 of the cam 375. Therefore, the cam 375 rotates in the direction indicated by an arrow mark Q. As the cartridge control lever 321 rotates from the horizontal position, the cartridge control means 371 rotates as shown in FIGS. 26 and 27. FIG. 26 shows the state of the cartridge control lever 321 when the cartridge control lever 321 has rotated 15 degrees from the horizontal position. As the cartridge control lever 321 rotates 15 degrees, the arm 372 of the cartridge control linkage 371 also rotates 15 degrees, which causes the cam 375 to rotate 33 degrees. As a result, the rod 376 moves to the illustrated position. The cartridge control lever 321 is further rotated from the position at which the arm 372 has rotated 15 degrees. Then, by the time the cartridge control lever 321 has rotated 30 degrees from the horizontal position, the cam 375 has rotated 53 degrees. However, while the cartridge control lever 321 is rotated from this position, corresponding to 30 degrees from the horizontal position, to the position corresponding to 90 degrees from the horizontal position, the pin 373 simply slides in the groove 374, and therefore, the cam 375 does not rotate. As the cam 375 rotates 53 degrees, the rod 376 rotatably connected to the cam 375 moves in its longitudinal direction up to the illustrated position. The groove 374 forms an arc, the center of which coincides with the axial line of the shaft 357.

The other end of the rod 376 is connected to the driving means 381 (FIG. 29) for driving the process cartridge 15. As the rod 376 moves in the direction of the arrow mark H in FIG. 29, the coupling 832, with which the driving means 381 is provided, retracts in the direction indicated by an arrow mark J, becoming disengaged from the coupling portion 383, that is, the portion through which driving force is received by the process cartridge 15, as illustrated. This driving force receiving portion 383 is fixed to the photosensitive drum 11. A flange (unillustrated) attached to the other longitudinal and of the photosensitive drum 11, that is, the longitudinal end opposite to the longitudinal end to which the driving force receiving portion 383 is fixed, is rotatably supported by the cleaning means frame 14*c*.

After this movement of the rod 376, there is nothing to constrain the process cartridge 15, and therefore, the process cartridge 15 can be lifted. Next, as the cartridge control lever 321 is rotated 60 degrees, the process cartridge 15 is lifted.

On the contrary, in order to lower the process cartridge 15, which is in the lifted position, to the position for image formation, the cartridge control lever 321 is rotated in the clockwise direction. As the cartridge control lever 321 is rotated 60 degrees, the process cartridge 15 descends to the image formation position. Then, the control lever 321 is further rotated in the clockwise direction, from the position corresponding to this image formation position for the process cartridge 15, by 30 degrees. With this rotation, the rod 376 moves in the direction of the arrow mark K as shown in FIG. 30, which is the direction opposite to the direction described regarding the lifting of the process cartridge 15, causing the coupling 382 to move in the direction indicated by an arrow mark L, and engages with the driving force receiving portion 383 of the process cartridge 15.

At this time, referring to FIG. 38, an example of the driving means 381, the movement of which is linked to the movement of the rod 376 and coupling 382, will be described.

The driving means 381 comprising a drive shaft 384, to one end of which the coupling 382 is fixed is supported by a bearing (unillustrated) in such a manner that the drive shaft 384 is allowed to advance or retract. An end face cam 385 is rotatably supported by the main assembly 387, by the drive shaft 384. The rotational axis of the cam 385 coincides with the rotational axis of the drive shaft 384. The end face cam 385 is supported by the main assembly 387, being not allowed to move in it axial direction. An end face cam 386 is supported by the main assembly 387, non-rotatably, but movably in the axial direction. The end face cam 386 is in contact with the rib 384*a* of the drive shaft 384. The drive shaft 384 is under the pressure from a compressed compression spring 388 disposed between the rear end of the drive shaft 384 and an immobile spring seat. The cam surfaces of the end face cams 385 and 386 are spiral. The rod 376 is connected to the peripheral portion of the end face cam 385 with the use of a pin 389.

Figure 38:
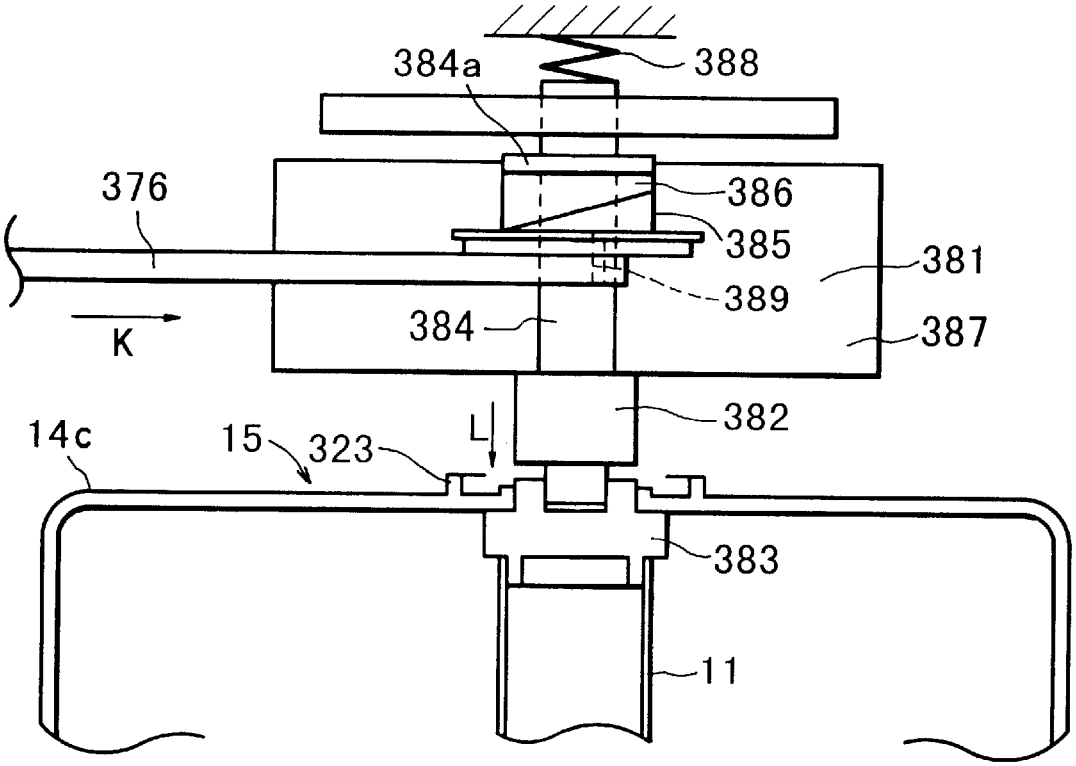
FIG. 38 is a sectional plan of driving means according to the fifth embodiment of the present invention.

Referring to FIG. 38, as the rod 376 is pulled in the direction opposite to the direction of the arrow mark K, the end face cam 385 rotates, causing the end face cam 386 to retract. As the end face cam 386 retracts, the rib 384*a* is pressed against the force of the spring 388. As a result, the drive shaft 384 retracts. With this action, the coupling 302 retracts from the driving force receiving portion 383 of the process cartridge 15, and becomes disengaged therefrom. On the contrary, as the rod 376 is pushed in the direction of the arrow mark K, the cam 385 rotates. Then, the drive shaft 384 under the pressure from the spring 388 advances. As the drive shaft 384 advances, the cam 386 is pressed by the rib 384*a*. As a result, the cam 386 moves toward the process cartridge 15 following the cam surface of the cam 385, allowing the drive shaft 384 to advance. As the drive shaft 384 advances, the coupling 382 engages with the driving force receiving portion 383.

As described above, according to this embodiment, as the process-cartridge control lever is operated for moving the process cartridge, not only the process cartridge is moved, but also it is assured that the driving means for driving the process cartridge and the process cartridge are reliably engaged. In other words, this embodiment is superior in operational simplicity.

In this embodiment, the process cartridge controlling means, which doubles as a means for connecting the process cartridge to the driving means, comprises an arm, a pair of cams, and a rod. However, the present invention does not place any restriction upon the components and structure of the cartridge controlling means, as long as the cartridge controlling means is capable of moving the process cartridge and connecting the process cartridge to the driving means, through a single operational stroke.

As for the moving range of the cartridge control lever, the range of 60 degrees is assigned for moving the process cartridge, and the range of 30 degrees is assigned for connecting the process cartridge to the driving means. However, the present invention does not place any restriction upon the moving range of the cartridge control lever in terms of size and how the moving range is allocated for specific movements of the process cartridge. In other words, an optimal configuration for the cartridge controlling means may be determined in consideration of the distance the process cartridge is moved, the force required to move the process cartridge, the distance the process cartridge is moved to be connected to the driving means, and the overall force necessary for controlling the process cartridge.

Embodiment 6

Figure 34:
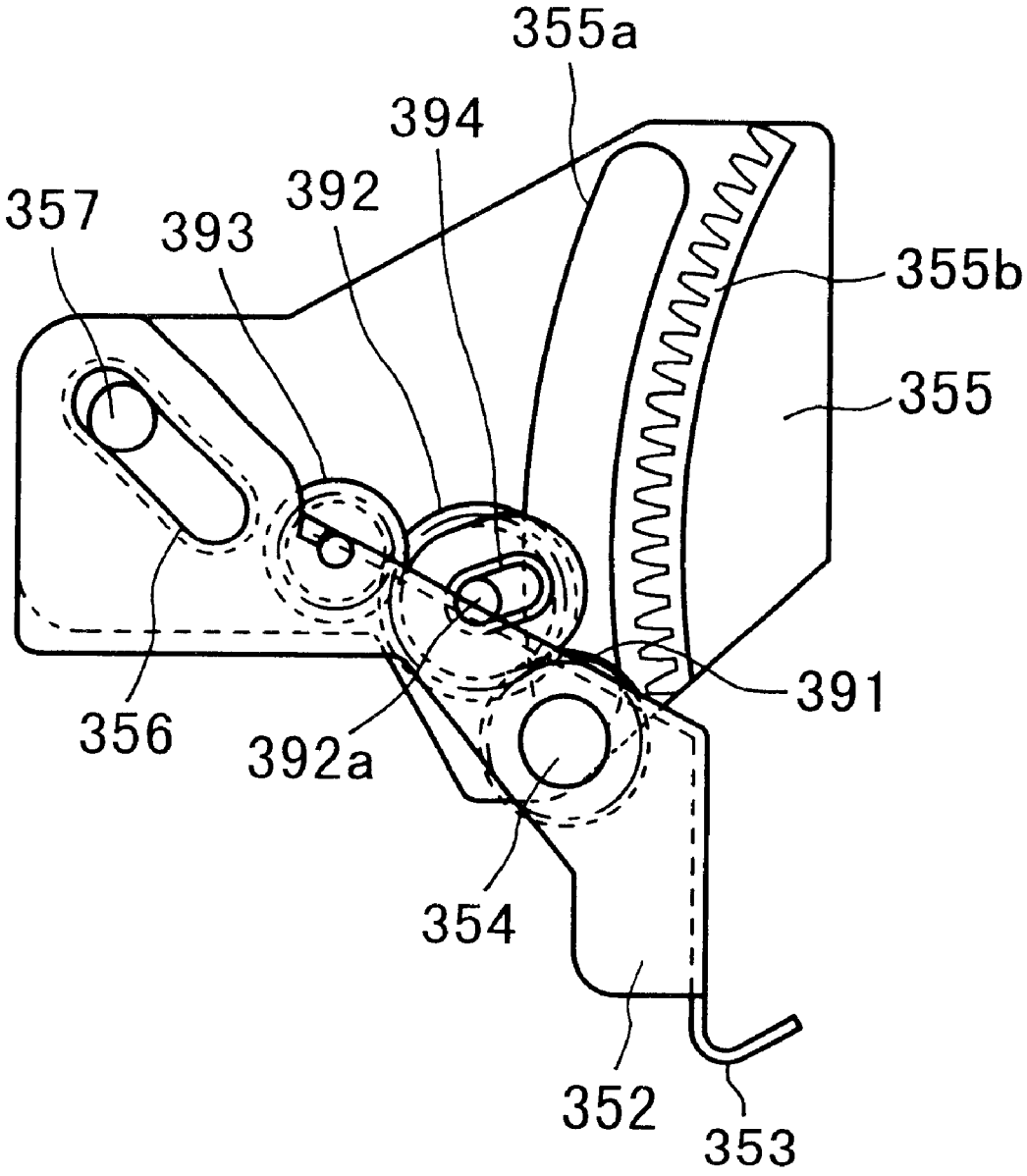
FIG. 34 is a detailed front view of a guiding number according to a sixth embodiment of the present invention.
Figure 35:
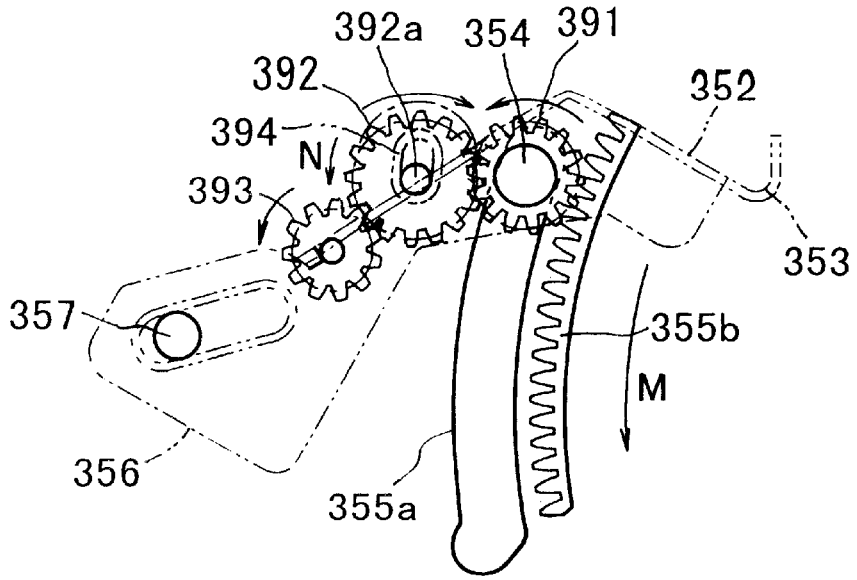
FIG. 35 is a detailed front view of a guiding number according to the sixth embodiment of the present invention.
Figure 36:
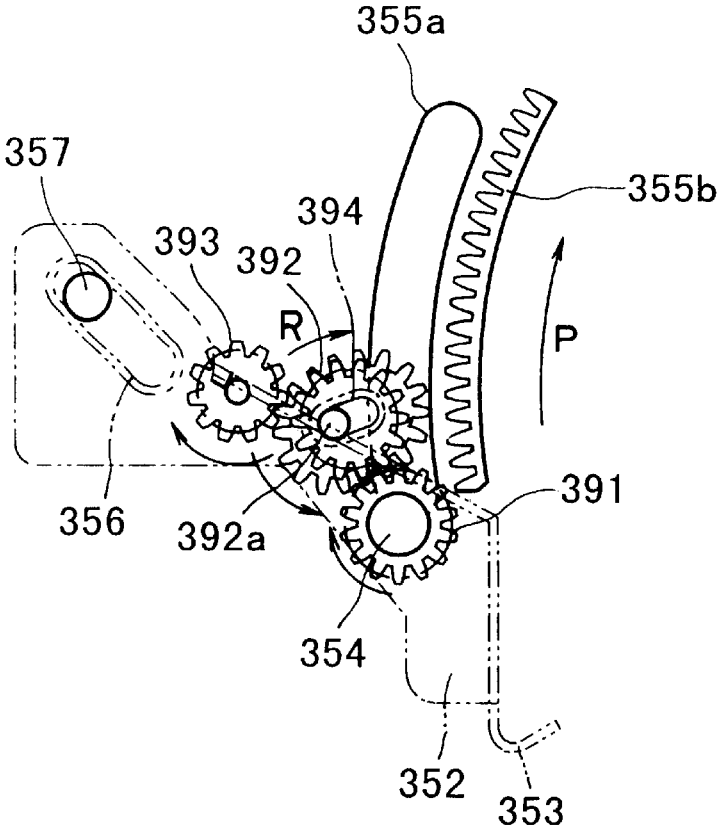
FIG. 36 is a detailed front view of a guiding number used in the sixth embodiment of the present invention.

FIGS. 34 to 36 are detailed drawings of the guiding member in the sixth embodiment of the present invention.

This embodiment is different from the fifth embodiment in that the guiding member is provided with a shock absorbing mechanism for cushioning the shock applied to the guiding member by the weight of the process cartridge itself as the process cartridge descends. The components and portions in this embodiment identical to those in the fifth embodiment are given the same reference codes so that the descriptions given regarding the fifth embodiment can be quoted.

Referring to FIG. 34, a gear 391 is rotatably fitted around the pin 354 with which the guiding member 352 is provided. The gear 391 is meshed with a gear 392, which is allowed to oscillate and is meshed with a dumper gear 393 provided with a dumping mechanism (unillustrated). The guiding member 352 is provided with an elongated hole 394 by which the gear 392 is supported in a manner to allow the gear 392 to oscillate. More specifically, the elongated hole 394 forms an arc, the center of which is included in the axial line of the pin 354, and the shaft 392*a* of the gear 392 is fitted in the elongated hole 394, being allowed to oscillate freely. On the other hand, a member 355 is provided with an elongated groove 355*a,* and a gear-shaped portion 355*b* which extends along the long groove 355*a*. This gear-shaped portion 355*b* meshes with the gear 391. The gear-shaped portion 355*b* constitutes a segment gear.

In the case of the above-described structure, when lowering the process cartridge 15 from the uppermost point of its moving range, the above described components move as shown in FIG. 35. In other words, as the guiding member 352 moves in the direction indicated by an arrow mark M, the gear 391, which meshes with the gear-shaped portion 355*b,* rotates in the counterclockwise direction while remaining meshed with the gear-shape portion 355*b*. As a result, the gear 392 rotates in the clockwise direction. Then, the gear 392 is moved by the driving force from the gear 391 in the direction indicated by an arrow mark N, that is, the direction to mesh with the dumper gear 393. As a result, the gear 392 meshes with the dumper gear 393, causing the load torque of the dumper gear to act on the gars 392 and 391. Thus, the guiding member 352 is prevented from being forced by the weight of the process cartridge 15 to instantly descend, being instead allowed to gradually descend, taking a certain length of time. On the contrary, when lifting the process cartridge 15 which is in the image formation position, the aforementioned components react as shown in FIG. 36. In other words, as the guiding member 352 is rotated in the direction of an arrow mark P, the gear 391 rotates in the clockwise direction. As the gear 391 rotates in the clockwise direction, the gear 392 rotates in the counterclockwise direction, and at the same time moves by the driving force, which the gear 392 receives from the gear 391, in the direction indicated by an arrow mark R, that is, the direction to move away from the dumper gear 393. In this situation, the gear 392 does not mesh with the dumper gear 393. Therefore, the load torque from the dumper gear does not act on the gears 392 and 391, and therefore, does not affect the operation of the process cassette control lever 321. During the lifting of the process cartridge 15, the gear 392 and dumper gear 393 repeat the process of meshing and unmeshing. Therefore, the load torque of the dumper gear 393 does not affect the operation of the process cartridge control lever 321 while the process cartridge is lifted.

In other words, according to this embodiment, the shock generated during the descending of the process cartridge is cushioned to make the lever feel comfortable to operate. Further, when lifting the process cartridge, the shock absorbing mechanism is kept disengaged to prevent the shock absorbing load torque from becoming active, and therefore, it is possible to offer the operator a light and comfortable feel of operation.

In this embodiment, the shock absorbing mechanism comprises a dumper gear. However, the present invention does not limit the shock absorbing mechanism to a dumper gear; a shock absorbing mechanism different from the above described one, for example, a shock absorbing mechanism comprising a spring, may be employed. Further, a shock absorbing mechanism may be directly connected to the shaft of a dumper gear.

Further, in this embodiment, an oscillatory gear is employed as the mechanism for disengaging a shock absorbing mechanism. The present invention does not limit the shocking-absorbing-mechanism disengaging mechanism to an oscillatory gear; any mechanism may be employed as long as the mechanism is capable of disengaging a shock absorbing mechanism through a simple one-way movement of the process cartridge.

According to the above described embodiment, as the operation for disposing a process cartridge into a predetermined position is carried out, the driving force receiving portion of the process cartridge is automatically connected to the driving means on the apparatus-main-assembly side. In other words, two operations can be carried through a single stroke of operation, improving the operational efficiency in the installation or removal of a process cartridge.

Even when a heavy process cartridge is installed, it descends gradually because the impact of the weight of the process cartridge is cushioned by the shock absorbing mechanism. Therefore, it does not occur that a large shock is generated by the landing of the process cartridge. Further, when lifting the process cartridge, the shock-absorbing-mechanism disengaging mechanism reacts to prevent the shock absorbing mechanism from working. Therefore, an operator can easily lift even a heavy process cartridge by applying a relatively small amount of manual force upon the process-cartridge control lever.

The process cartridges (15 and 115) in the preceding embodiments comprises: the electrophotographic photosensitive member (11 or 111); the developing member (development roller 18 or development sleeve 118) for developing an electrostatic latent image formed on the electrophotographic photosensitive member; the developer storage portion (toner storage container 16 or 116) for storing the developer used for developing the electrostatic latent image; the cartridge guides (a combination of guiding portions 20 and 20B, a combination of guiding members 119 and 120, or a combination of guiding members 210 and 220), which are guided by the guides (a combination of guiding rails 29 and 29B, a combination of guiding members 151 and 152, or a combination of projections 230 and 231) on the apparatus-main-assembly side, when the process cartridge is installed into the apparatus main assembly (27 or C); the first positioning portion (drum shaft 22*a,* projections 123, 223 or 323) which projects in alignment with the axial line of the electrophotographic photosensitive member from one of the longitudinal ends of the process cartridge, and engages with the first positioning portion (positioning groove 24, recess 163, or recess 263) on the main assembly side, as the process cartridge is caused to descend by the manipulation of the lever (lever 21 or 121 on the main assembly side, process cartridge control level 221 or 321), starting from the side opposite to the side where the developer storage portion is located, in the direction perpendicular to the axial line of the electrophotographic photosensitive member; and the second positioning portion (drum shaft 22*b,* projection 123, 223 or 323) which projects in alignment with the axial line of the electrophotographic photosensitive member from the other longitudinal end of the process cartridge, and engages with the second positioning portion (positioning groove 24, recess 163 or 263) on the apparatus-main-assembly side, as the process cartridge is caused to descend by the manipulation of the lever provided on the apparatus-main-assembly side, starting from the side opposite to the side where the development storage is located, in the direction perpendicular to the axial line of the electrophotographic photosensitive member.

The cartridge guides are disposed at both sides of the process cartridge, one for one, in terms of the direction perpendicular to the axial line of the electrophotographic photosensitive member.

The cartridge guides are extended in a direction parallel to the direction in which the process cartridge is inserted into the apparatus main assembly. The process cartridge enters the apparatus main assembly in a direction parallel to the axial line of the electrophotographic photosensitive member. Further, in order to position the process cartridge relative to the apparatus main assembly as the process cartridge is installed into the apparatus main assembly, the process cartridge is provided with the third positioning portion (supporting portion 15*c)* bottom portion 116*a,* 216*a,* or 316*a*), in addition to the first and second positioning portions.

As described above, according to the present invention, a process cartridge and the main assembly of an image forming apparatus are improved in terms of operativity regarding the installation or removal of the process cartridge into or from the main assembly.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive member;

a developing member for developing an electrostatic latent image formed on said electrophotographic photosensitive member;

a developer accommodating portion for accommodating a developer to be used by said developing member to develop said electrostatic latent image;

a cartridge guide for being guided by a main assembly side guide provided in the main assembly of the apparatus, when said process cartridge is mounted to the main assembly of said apparatus;

a first cartridge positioning portion, provided at one end portion in an axial direction of said electrophotographic photosensitive member, for engagement with a first main assembly side positioning portion, provided in the main assembly of the apparatus, in response to falling of a side of said process cartridge opposite from a side having said developer accommodating portion in a direction crossing with the axial direction of said electrophotographic photosensitive member by operation of a lever provided in the main assembly of the apparatus; and a second cartridge positioning portion, provided at the other end portion in an axial direction of said electrophotographic photosensitive member, for engagement with a second main assembly side positioning portion, provided in the main assembly of the apparatus, in response to falling of a side of said process cartridge opposite from a side having said developer accommodating portion in a direction crossing with the axial direction of said electrophotographic photosensitive member by operation of a lever provided in the main assembly of the apparatus.

2. A process cartridge according to claim 1, further comprising another cartridge guide, wherein said cartridge guides are disposed at one side and the other side in a direction crossing with the axis of the electrophotographic photosensitive member.

3. A process cartridge according to claim 2, wherein said cartridge guides are extended in a direction of insertion of said process cartridge into the main assembly of the apparatus, wherein said process cartridge is inserted into the main assembly of the apparatus along the axial direction of the electrophotographic photosensitive member.

4. A process cartridge according to claim 1 or 2, further comprising a third cartridge positioning portion in addition to said first cartridge positioning portion and said second cartridge positioning portion to position said process cartridge relative to the main assembly of the apparatus when said process cartridge is mounted to the main assembly of the apparatus.

5. A process cartridge according to claim 4, wherein said third cartridge positioning portion is provided on the same side as said developer accommodating portion in a direction crossing with the axial direction of said electrophotographic photosensitive member.

6. A process cartridge according to claim 1, wherein said first cartridge positioning portion is disposed coaxial with a driving force receiving portion for receiving from the main assembly of the apparatus a driving force for rotating said electrophotographic photosensitive member in the form of a drum, and is provided at one end portion of said electrophotographic photosensitive member, and said second cartridge positioning portion is a part of a drum shaft for supporting a cartridge frame at the other longitudinal end portion of said electrophotographic photosensitive member.

7. A process cartridge detachably mountable to a main assembly of an electrophotographic image forming apparatus, comprising:

an electrophotographic photosensitive drum;

a developing roller for developing an electrostatic latent image formed on said electrophotographic photosensitive drum;

a developer accommodating portion for accommodating a developer to be used by said developing roller to develop the electrostatic latent image;

a charge member for electrically charging said electrophotographic photosensitive drum;

a cleaning member for removing developer remaining on said electrophotographic photosensitive drum:

a removed developer accommodating portion for accommodating the developer removed from said electrophotographic photosensitive drum by said cleaning member;

a first cartridge guide for being guided by a first main assembly side guide provided in the main assembly of the apparatus when said process cartridge is mounted to the main assembly of the apparatus, wherein said first cartridge guide is disposed at one side in a direction crossing with a longitudinal direction of said electrophotographic photosensitive drum, and said first cartridge guide is extended in a direction of insertion of said process cartridge into the main assembly of the apparatus;

a second cartridge guide for being guided by a second main assembly side guide provided in the main assembly of the apparatus when said process cartridge is mounted to the main assembly of the apparatus, wherein said second cartridge guide is disposed at the other side in a direction crossing with a longitudinal direction of said electrophotographic photosensitive drum, and said second cartridge guide is extended in a direction of insertion of said process cartridge into the main assembly of the apparatus;

a first cartridge positioning portion, provided at one longitudinal end portion of the electrophotographic photosensitive drum, for engagement with a first main assembly side positioning portion provided in the main assembly of the apparatus in response to falling of a side which is provided with the removed developer accommodating portion and which is opposite from a side provided with said developer accommodating portion across said electrophotographic photosensitive drum, by operation of a lever provided in the main assembly of the apparatus, wherein said first cartridge positioning portion is disposed coaxial with a driving force receiving portion for receiving from the main assembly of the apparatus a driving force for rotating said electrophotographic photosensitive drum; and a second cartridge positioning portion, provided at the other longitudinal end portion of the electrophotographic photosensitive drum, for engagement with a second main assembly side positioning portion provided in the main assembly of the apparatus in response to falling of a side which is provided with the removed developer accommodating portion and which is opposite from a side provided with said developer accommodating portion across said electrophotographic photosensitive drum, by operation of a lever provided in the main assembly of the apparatus, wherein said second cartridge positioning portion is a part of a drum shaft supporting the other longitudinal end of said electrophotographic photosensitive drum on a cartridge frame, and wherein said process cartridge is inserted into the main assembly of the apparatus along a longitudinal direction of the electrophotographic photosensitive drum.

8. A process cartridge according to claim 7, further comprising a third cartridge positioning portion in addition to said first cartridge positioning portion and said second cartridge positioning portion to position said process cartridge relative to the main assembly of the apparatus when said process cartridge is mounted to the main assembly of the apparatus.

9. A process cartridge according to claim 8, wherein said third cartridge positioning portion is provided on the same side as said developer accommodating portion in a direction crossing with the axial direction of said electrophotographic photosensitive drum.

10. An electrophotographic image forming apparatus for forming an image on a recording material, to which a process cartridge is detachably mountable, said apparatus comprising:

(a) a main assembly side guide;

(b) a lever;

(c) a first main assembly side positioning portion;

(d) a second main assembly side positioning portion;

(e) a mounting portion for mounting the process cartridge, which includes:

an electrophotographic photosensitive member;

a developing member for developing an electrostatic latent image formed on said electrophotographic photosensitive member;

a developer accommodating portion for accommodating a developer to be used by said developing member to develop the electrostatic latent image:

a cartridge guide for being guided by said main assembly side guide when said process cartridge is mounted to the main assembly of said apparatus;

a first cartridge positioning portion, provided at one end portion in an axial direction of said electrophotographic photosensitive member, for engagement with said first main assembly side positioning portion in response to falling of a side of said process cartridge opposite from a side having said developer accommodating portion in the direction crossing with the axial direction of said electrophotographic photosensitive member by operation of said lever; and a second cartridge positioning portion, provided at the other end portion in an axial direction of said electrophotographic photosensitive member, for engagement with said second main assembly side positioning portion in response to falling of a side of said process cartridge opposite from a side having said developer accommodating portion in the direction crossing with the axial direction of said electrophotographic photosensitive member by operation of said lever.

11. An electrophotographic image forming apparatus for forming an image on a recording material, to which a process cartridge is detachably mountable, said apparatus comprising;

(a) a first main assembly side guide;

(b) a second main assembly side guide;

(c) a lever;

(d) a first main assembly side positioning portion;

(e) a second main assembly side positioning portion:

(*f*) a mounting portion for detachably mounting the process cartridge, which includes:

an electrophotographic photosensitive drum;

a developing roller for developing an electrostatic latent image formed on said electrophotographic photosensitive drum;

a developer accommodating portion for accommodating a developer to be used by said developing roller to develop the electrostatic latent image;

a charge member for electrically charging said electrophotographic photosensitive drum;

a cleaning member for removing a developer remaining on said electrophotographic photosensitive drum;

a removed developer accommodating portion for accommodating the developer removed from said electrophotographic photosensitive drum by said cleaning member;

a first cartridge guide for being guided by said first main assembly side guide when said process cartridge is mounted to the main assembly of the apparatus, wherein said first cartridge guide is disposed at one side in a direction crossing with a longitudinal direction of said electrophotographic photosensitive drum, and said first cartridge guide is extended in a direction of insertion of said process cartridge into the main assembly of the apparatus;

a second cartridge guide for being guided by said second main assembly side guide when said process cartridge is mounted to the main assembly of the apparatus, wherein said second cartridge guide is disposed at the other side in a direction crossing with a longitudinal direction of said electrophotographic photosensitive drum, and said second cartridge guide is extended in a direction of insertion of said process cartridge into the main assembly of the apparatus;

a first cartridge positioning portion, provided at one longitudinal end portion of the electrophotographic photosensitive drum, for engagement with said first main assembly side positioning portion in response to falling of a side which is provided with the removed developer accommodating portion and which is opposite form a side provided with said developer accommodating portion across said electrophotographic photosensitive drum, by operation of said lever, wherein said first cartridge positioning portion is disposed coaxial with a driving force receiving portion for receiving from the main assembly of the apparatus a driving force for rotating said electrophotographic photosensitive drum; and a second cartridge positioning portion, provided at the other longitudinal end portion of the electrophotographic photosensitive drum, for engagement with said second main assembly side positioning portion in response to falling of a side which is provided with the removed developer accommodating portion and which is opposite from a side provided with said developer accommodating portion across said electrophotographic photosensitive drum, by operation of the lever wherein said second cartridge positioning portion is a part of a drum shaft supporting the other longitudinal end of said electrophotographic photosensitive drum on a cartridge frame; and wherein said process cartridge is inserted into the main assembly of the apparatus along a longitudinal direction of the electrophotographic photosensitive drum.

* * * * *

UNITED STATES PATENT AND TRADEMARK OFFICE

CERTIFICATE OF CORRECTION

PATENT NO. : 6,405,004 B2
DATED : June 11, 2002
INVENTOR(S) : Hiroomi Matsuzaki

It is certified that error appears in the above-identified patent and that said Letters Patent is hereby corrected as shown below:

Title page,
Item [30], Foreign Application Priority Data, "11245163" should read -- 11-245163 --.

Column 1,
Lines 29 and 58, "mountably" should read -- mountable --.

Column 3,
Line 5, "side views" should read -- a side view --.
Lines 6, 50, 52 and 54, "number" should read -- member --.

Column 5,
Line 14, "15" should read -- 16 --.
Line 32, "6b" should read -- 16b --.
Line 44, "which which" should read -- with which --, and "cover 19" should read -- covers 19 --.
Line 49, "press" should read -- is press --.

Column 6,
Line 11, "cross sectional" should read -- cross-sectional --.
Line 26, "28" should read -- 20B --.

Column 7,
Line 36 "enganged" should read -- engaged --.
Line 65, "above described" should read -- above-described --.

Column 8,
Line 8, "FIG. 5," should read -- FIG. 7, --.
Line 22, "kelly-bar" should read -- kelly-bar 33b --.

Column 9,
Lines 35 and 41, "above described" should read -- above-described --.
Line 66, "be" should read -- to be --.

Column 10,
Line 9, "above described" should read -- above-described
Line 36, "alignment" should read -- in alignment --.
Line 47, "and" (2nd occurrence) should read -- are --.

UNITED STATES PATENT AND TRADEMARK OFFICE

CERTIFICATE OF CORRECTION

PATENT NO. : 6,405,004 B2
DATED : June 11, 2002
INVENTOR(S) : Hiroomi Matsuzaki

It is certified that error appears in the above-identified patent and that said Letters Patent is hereby corrected as shown below:

Column 11,
Line 3, "part: (14)" should read -- part (14) --.
Line 8, "above described" should read -- above-described --.
Lines 23 and 52, "13a )" should read -- 13a) --.
Line 44, " 22a )" should read -- 22a) --.
Line 57, "vided" should read -- vided, this first positioning portion being a part of the drum shaft by which the electrophotographic photosensitive drum is supported by the cartridge frame; and the second positioning portion (drum shaft 22b) which is located on the other longitudinal end of the process cartridge in terms of the longitudinal direction of the electrophotographic photosensitive drum, and engages with the second positioning portion (positioning groove 24) with which the apparatus main assembly (27) is provided, and the process cartridge (15) is allowed to descend from the removed developer storage portion (second toner storage bin 13a) side, that is, the side opposite to where the developer storage portion (toner storage container 16), with respect to the electrophotographic photosensitive drum (11), by the manipulation of the lever (main assembly side lever 21) with which the apparatus-main-assembly (27), is provided --.

Column 13,
Line 3, "night-" should read -- right- --.
Line 34, "side" should read -- slide --.
Line 43, "Further" should read -- Further, --.

Column 14,
Line 12, "door 16" should read -- door 160 --.
Line 39, "level 121," should read -- lever 121, --.
Line 45, "direction II," should read -- direction H, --.
Line 55, "rotates," should read -- rotated, --.
Line 60, "flucrum." should read -- fulcrum. --.

Column 15,
Line 3, "drum 11" should read -- drum 111 --.
Line 45, "above described" should read -- above-described --.

Column 16,
Line 3, "cartridge 15." should read -- cartridge 115. --.
Line 29, "above described" should read -- above-described --.

Column 17,
Line 29, "members 252" should read -- member 252 --.
Line 41, "rotatably" should read -- rotatable --.

UNITED STATES PATENT AND TRADEMARK OFFICE

CERTIFICATE OF CORRECTION

PATENT NO. : 6,405,004 B2
DATED : June 11, 2002
INVENTOR(S) : Hiroomi Matsuzaki

It is certified that error appears in the above-identified patent and that said Letters Patent is hereby corrected as shown below:

Column 18,
Line 8, "outward," should read -- upward, --.
Line 50, "pin 254" should read -- pins 254 --.

Column 19,
Line 27, "drum 11," should read -- drum 111, --.
Line 51, "cartridge 113" should read -- cartridge 115 --.

Column 20,
Line 5, "bottom" should read -- button --.
Line 38, "drum 11" should read -- drum 111 --.

Column 22,
Line 27, "apparatus 10" should read -- apparatus 110 --.

Column 24,
Line 39, "member 310" should read -- member 319 --.
Line 44, "cartridge 15" should read -- cartridge 115 --.
Line 54, "lever 32" should read -- lever 321 --.
Line 59, "member 252" should read -- member 352 --.

Column 25,
Line 9, "level 321" should read -- lever 321 --.

Column 26,
Line 14, "linkage 371" should read -- means 371 --.
Line 34, "coupling 832," should read -- coupling 382, --.

Column 27,
Line 23, "coupling 302" should read -- coupling 382 --.

Column 28,
Line 27, "above described" should read -- above-described --.
Line 32, "gear-shape" should read -- gear-shaped --.
Line 38, "gars 329" should read -- gears 392 --.

UNITED STATES PATENT AND TRADEMARK OFFICE

CERTIFICATE OF CORRECTION

PATENT NO. : 6,405,004 B2
DATED : June 11, 2002
INVENTOR(S) : Hiroomi Matsuzaki

It is certified that error appears in the above-identified patent and that said Letters Patent is hereby corrected as shown below:

Column 29,
Line 7, "above" should read -- above- --.
Line 20, "above described" should read -- above-described --.
Line 25, "carried" should read -- carried out --.
Line 41, "comprises:" should read -- comprise: --.
Line 64, "level 221" should read -- lever 221 --.

Signed and Sealed this

Thirteenth Day of April, 2004

JON W. DUDAS
*Acting Director of the United States Patent and Trademark Office*